US010562156B2

(12) United States Patent
Levinson

(10) Patent No.: US 10,562,156 B2
(45) Date of Patent: Feb. 18, 2020

(54) ERGONOMIC QUICK RELEASE MECHANISM FOR HAND-HELD CLAMPING TOGGLE LOCK TOOLS

(71) Applicant: RED DOG TOOL WORKS LLC, Savannah, GA (US)

(72) Inventor: David Levinson, Savannah, GA (US)

(73) Assignee: RED DOG TOOL WORKS, LLC, Savannah, GA (US)

( * ) Notice: Subject to any disclaimer, the term of this patent is extended or adjusted under 35 U.S.C. 154(b) by 287 days.

(21) Appl. No.: 15/178,186

(22) Filed: Jun. 9, 2016

(65) Prior Publication Data

US 2016/0361799 A1 Dec. 15, 2016

Related U.S. Application Data

(60) Provisional application No. 62/173,191, filed on Jun. 9, 2015.

(51) Int. Cl.

| | |
|---|---|
| ***B25B 7/12*** | (2006.01) |
| ***B25B 7/14*** | (2006.01) |
| ***B25B 13/50*** | (2006.01) |

(52) U.S. Cl.

CPC ..... *B25B 7/123* (2013.01); *B25B 13/5058* (2013.01)

(58) Field of Classification Search

CPC .... B25B 7/123; B25B 13/505; B25B 13/5058
See application file for complete search history.

(56) References Cited

U.S. PATENT DOCUMENTS

| | | | |
|---|---|---|---|
| 1,086,078 | A | 2/1914 | Palmer |
| 2,532,659 | A | 12/1950 | Burns |
| 2,543,922 | A | 3/1951 | Mead |
| 2,800,823 | A | 7/1957 | Tugend |

(Continued)

FOREIGN PATENT DOCUMENTS

| | | |
|---|---|---|
| DE | 20104732 U1 | 8/2001 |
| EP | 2826595 A1 | 1/2015 |

OTHER PUBLICATIONS

International Search Report issued by the United States Patent and Trademark Office for PCT/US2016/036696 dated Aug. 29, 2016.

(Continued)

*Primary Examiner* — Joseph J Hail
*Assistant Examiner* — J Stephen Taylor
(74) *Attorney, Agent, or Firm* — Johnson, Marcou & Isaacs, LLC; F. Brent Nix, Esq.; Gertrud U. Rey

(57) ABSTRACT

Embodiments disclosed herein provide an ergonomic quick release mechanism for hand-held clamping toggle lock tools where a fixed jaw and handle have another jaw movably attached. A moving handle assembly comprises a front handle section and a rear handle section held rigid to one another by a movable release trigger mounted on one of the two sections engaging a catch on the other section. The front handle section connects to the movable jaw and a toggle link. Squeezing the moving handle causes the jaws to close and a toggle pivot to go past toggle over center, locking the jaws. To unlock them, the release trigger is disengaged and the rear handle section is then squeezed causing it to rotate and contact an element of the fixed handle assembly at a release fulcrum point, causing the front handle section to rotate outward, releasing the toggle lock.

20 Claims, 31 Drawing Sheets

(56) References Cited

U.S. PATENT DOCUMENTS

| | | | | |
|---|---|---|---|---|
| 2,838,973 | A | 6/1958 | Peterson | |
| 5,014,578 | A | 5/1991 | Flentge | |
| 5,233,893 | A * | 8/1993 | Schmidt | B25B 7/123 81/368 |
| 6,227,080 | B1 | 5/2001 | Grayo et al. | |
| 6,708,588 | B2 | 3/2004 | Kesinger et al. | |
| 6,941,844 | B2 | 9/2005 | Hile | |
| 7,454,999 | B2 | 11/2008 | Wu | |
| 8,225,700 | B2 | 7/2012 | Hile | |
| 8,656,813 | B1 | 2/2014 | Aldredge | |
| 2013/0239759 | A1 | 9/2013 | Huang | |

OTHER PUBLICATIONS

Written Opinion of the International Searching Authority issued by the United States Patent and Trademark Office for PCT/US2016/036696 dated Aug. 29, 2016.

Supplementary European Search Report issued by the European Patent Office dated Jan. 24, 2019 for EP3307484.

* cited by examiner

FIG 2-1
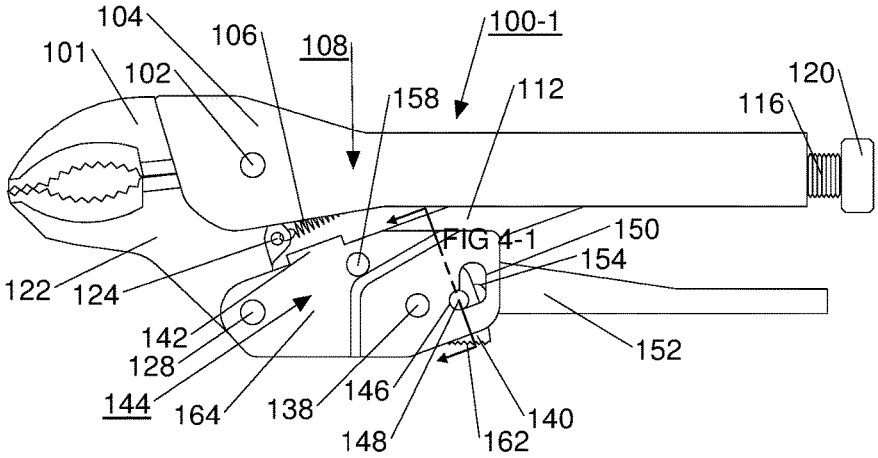
FIG 3-1
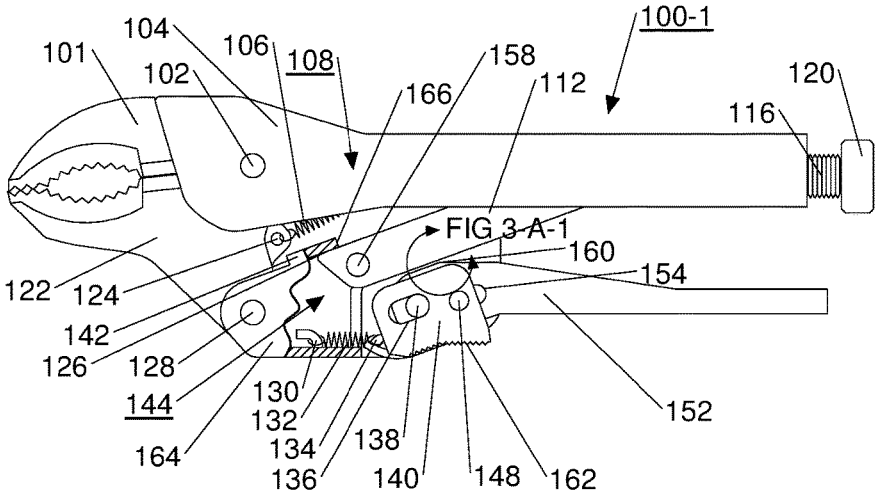
FIG 4-1
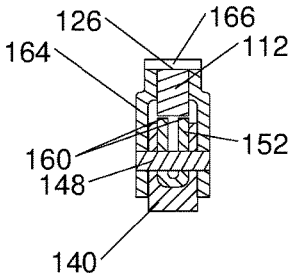
FIG 3-A-1
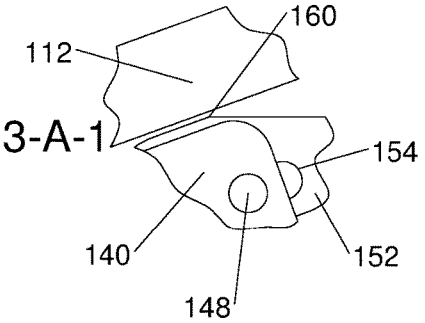

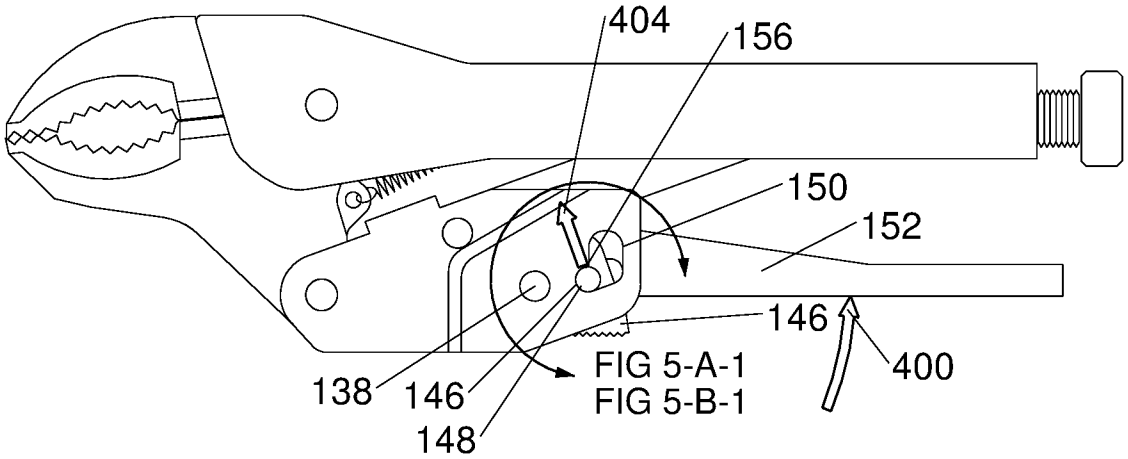
FIG 5-1
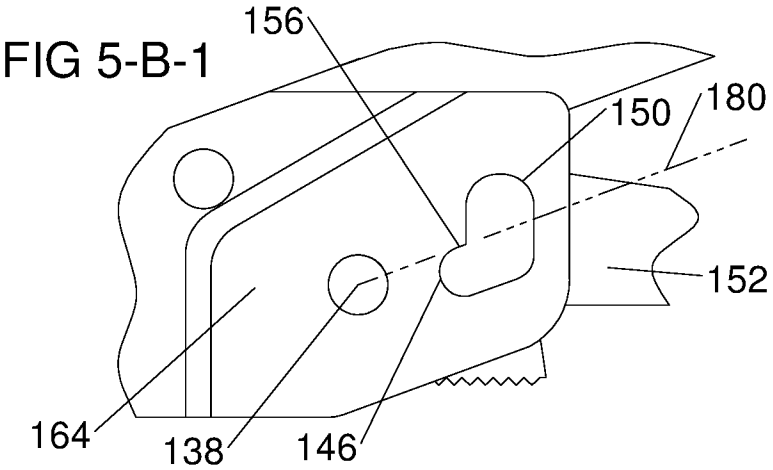
FIG 5-B-1
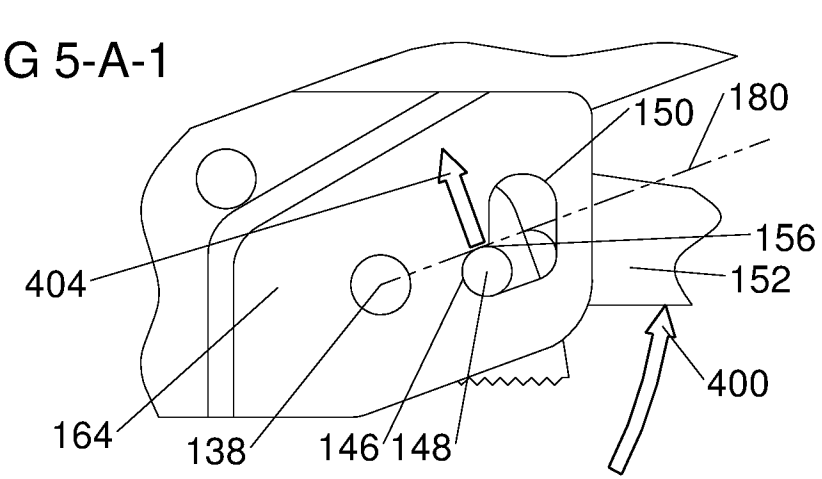
FIG 5-A-1

FIG 13-A-1
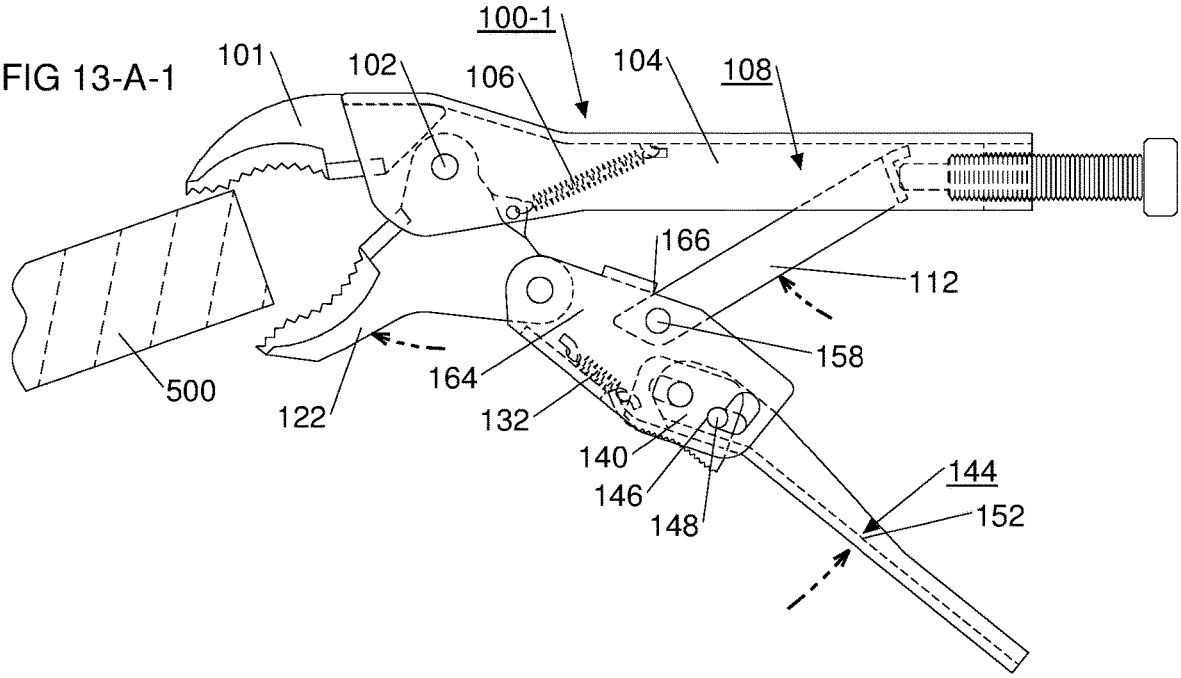
FIG 13-B-1
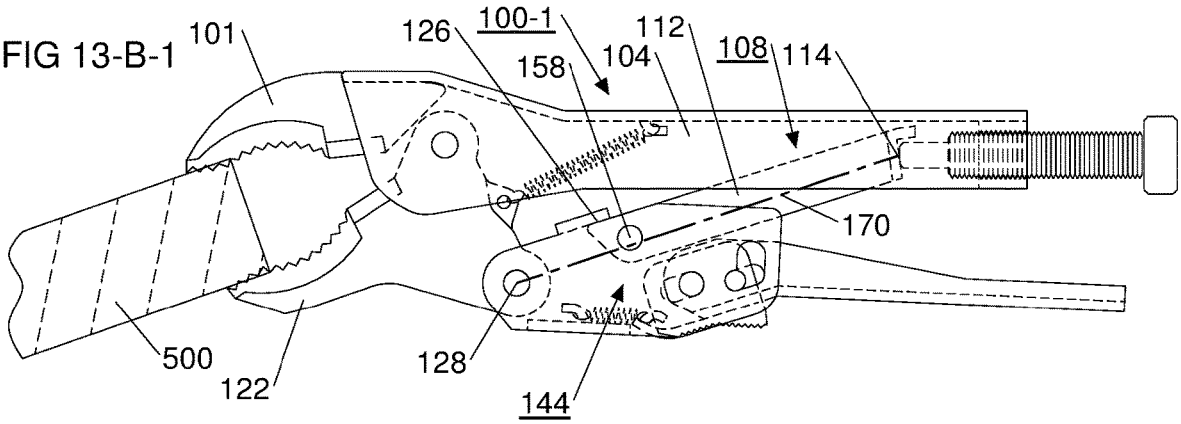

FIG 13-C-1
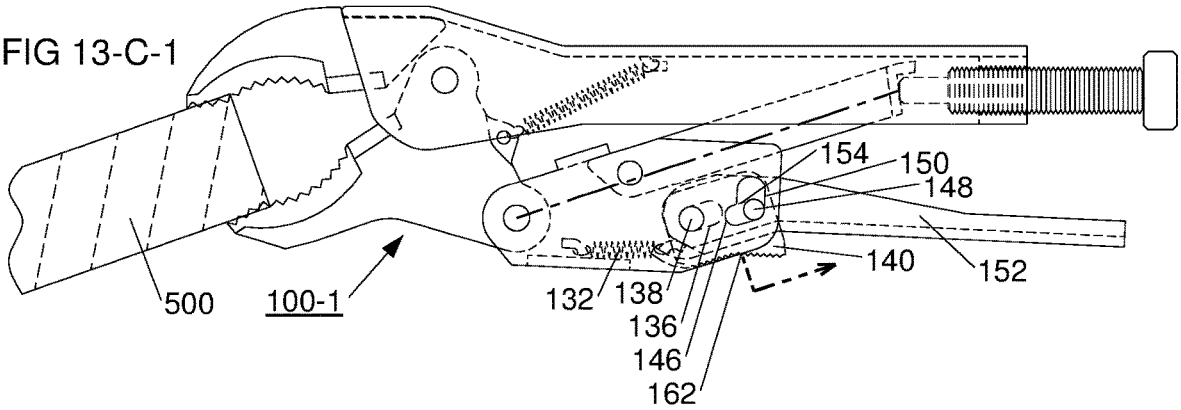
FIG 13-D-1
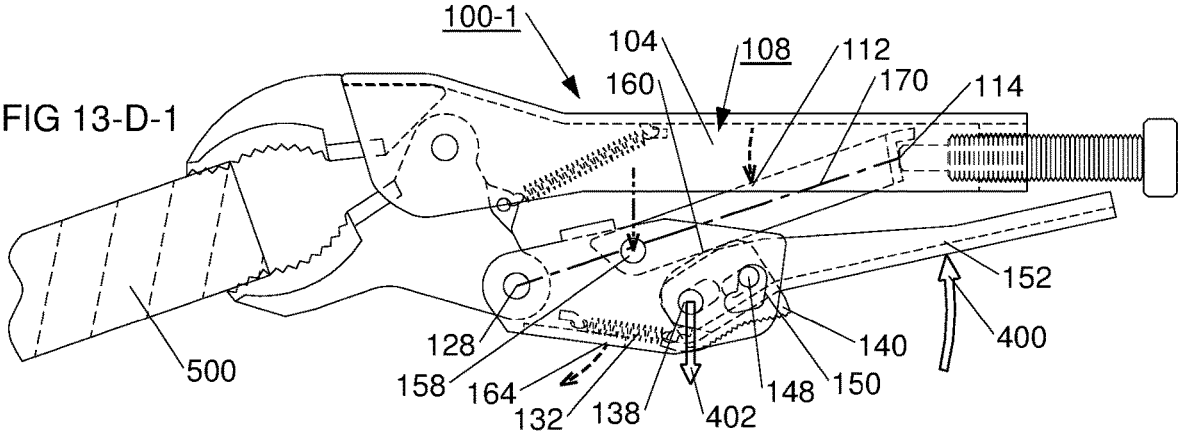
FIG 13-E-1
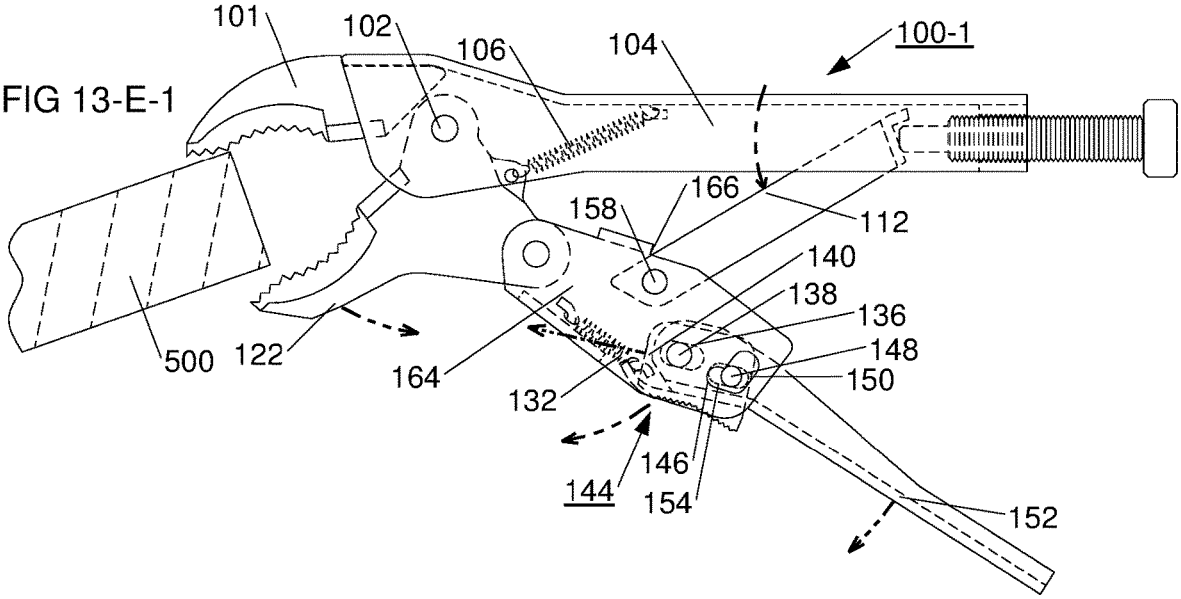

FIG 14-2 --PRIOR ART--
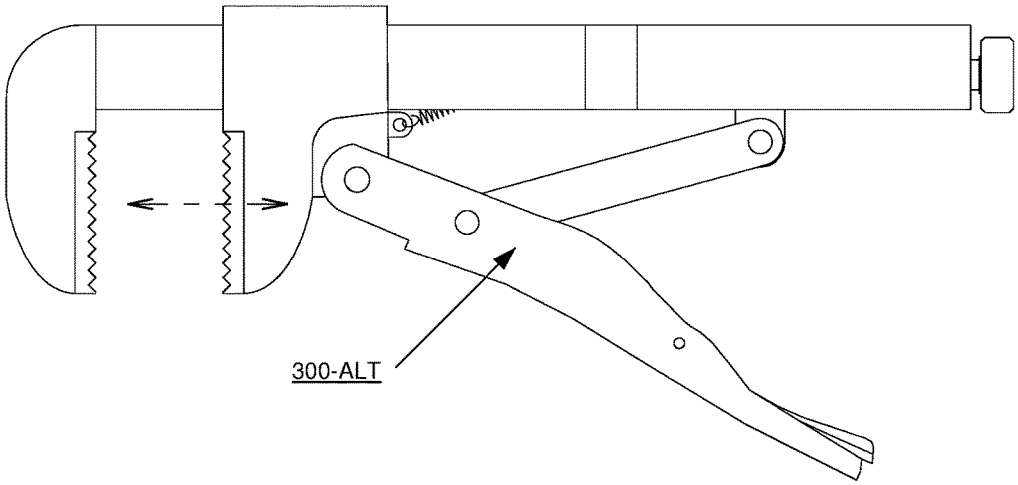
FIG 15-2 --PRIOR ART--
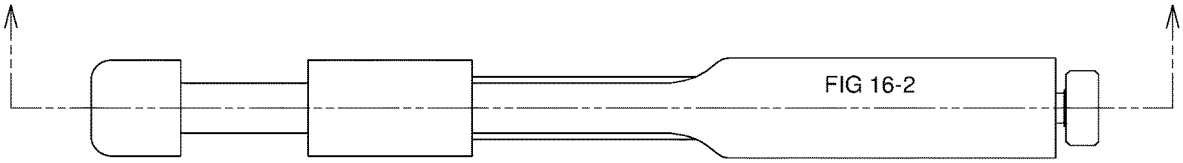
FIG 16-2 --PRIOR ART--
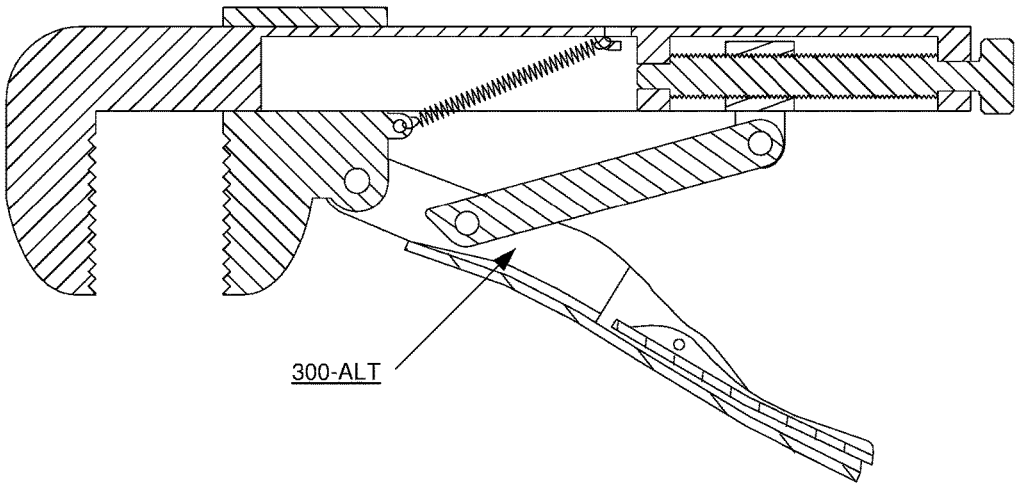

FIG 32-A-4
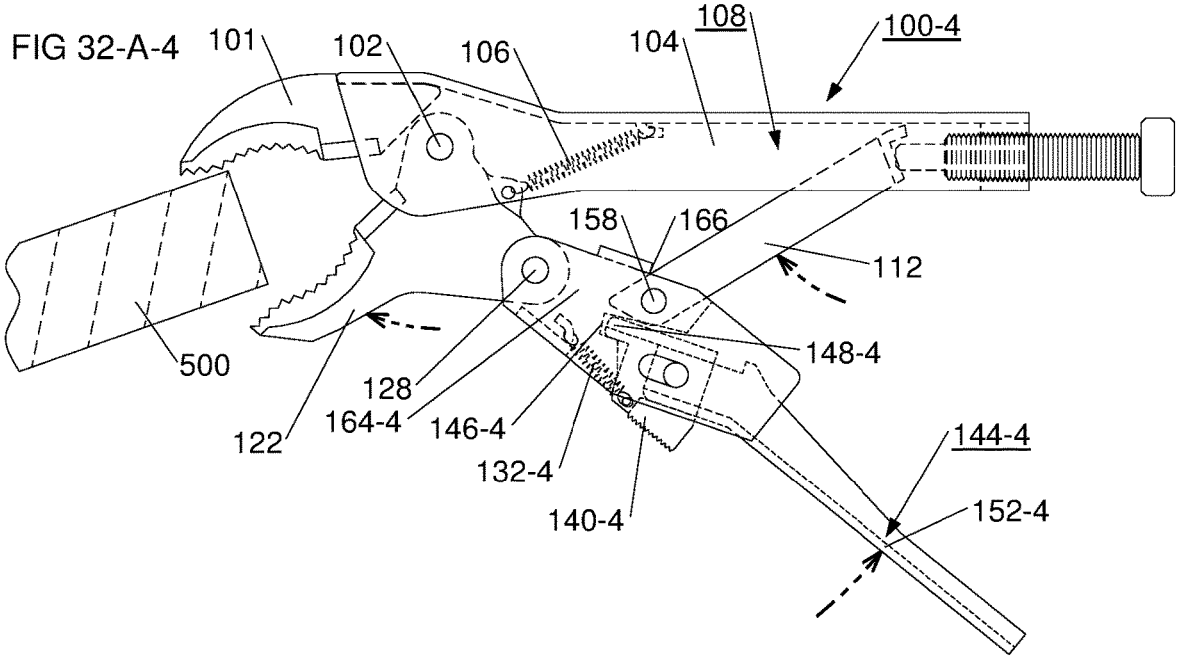
FIG 32-B-4
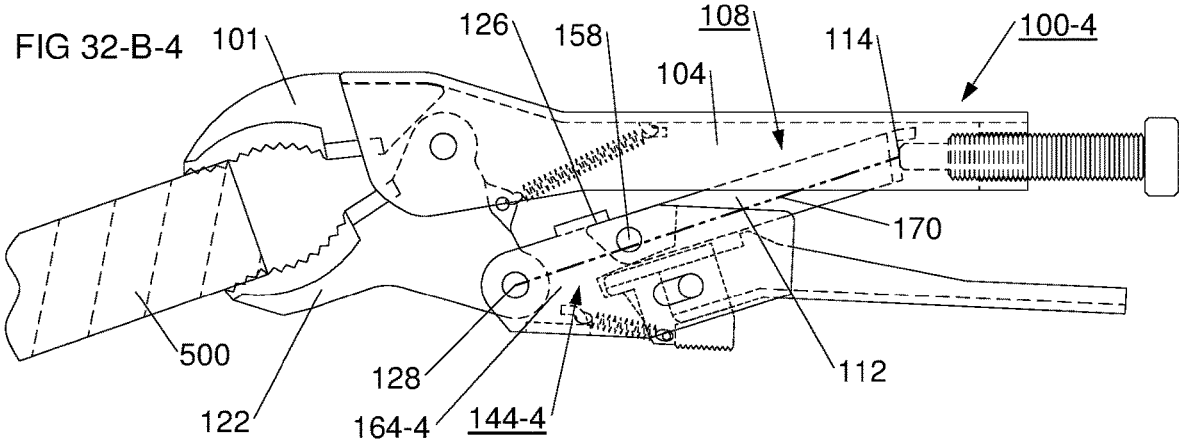

FIG 32-C-4
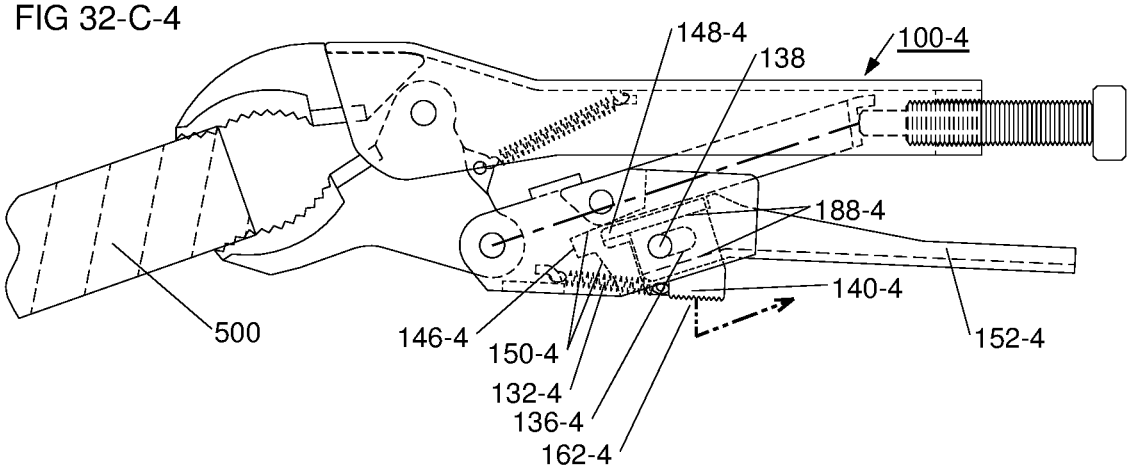
FIG 32-D-4
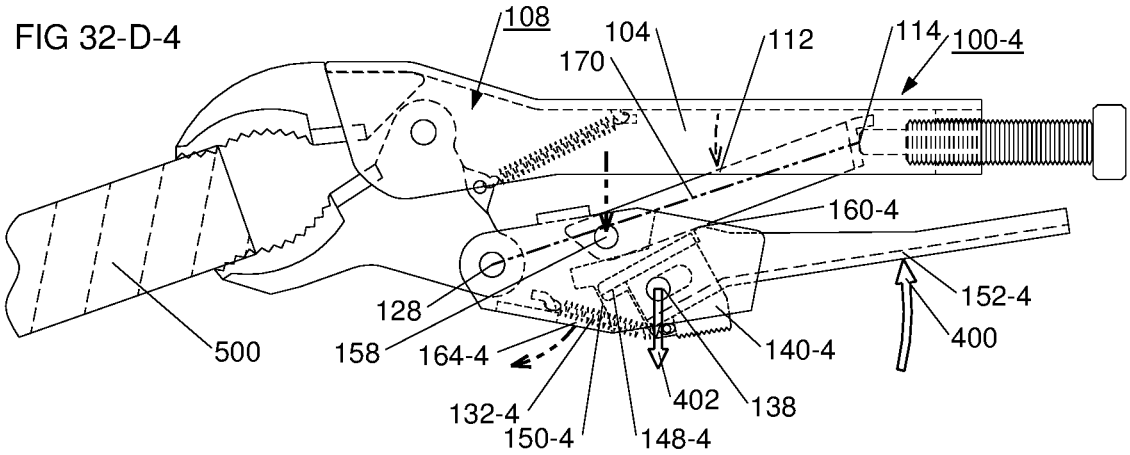
FIG 32-E-4
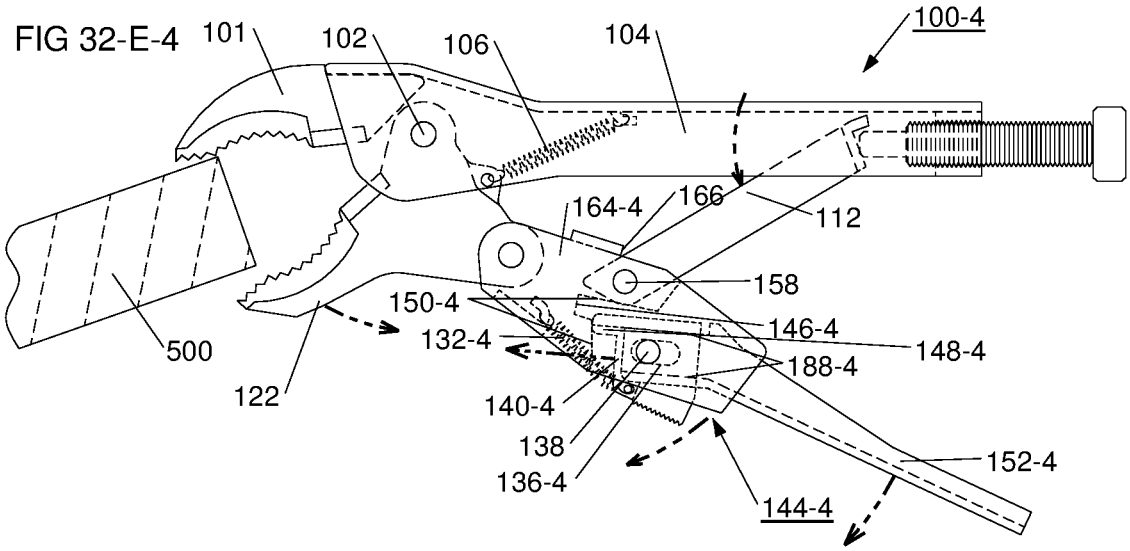

FIG 39-A-5
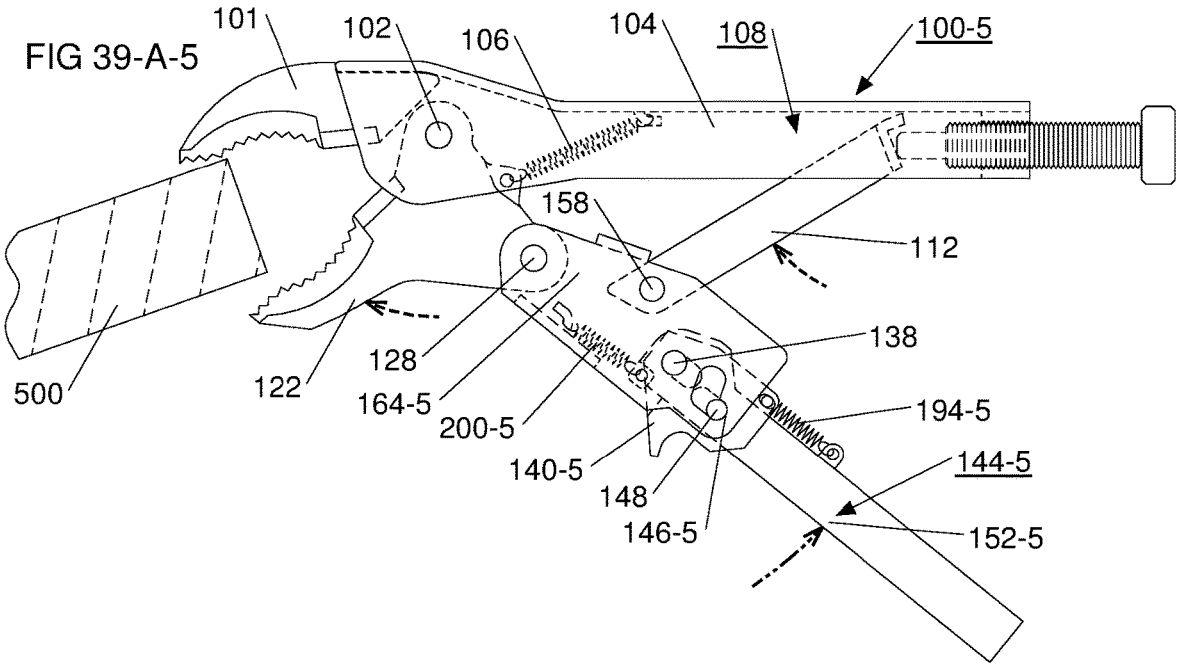
FIG 39-B-5
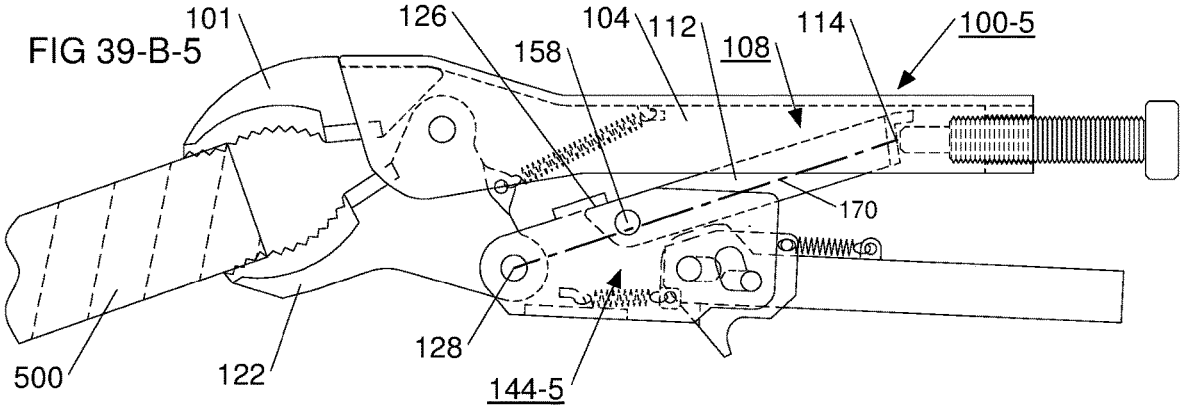

FIG 39-C-5
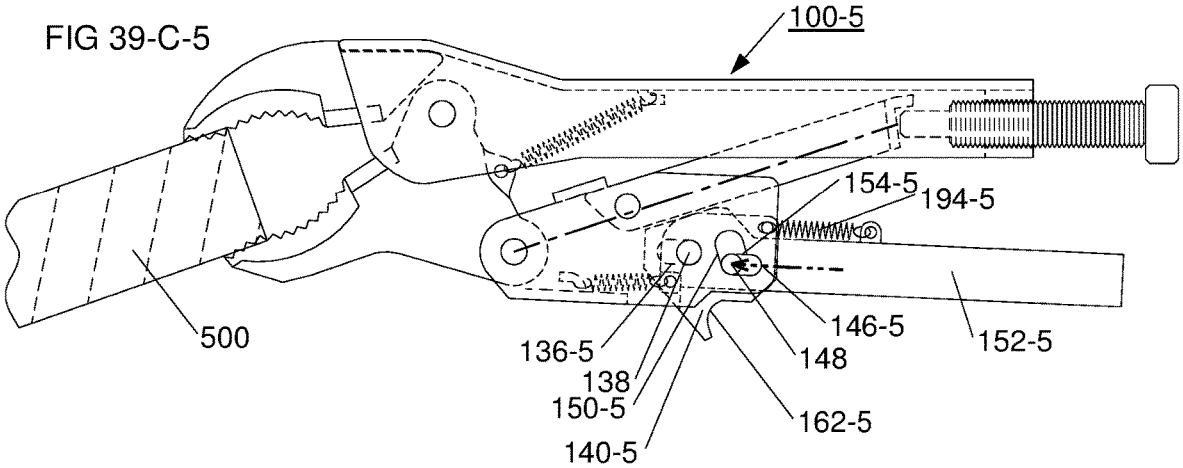
FIG 39-D-5
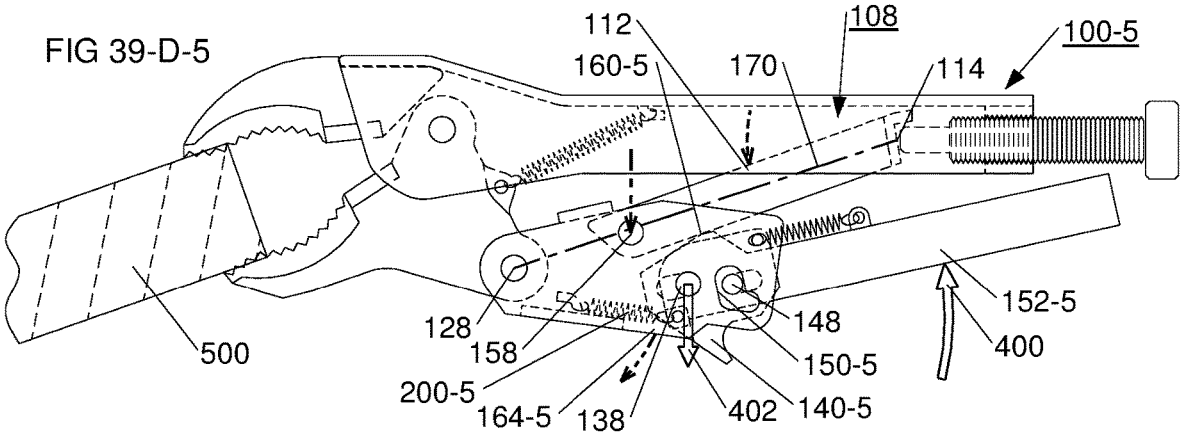
FIG 39-E-5
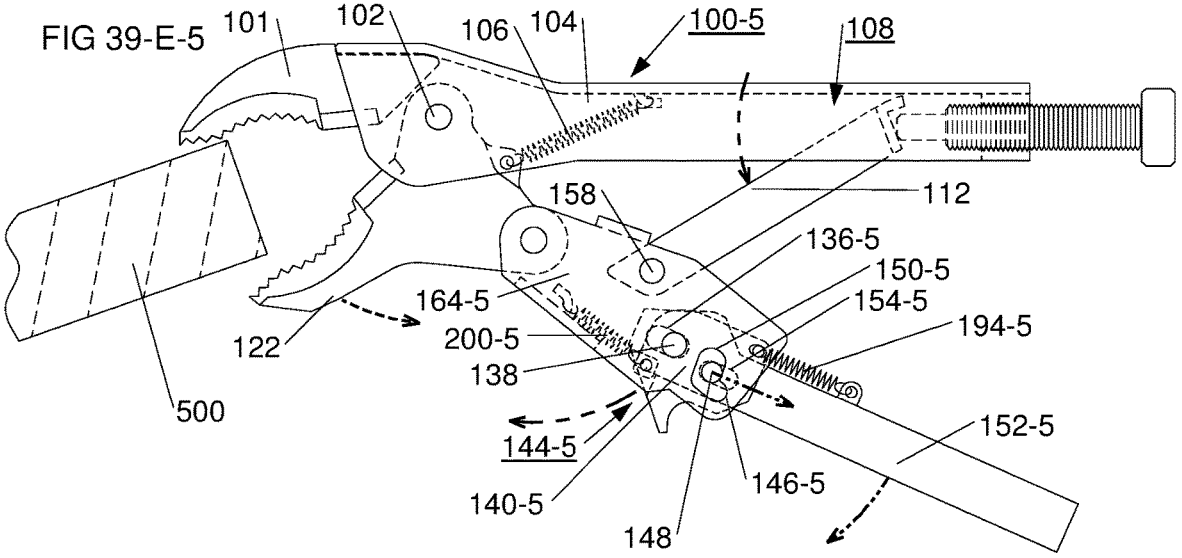

FIG 44-A-6
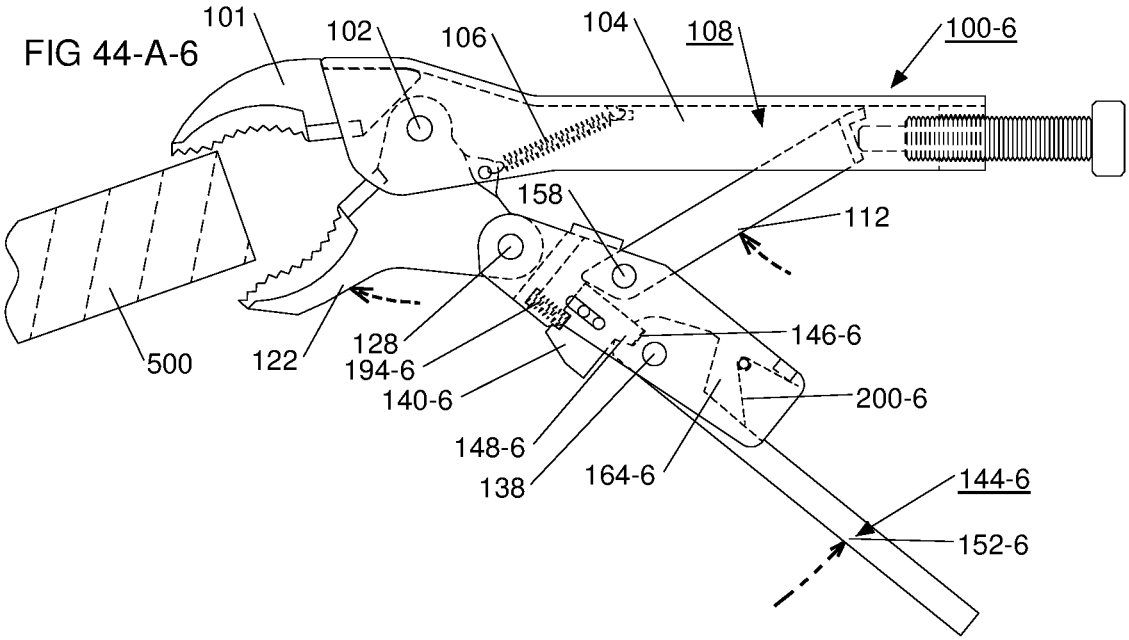
FIG 44-B-6
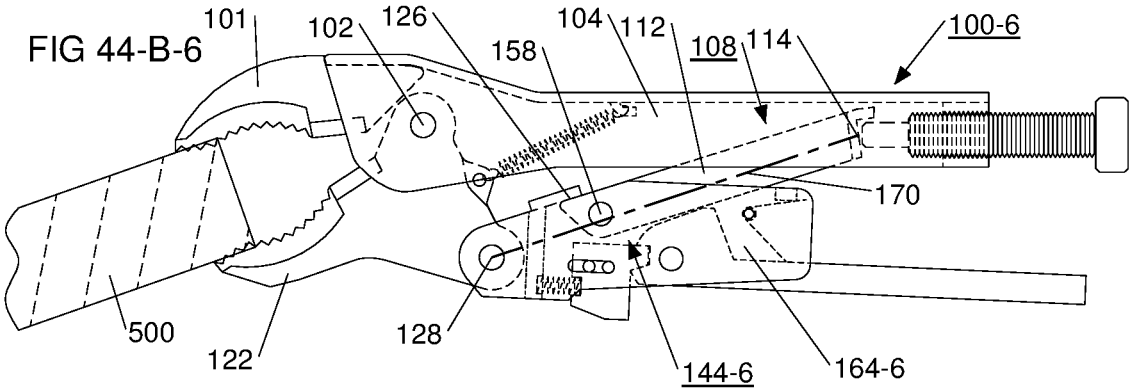

FIG 44-C-6
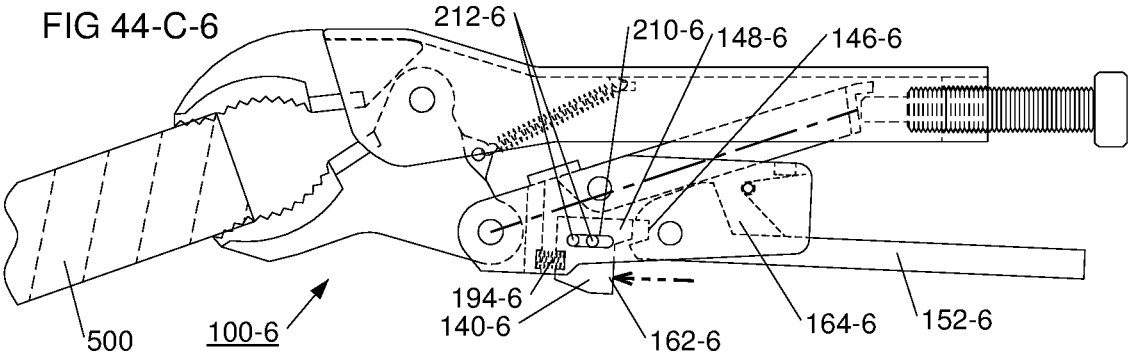
FIG 44-D-6
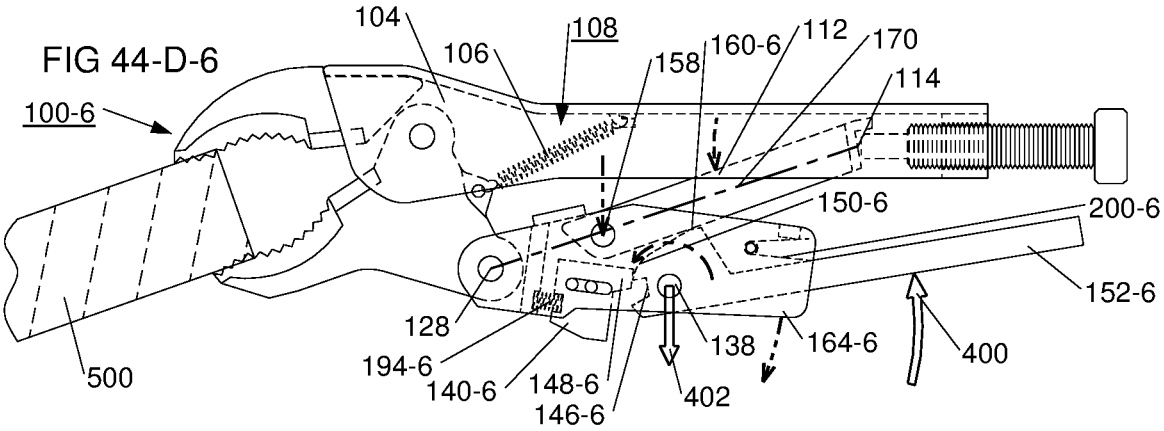
FIG 44-E-6
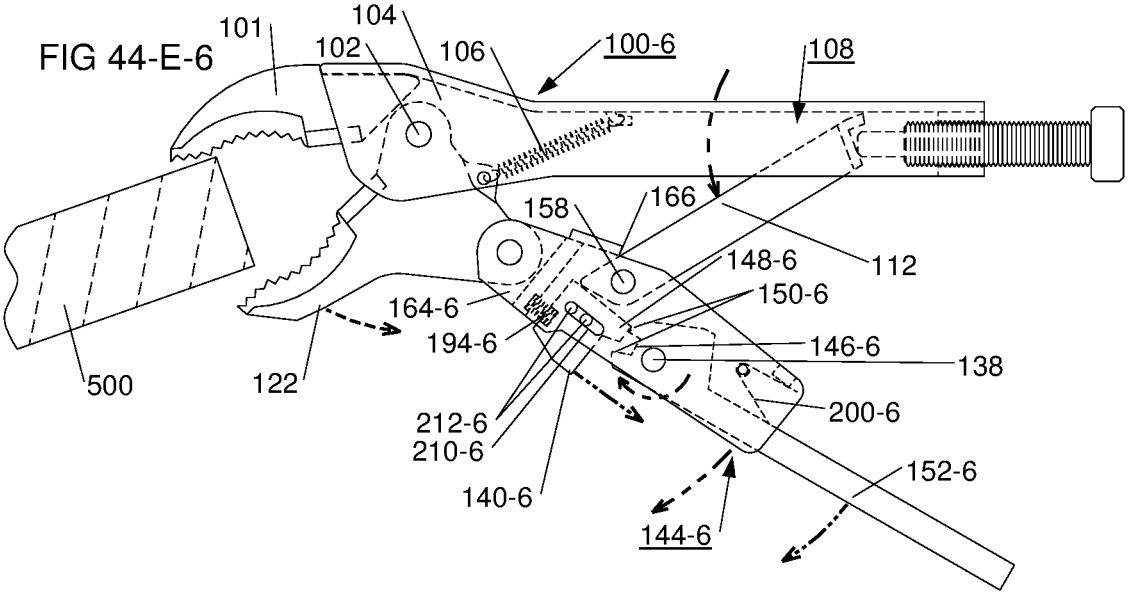

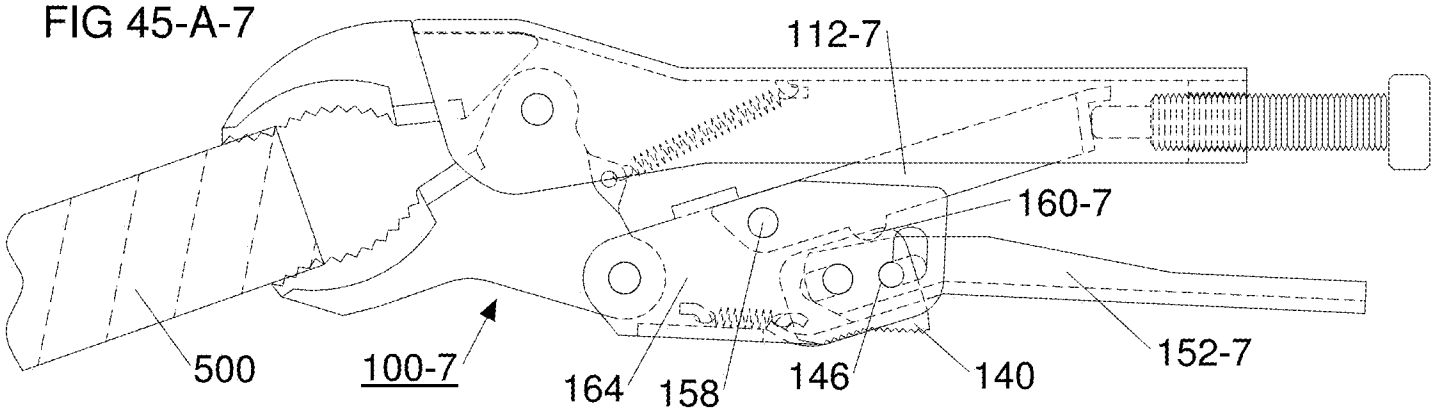
FIG 45-A-7
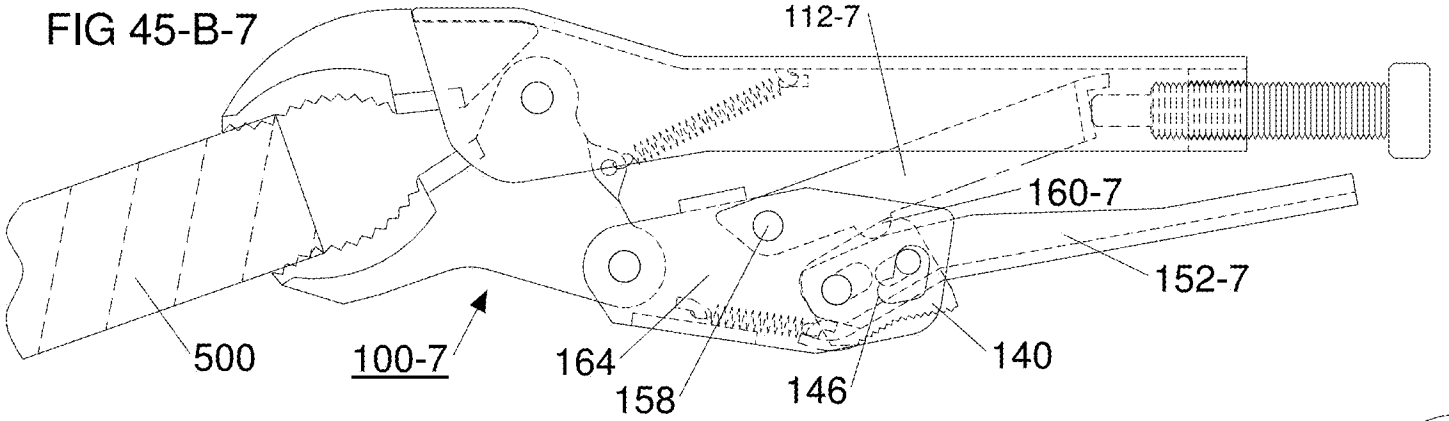
FIG 45-B-7
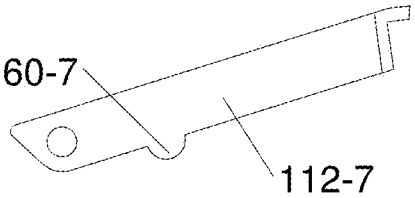
FIG 45-C-7

ERGONOMIC QUICK RELEASE MECHANISM FOR HAND-HELD CLAMPING TOGGLE LOCK TOOLS

CROSS-REFERENCE TO RELATED APPLICATIONS

This patent application claims priority to U.S. Provisional Patent Application No. 62/173,191, filed Jun. 9, 2015, and entitled "Ergonomic Quick Release Mechanism for Hand-Held Clamping Toggle Lock Tools." The entire disclosure of the above-identified priority application is hereby fully incorporated herein by reference.

TECHNICAL FIELD

The subject matter disclosed herein relates to toggle locking hand clamping tools such as locking pliers, clamps, wrenches and other clamping or crimping tools that use an over center locking toggle to securely grip crimp or cut the work-piece. More specifically, it applies to a release mechanism for locking pliers, clamps and the like, to release the jaws of the tools once locked on a work-piece.

BACKGROUND

Toggle locking gripping tools come in the form of pliers, wrenches, clamps, bar clamps, tongs and many other hand-held clamping and crimping tools. One example of one of the most widely recognized types are pliers known by the trademark name Vise-Grip®.

These tools have a jaw fixed to a stationary handle, a movable jaw connected to a moving handle with a toggle link member connecting both the moving handle at a toggle pivot and the fixed handle. Typically, but not always, there is a means to adjust the opening space between the two jaws by moving the toggle link connection in relation to the fixed jaw. These means can consist of an adjustment screw or other means in the fixed handle or more recently "auto adjusting" type tools such as U.S. Pat. No. 6,708,588 to (Kesinger et al. 2004) that use cams, lock washers and the like that automatically clamp at a set force without needing any manual jaw opening adjustment.

Operation of these types of tools is simple; the operator squeezes the moving handle towards the fixed handle. This causes the two jaws to grip the work-piece and simultaneously causes the moving handle and toggle link to rotate inwards towards the fixed handle. As a result the toggle pivot moves just past what is commonly referred to as toggle over center line (also referred to as over center lock or past dead center) which is a reference line between the attachment of the moving handle to moving jaw and the attachment of the toggle link to the fixed handle body. This results in the tool positively gripping the work-piece with forces that can be enormous (this is often referred to as the jaws being locked, jaws toggle locked or toggle lock).

Many solutions to the problem of releasing the jaws when locked have been tried and all have disadvantages.

When toggle lock tools first started coming on to the market, the only way to release the force was to pry the two handles apart. This required the user to have to use both hands to accomplish this and the outwards release of great force could injure the user and/or damage the work-piece.

Later versions incorporated a release lever in the moving handle that projected out past the end of the moving handle. Moving this handle resulted in it contacting either the toggle link or fixed handle body, resulting in the moving handle moving outwards, the toggle pivot moving back over the toggle over center line and the jaws being unlocked. Once again, operation of this lever required the user to either shift their hand on the tool or use both hands. In addition, the user could only use the force of one or two fingers, which were often pinched by the release lever and handles.

Some inventions such as U.S. Pat. No. 8,225,700 (Hile, 2012) tried to solve the release problem by having a releasable 'fixed' jaw with a thumb release on the fixed handle. Apart from the added mechanical complexity and cost, there are ergonomic issues such as limited gripping area on the fixed handle and the potential for accidental release from hitting the thumb release when using the tool.

More recently some toggle lock pliers have been marketed using an outwards release method involving an extra link between the toggle link and moving handle. This gives the invention added mechanical advantage but does not change the fact that two hands are still needed to pry the two levers apart, nor does it address the issue of the violent release of outwards force. U.S. Pat. No. 2,838,973 (Peterson, 1958) and U.S. Pat. No. 7,454,999 (Wu, 2008) are two such examples of this type of toggle lock pliers.

There have been a few attempts at creating a release method using a moving segmented handle and having the rear section pivot inwards towards the fixed handle to release the toggle lock, all of which have serious shortcomings.

U.S. Pat. No. 2,532,659 (Burns, 1950) uses a segmented handle that has a rear segment called a releasing handle pivoting inwards to release the toggle lock. In this design, the releasing handle latches directly onto the toggle linkage ('Toggle linkage' in this patent is the definition for the front handle section) without any intermediary member. The operator releases the toggle lock by sliding the releasing handle detent means from engagement with the toggle linkage detent means. A cam projection provides a fulcrum on the releasing handle that contacts the fixed handle that causes the toggle lock to be broken when the releasing handle is rotated inwards towards the fixed handle.

This design creates two conflicting problems: Either the releasing handle is easily slid off the detent, which could result in a violent accidental release of the jaws while torqueing the pliers; or the releasing handle is stiff in relation to the detent, thus making the releasing handle difficult to easily manipulate from the detent in order to release the toggle lock. In addition, because the cam is used as a toggle pivot over center stop, it results in large outwards torque force on the release handle making disengaging the detent difficult when the jaws are locked.

U.S. Pat. No. 2,543,922 (Mead, 1951) uses a segmented handle using a rear handle section pivoting inwards towards the fixed handle to release the toggle lock. In this design, a key block acts as a release member sandwiched between the front handle section and rear handle section normally keeping the two rigid to one another with thicker key block cross section. By sliding the block sandwiched in between the front and rear handle sections, the key block cross section is moved out from between the two sections allowing some loose play, which allows the user to pivot the rear handle section inward. Pivoting the rear section inwards results in the fulcrum point part of the rear handle section coming in contact with the toggle bar, which causes the front handle section to rotate outwards and the toggle lock to be broken.

This design has multiple serious drawbacks. By sandwiching the key block between the front and rear handle sections, instead of mounting and retaining the block movably on one section or the other, the key block has the chance of falling out of the assembly altogether if the two sections are not tightly sandwiching the key block. Conversely, if the two sections do sandwich the key block tightly, the key block will be difficult to operate because of high friction.

In addition, because the rear handle section is used as a toggle pivot over center stop, it will result in large outwards torque force on the rear handle section when the jaws are locked. The resulting torque and movement of the rear handle section could force the key block out between the two sections. This would result in the front and rear sections becoming accidently uncoupled and no longer rigid to one another.

Another major issue with this design is the fact that the range of rotation of the rear handle section is limited by the presence of the key block sandwiched in between the front and rear handle sections; in some cases this could result in there not being enough inward rotation movement to break the toggle lock. Yet another problem is that the key block would constantly be getting caught on the shank of the front handle section because there is no means of guiding it into alignment.

Often confused with toggle lock pliers is another type of locking pliers such as U.S. Pat. No. 6,227,080 (Grayo et al, 2001). Although these types of locking pliers have a release trigger on the moving handle, they do not use an over toggle locking design, but instead use a catch to engage and stop the toggle pivot just short of passing over the toggle over center line. The toggle lock is released by triggering this catch. This type of locking plier design has several problems such as the added mechanical complexity resulting in increased cost and reduced reliability. The catch is subject to a large force over a small area and can wear rapidly, and at higher force settings it can be difficult to get the catch to engage at all.

SUMMARY

In accordance with certain example embodiments, an ergonomic quick release mechanism for hand-held clamping toggle lock tools may be summarized as follows. A fixed handle assembly, consisting of a fixed handle body with a fixed jaw at one end. A toggle link is movably attached to the fixed handle body at a distance from the fixed jaw. A movable jaw is movably attached to the fixed handle assembly. A means to retract the movable jaw away from the fixed jaw (such as a retraction spring) and a means to adjust the jaw opening space (such as a toggle link position adjustment screw) may also be included.

A moving handle assembly comprising a front handle section and rear handle section is movably attached to the movable jaw at the front handle section and attached pivotally to the toggle link at a toggle pivot on the front handle section. The rear handle section is pivotally attached to the front handle section at a rear handle section pivot point. The two sections are normally kept rigid to one another and the rear handle section rotated outwards by a release trigger, catch, and force elements. The release trigger is movably mounted and retained on one of the moving handle assembly sections and engages the catch on the other section. The force elements (usually comprising one or more springs) normally cause the rear handle section to rotate outward from the fixed handle body until the release trigger engages the catch and causes both sections to be rigid to one another with the rear handle section out locked, in an out-locked position or rear handle section out-locked position. This provides a releasable means for holding the front handle section and the rear handle section rigid to one another.

When the front handle section and rear handle section are held rigid to one another, the moving handle assembly can be squeezed towards the fixed handle assembly causing the jaws to close on a work-piece. This also results in the toggle pivot moving past a toggle over center line and the jaws being in a locked, in a toggle lock, in a toggle locked position, or toggle locked on a work-piece with a positive gripping force.

Operation of the ergonomic quick release mechanism for hand-held clamping toggle lock tools is used to release the tool jaws once they are toggle locked onto the work-piece. First, the release trigger is moved to a disengaged position from the catch by an operator. After this is done, the operator squeezes the rear handle section towards the fixed handle body causing the rear handle section to rotate around the rear handle section pivot point. This results in the rear handle section contacting part of the fixed handle assembly at a release fulcrum point. Once the rear handle section and fixed handle assembly are in contact at the release fulcrum point, the squeezing force of the operator on the rear handle section towards the fixed handle body results in an outwards force away from the fixed handle body at the rear handle section pivot point. This outwards force results in the front handle section rotating outwards from the fixed handle body and the toggle pivot coming back over the toggle over center line, eliminating (releasing or unlocking) the toggle lock and the positive gripping force on the work-piece.

In certain example embodiments, once the toggle lock is disengaged, the operator releases the release trigger and relaxes the squeezing force on the rear handle section. This allows the force elements and a catch engagement guide to rotate the rear handle section outwards to the original out-locked position. The force elements and catch engagement guide also simultaneously guide the release trigger into engagement with the catch. Thus, the force elements and catch engagement guide provide a means for guiding and retaining the release trigger into engagement with the catch.

Several advantages of one or more aspects of the invention include provision of an ergonomic quick release mechanism for hand-held clamping toggle lock tools that is mechanically simple, with few parts and that allows the user to quickly and easily release the toggle lock using only one hand, thereby allowing the user to have the other hand free. The user simply disengages the release trigger mounted on the moving handle (easily accessed by the user's fingers) and squeezes the rear handle section to release the toggle lock using the superior squeezing strength of the user's entire hand. The squeezing motion also eliminates the explosive outward release of many types of previous toggle lock releases and aids assisting the user in maintaining control of the tool and the work-piece. In addition, the squeezing motion can be accomplished in confined spaces which would limit other types of releases.

Having the release trigger movably mounted and retained on one of the sections, and a catch and catch engagement guide on the other section, allows springs to reliably reengage the release trigger with the catch and swing the rear handle section back out to its original position, with no need for action from the user other than just letting go of the release trigger and relaxing their grip on the rear handle section.

Having a catch force-bearing surface in line with a line through the center of rotation of the rear handle section means that the catch firmly engages the release trigger without slipping and that the front and rear handle sections remain rigid to one another when the moving handle is used to grip a work-piece. This feature allows the user to easily disengage the release trigger.

The following features also help the user to easily disengage the release trigger when desired. A toggle pivot over center stop on the front handle section eliminates additional forces on the rear handle section from the jaws being toggle locked, which might cause the release trigger to be difficult to move in the catch due to friction generated from those forces. The sliding motion of the release trigger in the catch and the release trigger on the rear handle section are in line with one another so that the disengagement motion of the release trigger from the catch is smooth. The sliding motion of the release trigger when disengaging is at an angle toward the long axis of the fixed handle body. Thus, any natural squeezing motion by the user on the release trigger towards the handle body translates into a motion disengaging the release trigger from the catch.

These and other aspects, objects, features, and advantages of the example embodiments will become apparent to those having ordinary skill in the art upon consideration of the following detailed description of illustrated example embodiments.

BRIEF DESCRIPTION OF THE DRAWINGS

FIGS. 1-1 through 13-E-1 depict an example plier type toggle lock hand tool utilizing a lock pin catch engagement element quick release, in accordance with one embodiment.

FIG. 1-1 is a side view (with hidden views) of a plier type toggle lock device with ergonomic quick release, in accordance with an example embodiment.

FIG. 2-1 is a side view of a plier type toggle lock device with ergonomic quick release, in accordance with an example embodiment.

FIG. 3-1 is a side view of the plier type toggle lock hand tool with part of the front handle section broken away to show an interior view of the locking mechanism. FIG. 3-A-1 is an enlarged view of the toggle link, release trigger, lock pin, and shows the release fulcrum point, in accordance with an example embodiment.

FIG. 4-1 is a sectional view of the plier type toggle lock hand tool with the lock pin catch engagement element quick release mechanism, in accordance with certain example embodiments.

FIG. 5-1 is a side view of the plier type toggle lock hand tool showing the squeezing force on the rear handle and the resultant force on the catch force-bearing surface, in accordance with certain example embodiments. FIG. 5-A-1 is an enlarged view of the catch force-bearing surface in relation to the reference line through the center of rear handle rotation. FIG. 5-B-1 is an enlarged view of the catch force-bearing surface in relation to the reference line through the center of rear handle rotation with some features removed for clarity.

FIG. 6-1 is a perspective view of the plier type toggle lock hand tool showing various subassemblies, in accordance with certain example embodiments.

FIG. 7-1 is a perspective view of the plier type toggle lock hand tool and the fixed handle assembly, in accordance with certain example embodiments.

FIG. 8-1 is a perspective view of the plier type toggle lock hand tool moving handle assembly, in accordance with certain example embodiments.

FIG. 9-1 is a perspective view of the release trigger of the plier type toggle lock hand tool, in accordance with certain example embodiments.

FIG. 10-1 is a perspective view of the rear handle section with the release trigger mounted on the handle of a plier type toggle lock hand tool, in accordance with certain example embodiments.

FIG. 11-1 is an exploded view in perspective of all parts of the plier type toggle lock hand tool, in accordance with certain example embodiments.

FIG. 12-1 is a side view of the plier type toggle lock hand tool showing the relation of perpendicular force on the release trigger, the sliding movement of the release trigger, the long axis of the fixed handle body and the angles between them, in accordance with certain example embodiments.

FIGS. 13-A-1 through 13-E-1 depict side views of the plier type toggle lock hand tool with hidden views in various stages of operation, in accordance with certain example embodiments.

FIG. 13-A-1 shows the jaws open in the process of clamping onto a work-piece by an operator moving the moving handle assembly towards the fixed handle assembly.

FIG. 13-B-1 shows the jaws locked onto the work-piece with positive gripping force and the center of the toggle pivot past the toggle over center line.

FIG. 13-C-1 shows the release trigger pulled back by the operator disengaging the release trigger from the catch.

FIG. 13-D-1 shows the operator holding the release trigger in place and squeezing the rear handle section towards the fixed handle body resulting in the release fulcrum point contacting the toggle link, resulting in the front handle section rotating outward from the fixed handle body, thus moving the toggle pivot back across the toggle over center line.

FIG. 13-E-1 shows the jaws opening and the operator relaxing the squeezing force on the rear handle section resulting in the release trigger spring rotating the rear handle section to an out-locked position and simultaneously returning the release trigger to a position where the release trigger engages the catch, with the moving handle assembly retracted away from the fixed handle body.

FIGS. 14-2 through 19-2 depict an example pipe wrench type toggle lock hand tool, in accordance with certain example embodiments.

FIGS. 14-2 through 16-2 show drawings of a non-embodiment toggle lock pipe type wrench with a typical release handle pertaining to the pipe wrench type toggle lock hand tool.

FIG. 14-2 is a side view of a non-embodiment toggle lock pipe type wrench.

FIG. 15-2 is a top view of a non-embodiment toggle lock pipe type wrench.

FIG. 16-2 is a sectional view indicated in FIG. 14-2 of a non-embodiment toggle lock pipe type wrench.

FIGS. 17-2 through 19-2 show drawings of an example pipe wrench type toggle lock hand tool with quick release embodiment, in accordance with certain example embodiments.

FIG. 17-2 is a side view of an example pipe wrench type toggle lock hand tool with quick release embodiment, in accordance with certain example embodiments.

FIG. 18-2 is a top view of the pipe wrench type toggle lock hand tool with quick release embodiment, in accordance with certain example embodiments.

FIG. 19-2 is a sectional view of the pipe wrench type toggle lock hand tool indicated in FIG. 17-2.

FIGS. 20-3 through 24-3 show drawings of a an example plier type toggle lock hand tool utilizing a release fulcrum point contacting the fixed handle body quick release, in accordance with certain example embodiments.

FIG. 20-3 is a side view of the plier type toggle lock hand tool utilizing a release fulcrum point contacting the fixed handle body quick release, in accordance with certain example embodiments FIG. 21-3 is a side view of the rear handle section of the plier type toggle lock hand tool utilizing a release fulcrum point contacting the fixed handle body quick release, in accordance with certain example embodiments.

FIG. 22-3 is a sectional view as indicated in FIG. 20-3.

FIG. 23-3 shows a hidden side view of the plier type toggle lock hand tool utilizing a release fulcrum point contacting the fixed handle body quick release, in accordance with certain example embodiments.

FIG. 24-3 shows a hidden side view of the plier type toggle lock hand tool utilizing a release fulcrum point contacting the fixed handle body quick release with the release fulcrum point in contact with the fixed handle body, the rear handle section squeezed in towards the fixed handle body and the front handle section rotated outwards, in accordance with certain example embodiments.

FIGS. 25-4 through 32-E-4 show drawings of an example plier type toggle lock hand tool utilizing a quick release without a lock pin, in accordance with certain example embodiments.

FIG. 25-4 is a hidden side view of the plier type toggle lock hand tool utilizing a quick release without a lock pin, in accordance with certain example embodiments.

FIG. 26-4 is a side view of the plier type toggle lock hand tool utilizing a quick release without a lock pin, in accordance with certain example embodiments.

FIG. 27-4 is a side view of the plier type toggle lock hand tool utilizing a quick release without a lock pin with the front handle section partially broken away, in accordance with certain example embodiments.

FIG. 28-4 is a partially exploded perspective view of the plier type toggle lock hand tool utilizing a quick release without a lock pin, in accordance with certain example embodiments.

FIG. 29-4 is a perspective side view of the plier type toggle lock hand tool utilizing a quick release without a lock pin, in accordance with certain example embodiments.

FIG. 30-4 is a perspective side view of the front handle section of the plier type toggle lock hand tool utilizing a quick release without a lock pin with the front handle section partially broken away, in accordance with certain example embodiments.

FIG. 31-4 is a perspective side view with the front handle section of the plier type toggle lock hand tool utilizing a quick release without a lock pin partially broken away, in accordance with certain example embodiments.

FIGS. 32-A-4 through 32-E-4 show side views of the plier type toggle lock hand tool utilizing a quick release without a lock pin showing hidden views in various stages of operation, in accordance with certain example embodiments.

FIG. 32-A-4 shows the jaws open in the process of the clamping onto a work-piece by an operator moving the moving handle assembly towards the fixed handle assembly, in accordance with certain example embodiments.

FIG. 32-B-4 shows the jaws locked onto the work-piece with positive gripping force and the center of the toggle pivot past the toggle over center line, in accordance with certain example embodiments.

FIG. 32-C-4 shows the release trigger pulled back by the operator disengaging the release trigger from the catch, in accordance with certain example embodiments.

FIG. 32-D-4 shows the release trigger disengaged from the catch and an operator squeezing the rear handle section towards the fixed handle body resulting in the release fulcrum point contacting the toggle link, in accordance with certain example embodiments. This further results in the front handle section rotating outward from the fixed handle body, thus moving the toggle pivot back across the toggle over center line.

FIG. 32-E-4 shows the jaws opening and the operator relaxing the squeezing force on the rear handle section, resulting in the release trigger spring rotating the rear handle section to an out-locked position and simultaneously returning the release trigger to a position where the release trigger engages the catch, with the moving handle assembly retracting away from the fixed handle body, in accordance with certain example embodiments.

FIGS. 33-5 through 39-E-5 show drawings of an example plier type toggle lock hand tool utilizing a locking pin and push forward type release trigger quick release, in accordance with certain example embodiments.

FIG. 33-5 shows a hidden side view of a plier type toggle lock hand tool utilizing a locking pin and push forward type release trigger quick release, in accordance with certain example embodiments.

FIG. 34-5 shows a side view of the plier type toggle lock hand tool utilizing a locking pin and push forward type release trigger quick release, in accordance with certain example embodiments.

FIG. 35-5 shows a side view of the plier type toggle lock hand tool utilizing a locking pin and push forward type release trigger quick release with the front handle section partially broken away, in accordance with certain example embodiments.

FIG. 36-5 shows an exploded perspective view of the plier type toggle lock hand tool utilizing a locking pin and push forward type release trigger quick release, in accordance with certain example embodiments.

FIG. 37-5 shows a perspective side view of the plier type toggle lock hand tool utilizing a locking pin and push forward type release trigger quick release, in accordance with certain example embodiments.

FIG. 38-5 shows a perspective side view of the plier type toggle lock hand tool utilizing a locking pin and push forward type release trigger quick release with the front handle section partially broken away, in accordance with certain example embodiments.

FIGS. 39-A-5 through 39-E-5 show side views with hidden views of the plier type toggle lock hand tool utilizing a locking pin and push forward type release trigger quick release in various stages of operation, in accordance with certain example embodiments.

FIG. 39-A-5 shows the jaws open in the process of the clamping onto a work-piece by an operator moving the moving handle assembly towards the fixed handle assembly, in accordance with certain example embodiments. FIG. 39-B-5 shows the jaws locked onto the work-piece with positive gripping force and the center of the toggle pivot past the toggle over center line, in accordance with certain example embodiments.

FIG. 39-C-5 shows the release trigger pushed forward by the operator disengaging the release trigger from the catch, in accordance with certain example embodiments, in accordance with certain example embodiments.

FIG. 39-D-5 shows the operator holding the release trigger in place and squeezing the rear handle section towards the fixed handle body resulting in the release fulcrum point contacting the toggle link, resulting in the front handle section rotating outward from the fixed handle body, thus moving the toggle pivot back across the toggle over center line, in accordance with certain example embodiments.

FIG. 39-E-5 shows the jaws opening and the operator relaxing the squeezing force on the rear handle section, resulting in the rear handle section spring rotating the rear handle to an out-locked position and the release trigger spring returning the release trigger to a position where the release trigger engages the catch, with the moving handle assembly retracting away from the fixed handle body, in accordance with certain example embodiments.

FIGS. 40-6 through 44-E-6 show drawings of an example plier type toggle lock hand tool having the release trigger mounted on the front handle section type quick release, in accordance with certain example embodiments.

FIG. 40-6 shows a hidden side view of the plier type toggle lock hand tool having the release trigger mounted on the front handle section type quick release, in accordance with certain example embodiments.

FIG. 41-6 shows a side view of the plier type toggle lock hand tool having the release trigger mounted on the front handle section type quick release, in accordance with certain example embodiments.

FIG. 42-6 shows a side view of the plier type toggle lock hand tool having the release trigger mounted on the front handle section type quick release, with part of the front handle section broken away, in accordance with certain example embodiments.

FIG. 43-6 shows a partially exploded side view of the example plier type toggle lock hand tool having the release trigger mounted on the front handle section type quick release, in accordance with certain example embodiments.

FIGS. 44-A-6 through 44-E-6 show side views with hidden views of the plier type toggle lock hand tool having the release trigger mounted on the front handle section type quick release in various stages of operation, in accordance with certain example embodiments.

FIG. 44-A-6 shows the jaws open in the process of the clamping onto a work-piece by an operator moving the moving handle assembly towards the fixed handle assembly, in accordance with certain example embodiments.

FIG. 44-B-6 shows the jaws locked onto the work-piece with positive gripping force and the center of the toggle pivot past the toggle over center line, in accordance with certain example embodiments.

FIG. 44-C-6 shows the release trigger pushed forward by the operator disengaging the release trigger from the catch, in accordance with certain example embodiments.

FIG. 44-D-6 shows the operator holding the release trigger in place and squeezing the rear handle section towards the fixed handle body, resulting in the release fulcrum point contacting the toggle link, resulting in the front handle section rotating outward from the fixed handle body, thus moving the toggle pivot back across the toggle over center line, in accordance with certain example embodiments.

FIG. 44-E-6 shows the jaws open and the operator relaxing the squeezing force on the rear handle section, resulting in the rear handle section spring rotating the rear handle section to an out-locked position and the release trigger spring returning the release trigger to a position where the release trigger engages the catch, with the moving handle assembly retracting away from the fixed handle body, in accordance with certain example embodiments.

FIGS. 45-A-7 through 46-7 show drawings of an example plier type toggle lock hand tool having the release fulcrum mounted on the toggle link type quick release, in accordance with certain example embodiments.

FIG. 45-A-7 shows a hidden side view of the plier type toggle lock hand tool having the release fulcrum mounted on the toggle link type quick release in toggle lock, in accordance with certain example embodiments.

FIG. 45-B-7 shows a hidden side view plier type toggle lock hand tool having the release fulcrum mounted on the toggle link type quick release after the release fulcrum point has been used to release the toggle lock, in accordance with certain example embodiments.

FIG. 46-7 shows a side view of the plier type toggle lock hand tool having the release fulcrum mounted on the toggle link type quick release with the release fulcrum point, in accordance with certain example embodiments.

DETAILED DESCRIPTION OF THE EXAMPLE EMBODIMENTS

Figure 1:
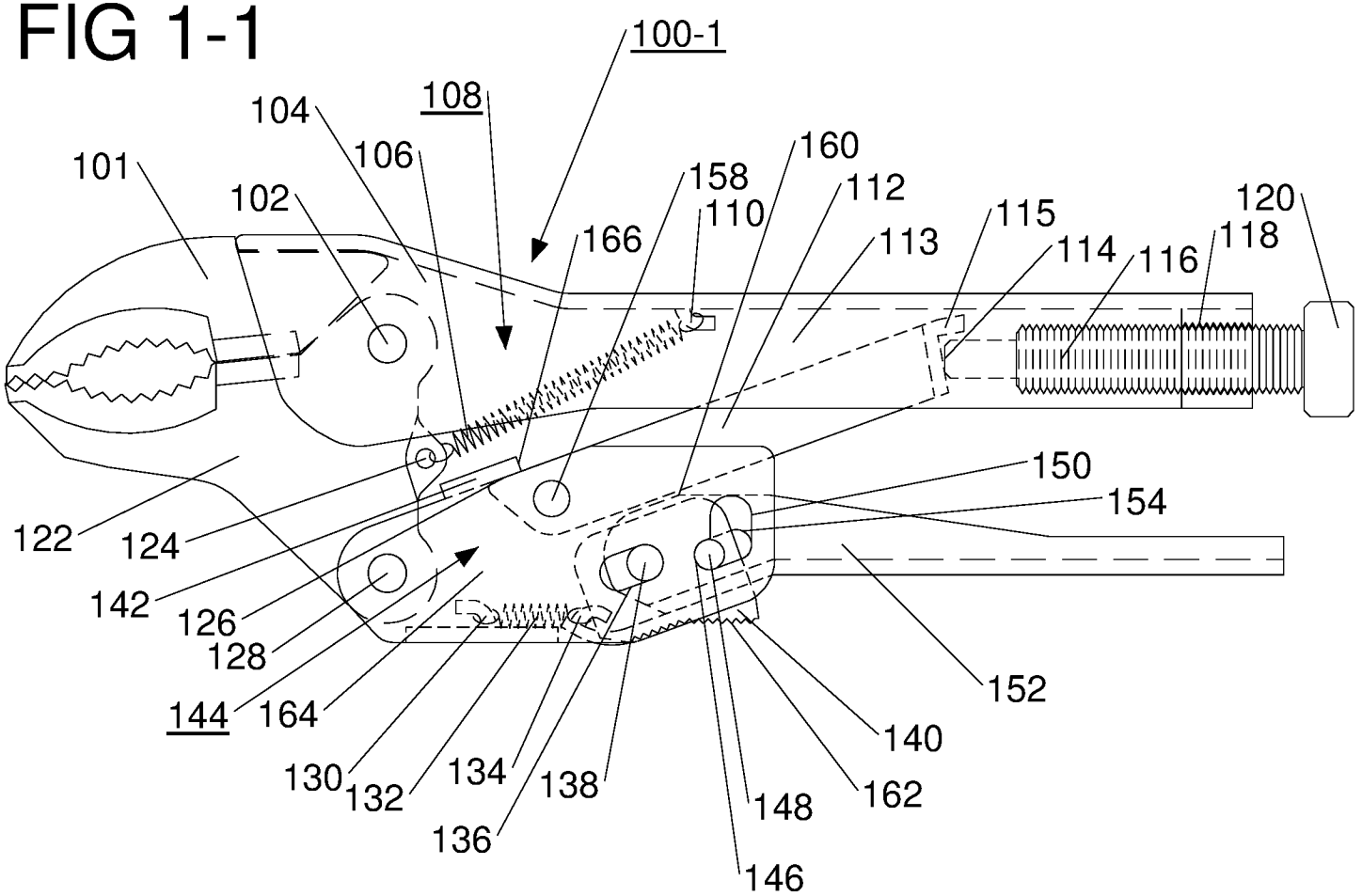

There are several advantages of the various embodiments. They provide an ergonomic quick release mechanism for hand-held clamping toggle lock tools such as pliers, wrenches, clamps, crimpers, bar clamps, pipe wrenches, cutters and many types of other hand tools. The mechanism is mechanically simple, with few parts, and allows the user to quickly and easily release the toggle lock using only one hand thereby allowing the user to have the other hand free. The user simply disengages the release trigger mounted on the moving handle and squeezes the rear handle to release the toggle lock using the superior squeezing strength of the user's entire hand. The squeezing motion also eliminates the explosive outwards release of many types of previous toggle lock releases and aids the user in maintaining control of the tool and the work-piece. In addition, the release can be operated in confined spaces.

Having the release trigger movably mounted and retained on one of the moving handle sections, and a catch and catch engagement guide on the other moving handle section, allows springs to reliably reengage the release trigger with the catch and swing the rear handle section back out to its original out-locked position with no need for action from the user other than just letting go of the release trigger and relaxing their grip on the rear handle section.

Having a catch force-bearing surface in line with a line through the center of rotation of the rear handle section means that the release trigger firmly engages the catch without slipping and the front and rear handle sections remain rigid to one another when the moving handle is used to grip a work-piece. This feature also allows the user to easily disengage the release trigger. The following features also help the user to easily disengage the release trigger when desired:

A toggle pivot over center stop on the front handle section eliminates additional forces on the rear handle section from the jaws being toggle locked which might cause the release trigger to be difficult to move in the catch due to friction generated from those forces.

The sliding motion of the release trigger in the catch and the release trigger on the rear handle section are in line with one another so that the disengagement motion of the release trigger from the catch is smooth.

The sliding motion of the release trigger when disengaging is toward the long axis of the fixed handle body. This results in any natural squeezing motion by the user on the release trigger perpendicular to the handle body translating into a motion disengaging the release trigger from the catch.

Although the description above contains many specificities, these should not be construed as limiting the scope of embodiments, but as merely providing illustrations of just some of many possible embodiments. The following are just some of the examples of alternate elements that could be used.

As noted before, this mechanism can be used with a wide variety of hand-held toggle clamping, crimping or cutting tools such as pliers, wrenches, clamps, crimpers, bar clamps, pipe wrenches, cutters, etc. The tools could have ergonomic padded grips on the handles, markings and different colors to aid in operation. In addition, the tools could be made out of almost any possible type or combination of materials such as steel, plastic, aluminum, etc.

The jaws or gripping members could take different forms and shapes such as curved and serrated, parallel to one another, a widely spaced tong type meeting at just the tips, or many other forms. The jaws could also be pads with or without swivels, hard or soft gripping members, crimpers or cutters, etc., depending on the needed application. The fixed and movable jaws could also pivot or slide in relation to one another, be connected by other moving elements or any other sort of movement that allows the jaws to advance and retract towards one another when the moving handle assembly is actuated. In addition, a means to normally retract the moving jaw from the fixed jaw, such as a retraction spring, can also be provided if so desired.

A variety of jaw opening space adjusting mechanisms such as screws, ratchets, turnbuckles, etc. could be used. Automatic type jaw adjustment means in which the user does not need to set the jaw opening could be employed as well. Alternately, no jaw opening space adjustment means at all could be used if so desired.

The rear handle section could also be used as a toggle pivot over center stop instead of the front handle section if so desired.

The front handle section could be movably attached to the movable jaw either pivotally, with a slot or with linkages in-between, or any other type of attachment that would allow the movement of the front handle section (as a part of the moving handle assembly) to manipulate the movable jaw in relation to the fixed jaw. The front handle section and rear handle section could come in a wide variety of forms that could be solid, u-channeled, hollow, etc. Either section could be mounted partially or entirely inside each other or beside the other section.

The release fulcrum point can be on either the fixed handle assembly or the rear handle section and take a variety of forms (angled, rounded, cams, etc.) that would enable the rear handle section to rock (pivot) around this point and release the toggle lock.

The release trigger could be movably mounted and retained outside or inside on either the front handle section or the rear handle section. The release trigger could move by sliding, move pivotally, be composed of one or more moving elements, or any other movements that allow the release trigger to engage and disengage with the catch. The trigger engagement surface could project out of either section in any desired direction, or be inside, or inside and flush with the sides of either section.

The catch engagement element of the release trigger could be a lock pin, projection, knobs, ball detents or any structure that would allow the release trigger to engage with the catch. The catch could be a notch, detent, surface or any structure that corresponds with the catch engagement element. In addition, the catch could be on either the front handle section or rear handle section on whichever moving handle section where the release trigger was not mounted.

The force elements can consist of one more types of springs such as extension, compression, leaf, torsion, etc., or any other force generating element, and could be attached to various elements of the moving handle assembly. The catch engagement guide could be one or more slots, guiding surfaces or any structure that guides the release trigger into engagement with the catch so the rear handle section is out-locked.

Turning now to the drawings, in which like numerals represent like (but not necessarily identical) elements throughout the figures, example embodiments are described in detail.

Plier Type Toggle Lock Hand Tool with Quick Release Mechanism

One example embodiment is illustrated in FIG. 1-1 through FIG. 13-E-1. FIG. 1-1 shows a plier type toggle lock hand tool with quick release mechanism 100-1 which is but one example of an ergonomic quick release mechanism for hand-held clamping toggle lock tools. This embodiment shows a locking plier hand type tool embodiment; however, it could take the form of a toggle lock pipe wrench, clamps, crimpers, crescent wrench, bar clamps, cutters or any other type of clamping, crimping or cutting toggle lock hand tool. For convenience, the plier type toggle lock hand tool with quick release mechanism 100-1 will be referred to as 'the pliers', 'tool' or 'mechanism' in this embodiment.

Figures 1, 6:
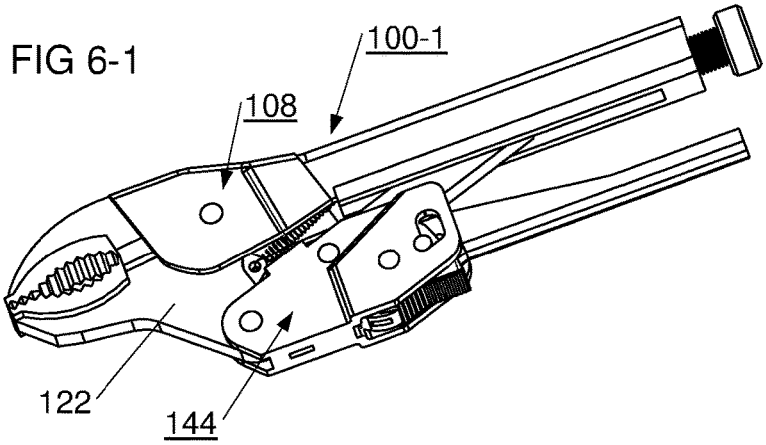

FIG. 6-1 shows the pliers 100-1 in perspective with the main assemblies labeled. The pliers 100-1 consist of a fixed handle assembly 108 (shown separately in FIG. 7-1), a movable jaw 122 (FIG. 11-1) and a moving handle assembly 144 (shown separately in FIG. 8-1). The various features of example embodiment 100-1 are discussed in further detail below.

1. Fixed Handle Assembly

The fixed handle assembly 108 consists of an elongated fixed handle body 104 with a fixed jaw 101 attached to one end and a toggle link 112 (also referred to as a toggle linkage, toggle bar, toggle member, or over center linkage) pivotally (movably) attached at a toggle link body attachment point 114 to the fixed handle body 104 at a distance from the fixed jaw 101.

The fixed jaw 101 along with the movable jaw 122 in this embodiment are typical curved serrated plier type jaws, but could take different forms and shapes such as parallel to one another, widely spaced tong type jaws meeting at just the tips, or many others. The jaws could also have pads with or without swivels, hard or soft gripping members, crimpers or cutters, etc., depending on the needed application.

2. Means for Adjusting the Jaw Opening Space

The pliers 100-1 in this embodiment are provided with a means for adjusting the jaw opening space. In this embodiment, the jaw opening is adjusted by moving the toggle link body attachment point 114 on the fixed handle body 104 in relation to the fixed jaw 101. In this embodiment, the toggle link 112 has a toggle link flange 115. The toggle link flange 115 rides in a hollow toggle link channel 113 (FIG. 11-1) inside the fixed handle body 104. An adjustment screw 116 is mated with a handle adjustment screw interior thread 118 inside the fixed handle body 104. The adjustment screw 116 projects into the toggle link channel 113. By turning an adjustment knob 120 at the end of the adjustment screw 116, the toggle link body attachment point 114 is moved up and down the toggle link channel 113 thus adjusting the jaw spacing. A variety of jaw opening space adjusting mechanisms, such as screws, ratchets, turnbuckles, etc., could be used. Automatic type jaw adjustment means, where the user does not need to set the jaw opening, could be employed as well. Alternately, no jaw opening adjustment means at all could be used if so desired.

3. Movable Jaw

Figures 1, 11:
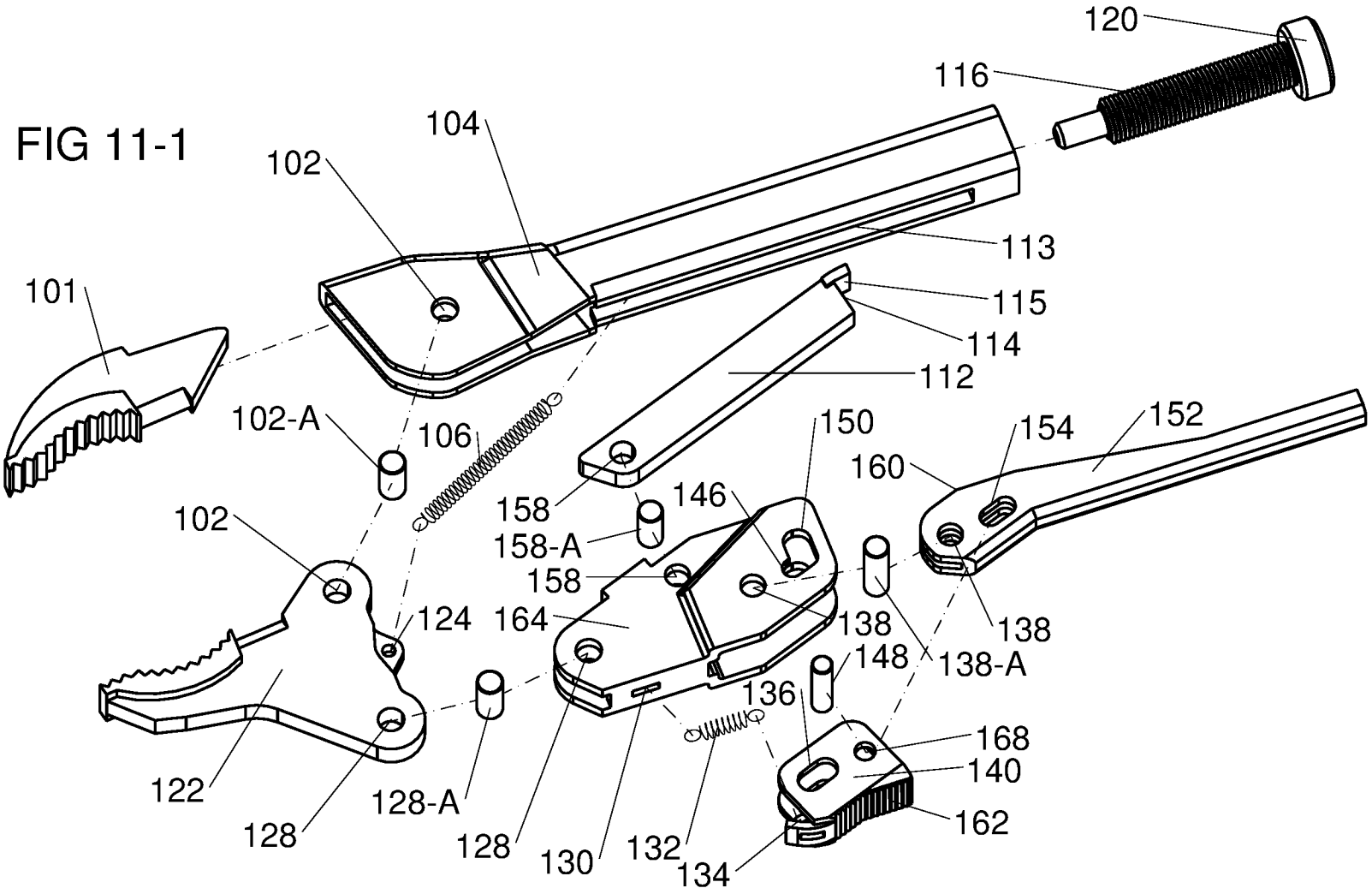

The movable jaw 122 is pivotally attached to the fixed handle assembly 108 at a jaw attachment point 102 with a jaw pivot pin 102-A (FIG. 11-1). The movable jaw 122 could also be movably attached to the fixed handle assembly 108 by being allowed to slide on it or any other type of mounting or linkage that allows the movable jaw 122 to move in relation to the fixed jaw 101 when the moving handle assembly 144 is actuated.

A means to retract the movable jaw 122 away from the fixed jaw 101 is provided for in this embodiment by a jaw retraction spring 106 which is an extension spring attached to the movable jaw 122 at a movable jaw retraction spring attachment point 124 and also attached to the fixed handle body 104 at a jaw retraction spring handle body attachment point 110. The retraction of the movable jaw 122 from the fixed jaw 101 also results in the moving handle assembly 144 rotating away from the fixed handle body 104. A variety of spring types and combinations could be used to retract the movable jaw 122 away from the fixed jaw 101 or, alternately, no jaw retraction means at all could be used.

4. Moving Handle Assembly

The moving handle assembly 144 has two main sections: a front handle section 164 (FIG. 11-1) and a rear handle section 152 pivotally attached to the front handle section 164 at a rear handle section pivot point 138 with a rear handle section pin 138-A. In this embodiment, the front handle section 164 takes the form of a hollow section with the rear handle section 152 mounted partially inside it, but other configurations are possible.

The moving handle assembly 144 is pivotally (movably) attached to the movable jaw 122 on the front handle section 164 at a front handle section attachment point 128 with a front handle section pivot pin 128-A (FIG. 11-1). The moving handle assembly 144 is also pivotally attached further away from the movable jaw 122 to the toggle link 112 on the front handle section 164 at a toggle pivot 158 with a toggle pin 158-A (FIG. 11-1).

A cross member 142 on the front handle section 164 (FIG. 1-1) provides a toggle link jaws retracted stop surface 166 which limits the outwards swing of the moving handle assembly 144 from the fixed handle body 104 by stopping the rotation of the toggle link 112 in relation to the front handle section 164 (FIG. 13-A-1).

The cross member 142 also provides a toggle pivot over center stop 126 surface that stops the movement of the toggle pivot 158 inwards towards the fixed handle body 104 just past a toggle over center line 170 by limiting the rotation of the toggle link 112 in relation to the front handle section 164 (FIG. 13-B-1). This results in the jaws gripping the work-piece with a positive gripping force. In this position, the pliers 100-1 are considered in a toggle locked position or what is called toggle locked, toggle lock, jaws locked, or jaws toggle locked (FIG. 13-B-1). The toggle over center line 170 (also referred to as "past dead center line") is a reference line between the front handle section attachment point 128 and the toggle link body attachment point 114 when the jaws are toggle locked. In the toggle locked position, the rear handle section 152 is stopped just short of contacting the toggle link 112 of the fixed handle assembly 108 so there is no additional force on the rear handle section 152 from the pliers 100-1 being locked. (FIG. 3-1, FIG. 3-A-1) Alternately, the rear handle section 152 could be used as a stop contact to stop the movement of the toggle link 112 so that the jaws are toggle locked if so desired.

It should also be noted that the term "toggle pivot 158 passing over the toggle over center line 170" means that the geometric center of the toggle pivot 158 passes over it and not necessarily the entire toggle pivot 158 or toggle pin 158-A.

5. Release Trigger

Figures 1, 9:
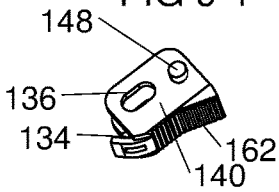

In this embodiment, the moving handle assembly 144 also has a release trigger 140 (FIG. 9-1) movably mounted and retained on the rear handle section 152 with the release trigger 140 also being inside the front handle section 164 (FIG. 10-1, FIG. 8-1, FIG. 4-1). The release trigger 140, in this embodiment, is u-channel shaped and has a release trigger handle pivot clearance slot 136 on both sides of the release trigger 140 that allows it to slide on the rear handle section pin 138-A. The rear handle section pin 138-A is inserted at the rear handle section pivot point 138 through one side of the front handle section 164 then through the release trigger handle pivot clearance slot 136 on one side of the release trigger 140 then through the rear handle section 152 then through release trigger handle pivot clearance slot 136 on the other side of the release trigger 140 and finally through the other side of the front handle section 164 (FIG. 11-1). The release trigger 140 also has a lock pin 148 mounted through a lock pin hole 168 on one side of the release trigger 140 through a rear handle section lock pin slot 154 in the rear handle section 152 and through the lock pin hole 168 on the other side of the release trigger 140 (FIG. 4-1, FIG. 10-1, FIG. 11-1). The release trigger handle pivot clearance slot 136 and rear handle section lock pin slot 154 allow a sliding movement of the release trigger 174 (FIG. 12-1) where the release trigger 140 can freely slide a limited distance and be retained on the rear handle section 152 even if the rear handle section 152 is rotating in respect to the front handle section 164.

The release trigger 140 could also be movably mounted and retained on the front handle section 164. It could slide in any direction, be pivotally mounted and swing instead of slide, or mounted in or on either section. It could consist of multiple moving elements with directional force changes. It could also take any number of forms mountings, or movements on the rear handle section 152 or front handle section 164.

Figures 2, 17:
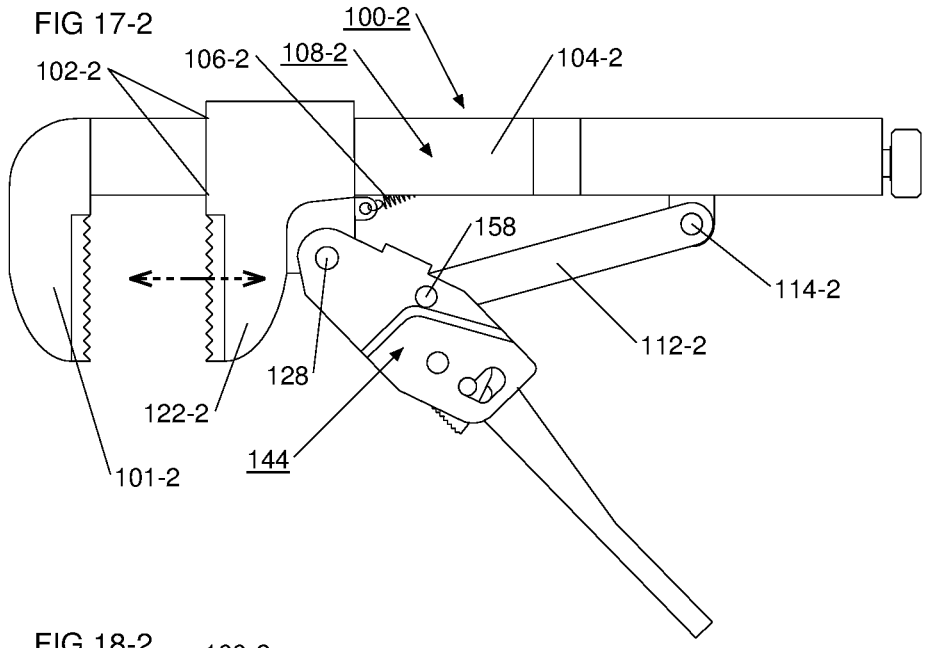

In this embodiment, part of the release trigger called the trigger engagement surface 162 projects out past the bottom (the side opposite from the fixed handle body 104) of the front handle section 164 (FIG. 1-1, FIG. 2-1). The trigger engagement surface 162 gives an operator a surface to manipulate the release trigger 140. In this embodiment, the position of the trigger engagement surface 162 allows the user to manipulate the release trigger 140 with the same hand that holds the pliers 100-1 without having to shift the position of their hand. The trigger engagement surface 162 could be also be parallel and flush with the bottom sides of the front handle section 164 or even be inside the front handle section 164 in order to minimize any chance of accidental release. The trigger engagement surface 162 could take a variety of other forms in relation to the front handle section 164 or could project out of the sides of the front handle section 164 if so desired.

6. Release Trigger and Force Elements

A release trigger spring 132 (which in this embodiment is an extension spring) is attached to the release trigger 140 at a release trigger spring attachment point 134. The release trigger spring attachment point 134 is attached at a distance from the rear handle section pivot point 138. The release trigger spring 132 is also attached closer to the front handle section attachment point 128 on the front handle section 164 at a release trigger spring front handle section attachment point 130. (FIG. 1-1, FIG. 3-1, FIG. 11-1) The release trigger spring 132 provides several force elements. One force element causes the release trigger 140 to tend to slide forward on the rear handle section 152 in the general direction towards the front handle section attachment point 128. Another force element results from the release trigger spring attachment point 134 being attached at a distance from the rear handle section pivot point 138 which causes a torque that tends to rotate the release trigger 140 and rear handle section 152 around the rear handle section pivot point 138 away from the fixed handle body 104 (FIG. 13-E-1).

The force elements provided by the release trigger spring 132 in this embodiment could also be more than one spring element, different types of springs such as compression, torsion, etc. and be attached differently depending on where and how the release trigger 140 was mounted and moves.

7. Catch, Catch Engagement Guide

Figures 1, 8:
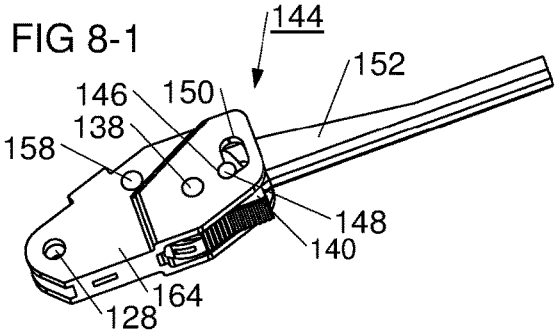
Figures 1, 10:
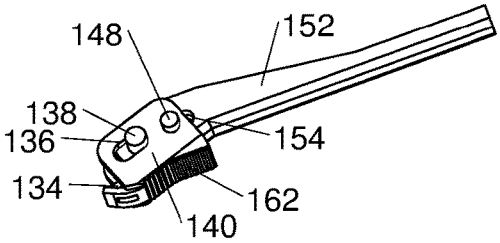
Figures 4, 25:
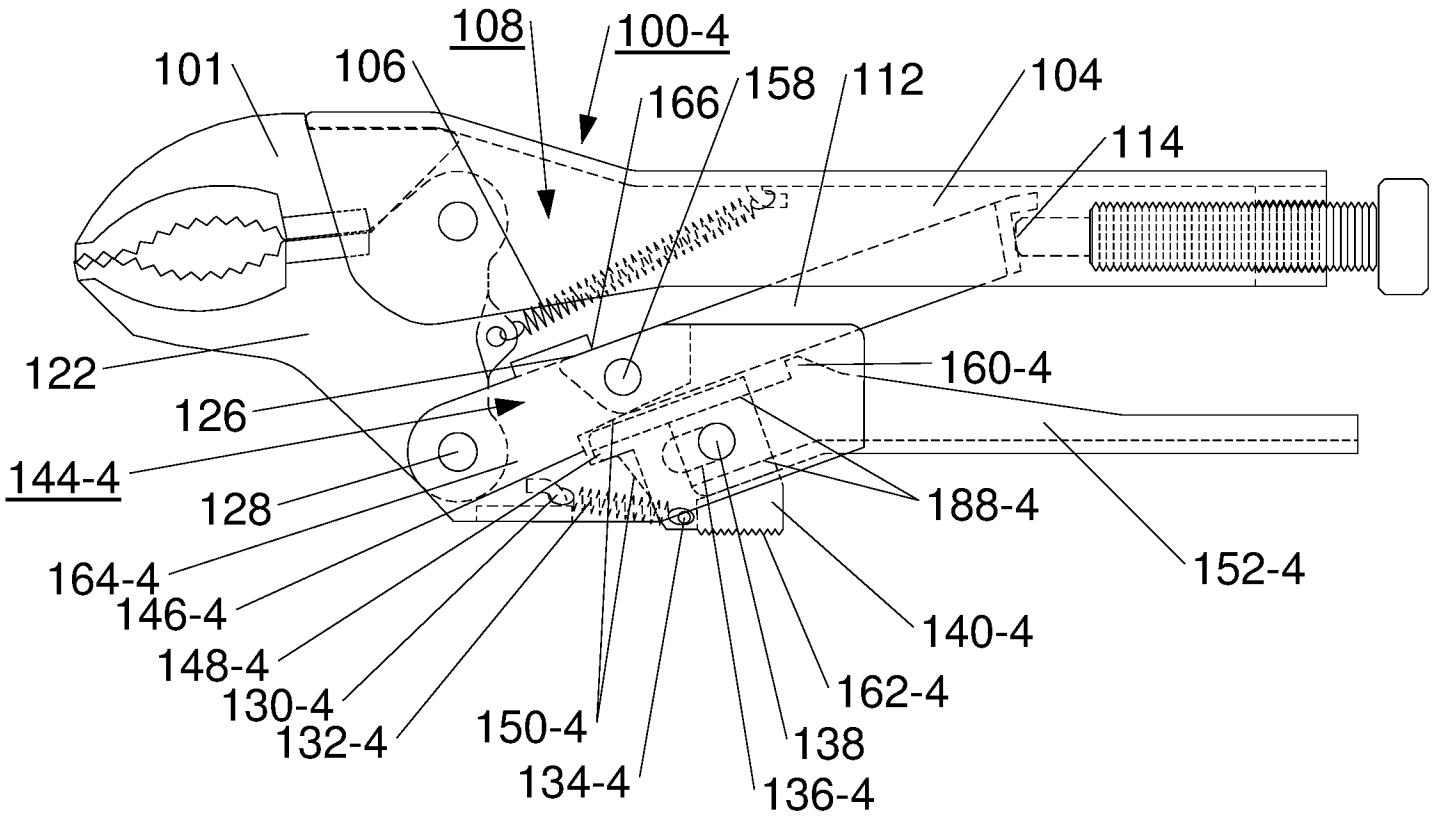

The lock pin 148 on the release trigger 140 projects through both sides of a catch engagement guide 150 (FIG. 11-1) which is a slot in both sides (or one side in another embodiment) of the front handle section 164 that allows the lock pin 148 to travel freely within the confines of the catch engagement guide 150 (FIG. 4-1, FIG. 8-1). A catch 146 (FIG. 5-B-1, FIG. 11-1), also known as a lock pin recess, is a recess or notch in the catch engagement guide 150 in the corner of the catch engagement guide 150 closest to the jaws and furthest away from the fixed handle body 104. The catch 146 is also in the catch engagement guide 150 on both sides of the front handle section 164 and is also slightly larger than the diameter of the lock pin 148.

The force elements of the release trigger spring 132 and the interior surfaces of the catch engagement guide 150 normally guide the lock pin 148 into engagement with the catch 146 where the lock pin acts as a catch engagement element. If the lock pin 148 is not in engagement with the catch 146 and there are no forces opposing the force elements on the release trigger 140 or rear handle section 152 then the release trigger spring 132 will cause the release trigger 140 to move forward (in a general direction towards the front handle section attachment point 128) on the rear handle section 152. Simultaneously, the release trigger spring 132 causes the release trigger 140 and rear handle section 152 to rotate around the rear handle section pivot point 138 away from the fixed handle body 104 until the lock pin 148 enters the catch 146 (FIG. 13-E-1). The catch engagement guide 150 and force elements provide a means for guiding and retaining the release trigger into engagement with the catch.

The release trigger spring 132 also normally retains the lock pin 148 into engagement with the catch 146. In this position, the release trigger 140 is considered to be engaged with, or biased against, the catch 146 or in an engaged position. In this position, the rear handle section 152 and front handle section 164 are held rigid to one another. This provides a releasable means for holding the front handle section and rear handle section rigid to one another. If the lock pin 148 (catch engagement element) of the release trigger 140 is not in the catch 146 then the release trigger 140 is considered disengaged, disengaged from the catch 146 or in the disengaged position.

When the release trigger 140 is engaged with the catch 146, the rear handle section 152 is rotated around the rear handle section pivot point 138 away from the fixed handle body 104 to the maximum extent. This is known as the rear handle section being out-locked or in the out-locked position (FIG. 13-A-1). The release trigger 140 and catch 146 provide a releasable means for holding the front handle section and the rear handle section rigid to one another.

The catch 146 could alternately be part of the rear handle section 152 in any case where the release trigger 140 is movably mounted and retained on the front handle section 164. The catch 146 and catch engagement element (lock pin 148) of the release trigger 140 could also take a wide variety of mating forms on both sections. Instead of a lock pin 148 and lock pin recess, there could, for example, be a projecting stud integral to the release trigger 140 that mates with a notch type catch or there could be complimentary surfaces on the release trigger 140 and catch 146. The structures of the catch 146 and catch engagement element could be reversed or there could be trigger actuated ball bearings that fit into detents. The catch engagement element could consist of one or more moving elements. Many different forms and actions are possible that would allow the catch and catch engagement element to keep both sections rigid to one another.

8. Catch Engagement-Disengagement Ergonomics

In this embodiment, the interior surfaces of the catch 146 are approximate in line with the interior surfaces of the rear handle section lock pin slot 154 when the release trigger 140 is engaged with the catch 146. This allows the sliding movement of the lock pin 148 and release trigger 140 to be approximately aligned with the sliding movement of the lock pin 148 within the catch 146 and thus be easily moved in and out of the catch 146 (FIG. 1-1).

Figures 5, 33:
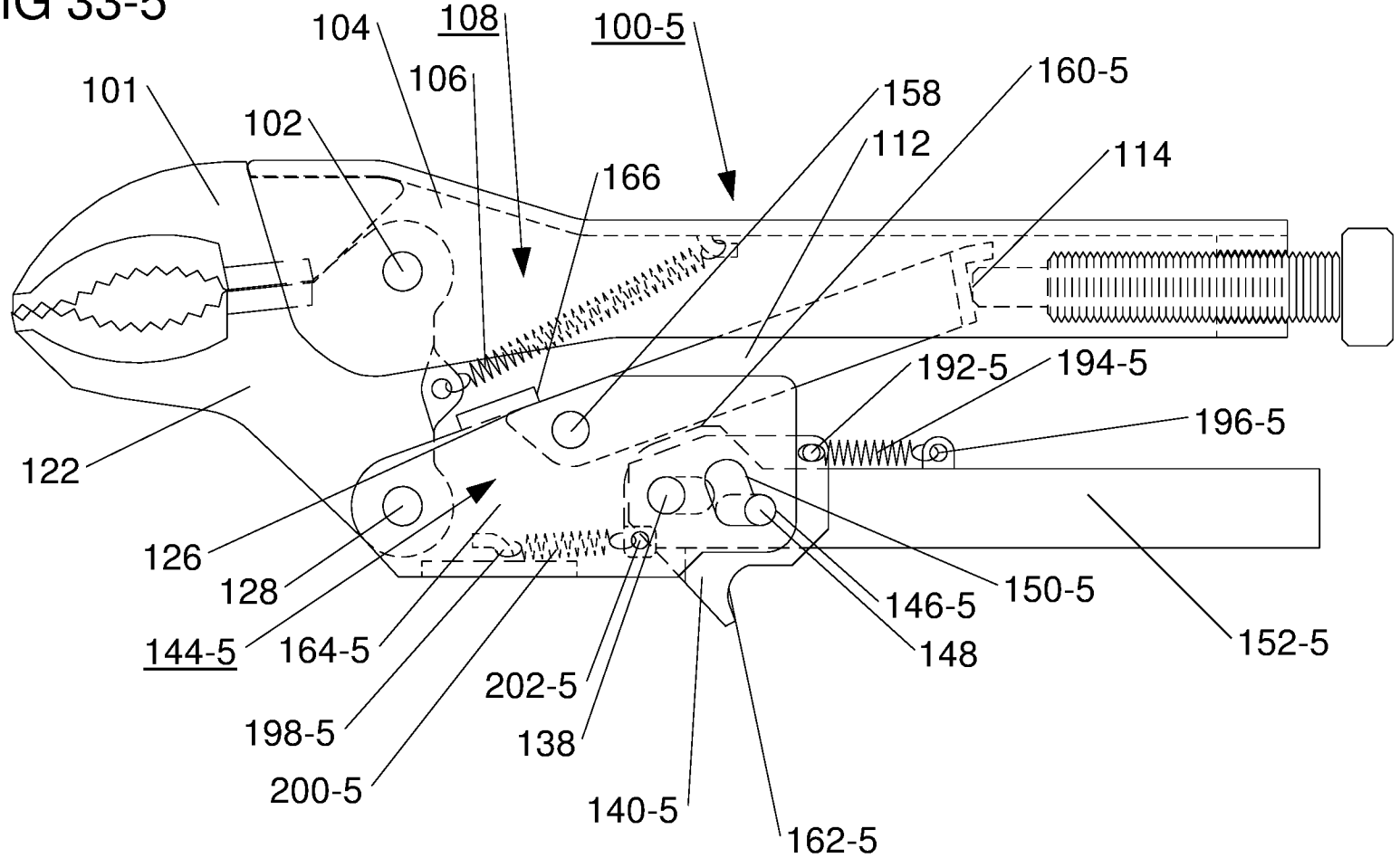

Also in this embodiment, the interior surface of the catch 146 closest to the fixed handle body 104 is referred to as a catch force-bearing surface 156. The catch force-bearing surface 156 is approximately in line with a reference line through the center of rotation of the rear handle section around the rear handle section pivot point 180 which is through the rear handle section pivot point 138 (this also could be visualized as the catch force-bearing surface 156 being approximately on a plane passing through the center of rotation) (FIG. 5-B-1). Squeezing (rotational) force 400 on the rear handle section 152 towards the fixed handle body 104 when the release trigger 140 is engaged with the catch 146 results in a force against and perpendicular 404 to the catch force-bearing surface 156 from the lock pin 148 (FIG. 5-1, FIG. 5-A-1). As a result of this, high squeezing forces 400 on the rear handle section 152 towards the fixed handle body 104 will result in the lock pin 148 being retained firmly in place in the catch 146 due to friction, but not result in a force that will disengage the lock pin 148. This feature will also allow the lock pin 148 to be easily disengaged from the catch 146 by moving the release trigger 140 when moderate (i.e., an operator simply holding on to the pliers) squeezing forces are on the rear handle section 152 towards the fixed handle body 104 (FIG. 5-1, FIG. 5-A-1).

Figures 1, 12:
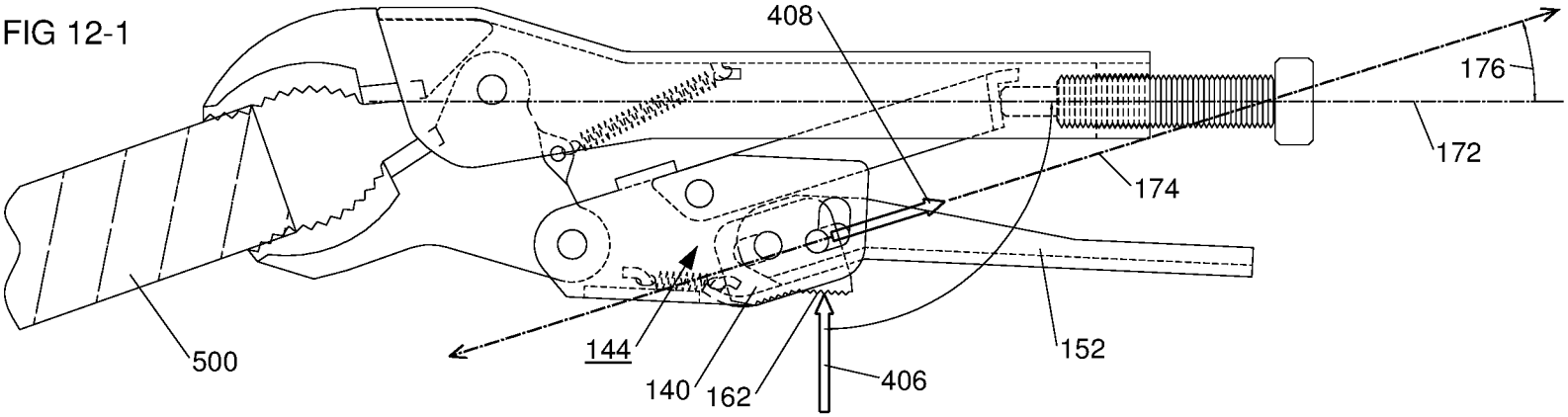

When the pliers 100-1 are toggle locked and the release trigger 140 is engaged with the catch 146 the sliding movement of the release trigger 174 is at an angle 176 to the long axis of the fixed handle body 172. As a result, any force on the release trigger perpendicular to and towards the long axis of the fixed handle body 406 (i.e., squeezing force on release trigger 140) translates into a force 408 along the sliding movement of the release trigger 174 tending to cause the release trigger 140 to disengage from the catch 146 (FIG. 12-1). This gives a more ergonomic means to disengaging the release trigger 140.

It should also be noted that the use of toggle pivot over center stop 126 eliminates any force on the rear handle section 152 and release trigger 140 that could cause the release trigger 140 to bind in the catch 146 due to force generated friction or to cause the release trigger 140 to accidently disengage from the catch 146.

9. Release Fulcrum Point

Figures 3, 20:
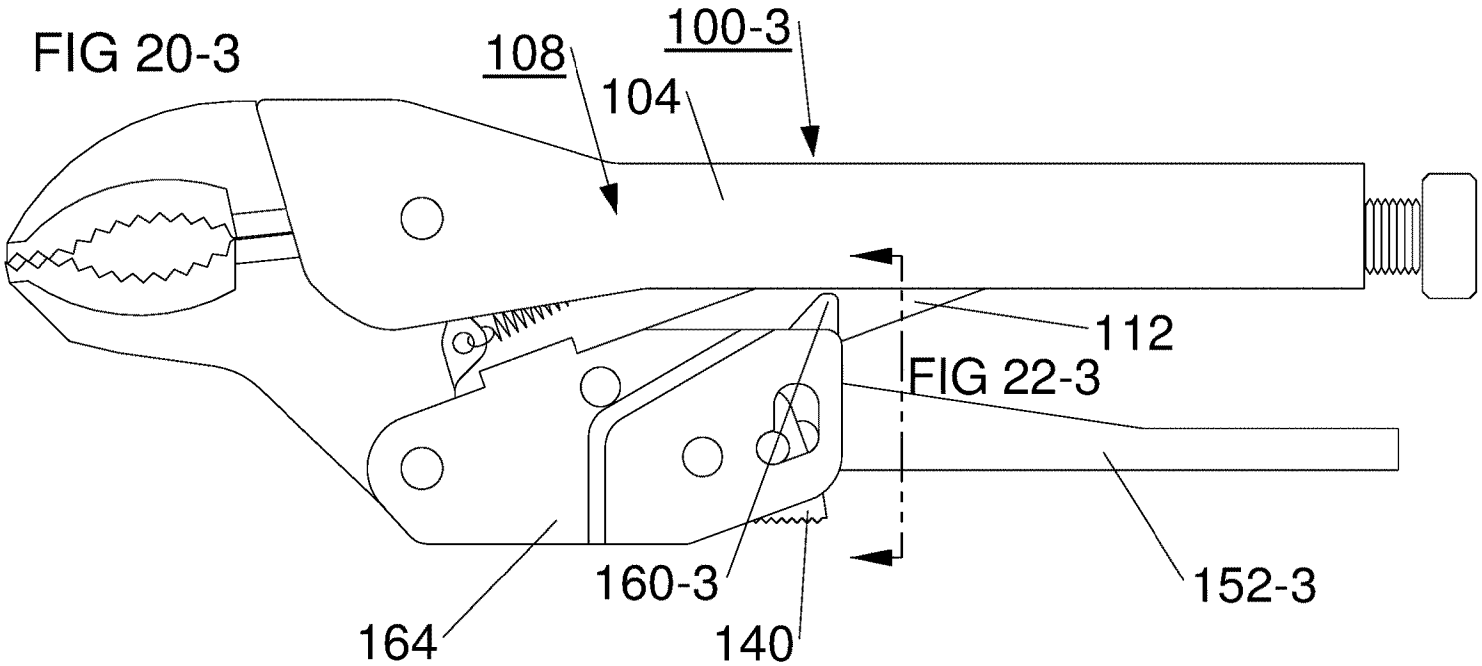

A release fulcrum point 160 is located on the rear handle section 152 on the side closest to the toggle link 112 (FIG. 3-1, FIG. 3-A-1). The release fulcrum point 160 is the point on the rear handle section 152 that first contacts the toggle link 112 when the rear handle section 152 is rotated around the rear handle section pivot point 138 towards the fixed handle body 104. The release fulcrum point 160 in this embodiment is an angle on the structure of the rear handle section 152 that allows the rear handle section 152 to rock or rotate on the surface of the toggle link 112 (FIG. 13-D-1). The release fulcrum point 160 could also be rounded, or a knob, projection or element mounted on the rear handle section 152 such as on the release trigger 140.

The release fulcrum point 160 could also contact the fixed handle body 104 or any element on the fixed handle assembly 108.

The release fulcrum point 160 could also be part of or mounted on any element of the fixed handle body 104, and the rear handle section 152 could contact the release fulcrum point 160 when the rear handle section 152 is rotated around the rear handle section pivot point 138 towards the fixed handle body 104.

The release fulcrum point 160 serves as a lever fulcrum point. When the rear handle section 152 is in contact with the toggle link 112 at the release fulcrum point 160 this results in any squeezing (rotational) force 400 on the rear handle section 152 towards the fixed handle body 104 being translated into a force 402 on the rear handle section pivot point 138 outwards from the fixed handle body 104. This outwards force 402 causes the front handle section 164 and the toggle link 112 to rotate outwards from the fixed handle body 104 (FIG. 13-D-1, resulting in the toggle pivot 158 retracting past the toggle over center line 170 and the positive gripping force of the jaws on the work-piece 500 being eliminated with the toggle lock also being eliminated (released). At this point, the jaws are considered unlocked.

10. Operation

FIG. 13-A-1 shows the pliers 100-1 with the jaws open approaching a work-piece 500. The movable jaw 122 is retracted away from the fixed jaw 101 by the jaw retraction spring 106, which causes the moving handle assembly 144 to be rotated away from the fixed handle body 104. The lock pin 148 of the release trigger 140 is engaged with the catch 146 and the rear handle section 152 is held rigid to the front handle section 164 with the rear handle section 152 in the out-locked position.

An operator applies a squeezing force on the rear handle section 152 of the moving handle assembly 144 towards the fixed handle body 104, resulting in the moving handle assembly 144 and toggle link 112 rotating inward towards the fixed handle body 104, causing the jaws to close on the work-piece 500.

FIG. 13-B-1 shows where the rotation of the moving handle assembly 144 and toggle link 112 has been stopped by the toggle link 112 contacting the toggle pivot over center stop 126 with the toggle pivot 158 stopped just past the toggle over center line 170. The jaws are closed and toggle locked onto the work-piece 500 with a positive gripping force. The toggle link 112 is stopped short of contacting the rear handle section 152.

The operator disengages the release trigger 140 from the catch 146. The operator does this by engaging the trigger engagement surface 162 with one or more fingers. The operator pulls the release trigger 140 back against the force of the release trigger spring 132, thereby sliding the release trigger 140 on the rear handle section 152 in a direction away from the front handle section attachment point 128. FIG. 13-C-1 shows the release trigger 140 pulled fully back on the rear handle section 152 resulting in the lock pin 148 exiting the catch 146. In this position, the release trigger 140 is disengaged or in the disengaged position from the catch 146. This allows the rear handle section 152 to rotate around the rear handle section pivot point 138 independently of the front handle section 164.

Next the operator, while holding the release trigger 140 in a disengaged position from the catch 146, squeezes the rear handle section 152 towards the fixed handle body 104. This squeezing force 400 causes the rear handle section 152 to rotate around the rear handle section pivot point 138 towards the fixed handle body 104 until the rear handle section 152 contacts the toggle link 112 at the release fulcrum point 160.

Upon contact with the toggle link 112, the release fulcrum point 160 causes the squeezing force 400 on the rear handle section 152 towards the fixed handle body 104 to be translated into outwards force 402 on the rear handle section pivot point 138 away from the fixed handle body 104. This outwards force 402 causes the front handle section 164 and toggle link 112 to rotate outwards from the fixed handle body 104 causing the toggle pivot 158 to retract past the toggle over center line 170 shown in FIG. 13-D-1. Once the toggle pivot 158 retracts past the toggle over center line 170, the positive gripping force of the jaws on the work-piece 500 is eliminated and the toggle lock is eliminated (released).

FIG. 13-E-1 shows after the toggle lock has been eliminated. The operator relaxes the squeezing force 400 on the rear handle section 152 towards the fixed handle body 104 and releases the release trigger 140. This allows the jaw retraction spring 106 to retract the movable jaw 122 away from the fixed jaw 101 releasing the work-piece 500. This also causes the moving handle assembly 144 to rotate outwards from the fixed handle body 104.

Simultaneously, the release trigger spring 132 causes the rear handle section 152 and release trigger 140 to rotate around the rear handle section pivot point 138 outwards from the fixed handle body 104 and the release trigger 140 to slide on the rear handle section 152 forward in a direction towards the front handle section attachment point 128. The movement of the lock pin 148 against the surfaces of the catch engagement guide 150 guide these two movements until the lock pin 148 enters the catch 146.

This results in the release trigger 140 being engaged with the catch 146 and the rear handle section 152 being held rigid to the front handle section 164 with the rear handle section 152 in the out-locked position. The movable jaw 122 is retracted away from the fixed jaw 101 by the jaw retraction spring 106, and the moving handle assembly 144 is retracted away from the fixed handle body 104 returning the pliers 100-1 to the original state shown in FIG. 13-A-1.

Locking Pipe Wrench Hand Tool with Quick Release Mechanism

Figures 2, 19:
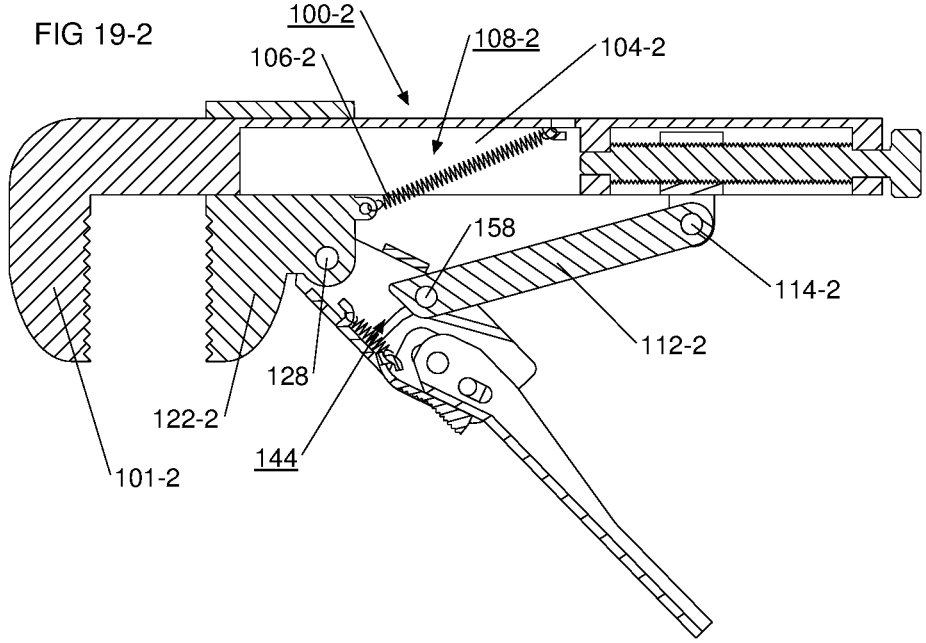

Another example embodiment of the disclosed invention is illustrated in FIG. 14-2 through FIG. 19-2. FIG. 14-2 through FIG. 16-2 are drawings pertaining to this embodiment, which show a non-embodiment version of a locking pipe wrench. This non-embodiment version has a conventional release mechanism with a release lever well known to the art 300-ALT.

FIG. 17-2 through FIG. 19-2 show views of a pipe wrench type toggle lock hand tool with quick release mechanism 100-2, which for convenience will be referred to as the 'wrench', 'tool' or 'mechanism' in this embodiment. The embodiment wrench is identical to the non-embodiment wrench shown in FIG. 14-2 through FIG. 16-2, except that the conventional release mechanism with a release lever well known to the art 300-ALT has been replaced with a moving handle assembly 144 identical to the embodiment shown in FIG. 1-1 through FIG. 13-E-1. The moving handle assembly 144 provides the same quick release mechanism for toggle lock hand tools used in the embodiment in FIG. 1-1 through FIG. 13-E-1, but any variant of the mechanism covered by the scope of this application will do. Any conventional toggle release mechanism can be replaced by the one in this application.

Figures 2, 18:
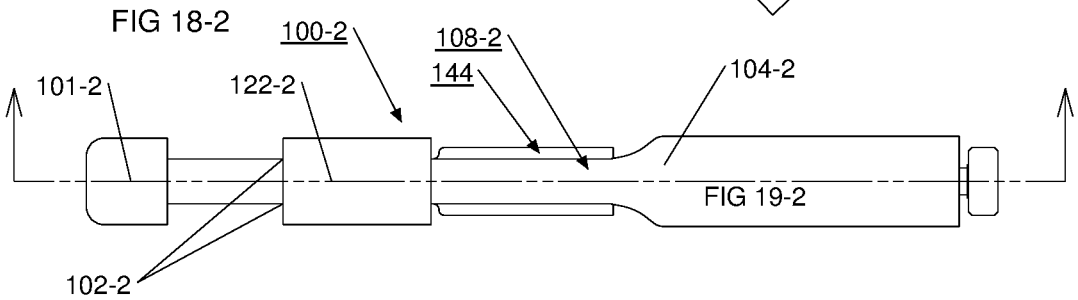

In this embodiment, the movable jaw 122-2 is slidably (movably) attached to the fixed handle assembly 108-2 at the jaw attachment point 102-2 (FIG. 18-2, FIG. 19-2). The jaw attachment point 102-2 consists of a hollow rectangular channel in the movable jaw 122-2 that rides on the shank with a similarly shaped cross section of the fixed handle body 104-2. This allows the movable jaw 122-2 to advance and retract away in relation to the fixed jaw 101-2, by sliding on the shank of the fixed handle body 104-2. The jaw retraction spring 106-2 normally retracts the movable jaw 122-2 away from the fixed jaw 101-2. By squeezing the moving handle assembly 144 towards the fixed handle body 104-2 the jaws can be made to close upon a work-piece 500.

Also in this embodiment, the toggle link 112-2 is attached with a pin at the toggle link body attachment point 114-2. (FIG. 17-2)

Operation of this embodiment is identical to the embodiment shown in FIG. 1-1 through FIG. 13-E-1. The exception is that the jaws close on the work-piece 500 by sliding towards one another instead of pivoting towards each other.

Figures 3, 22:
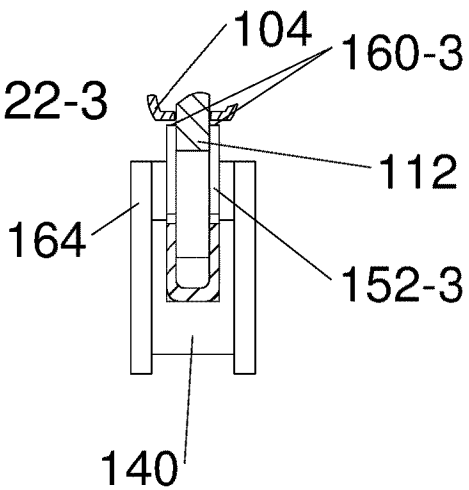
Figures 3, 21:
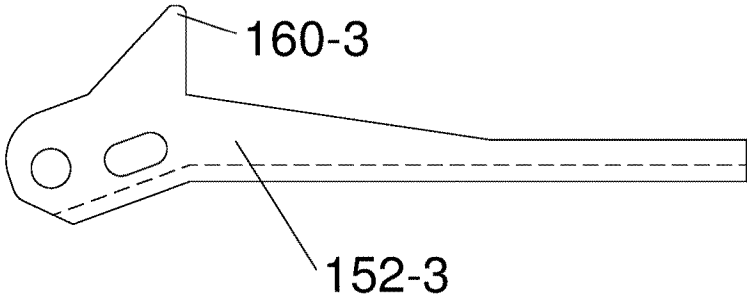
Figures 3, 24:
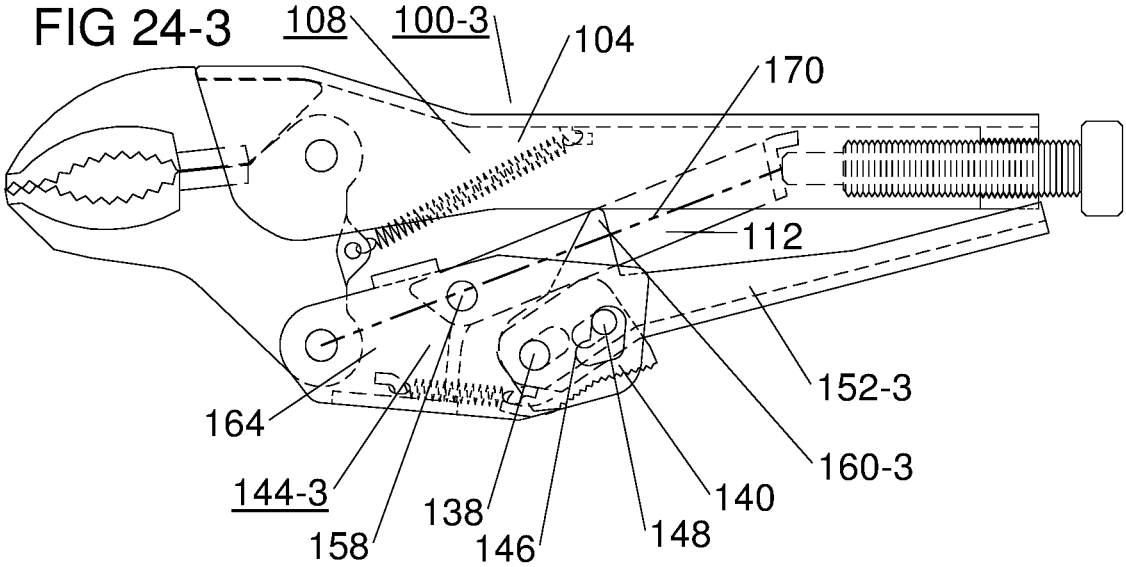

A Plier Type Toggle Lock Hand Tool with Release Fulcrum Point Contacting the Fixed Handle Body Another embodiment plier type toggle lock hand tool with quick release mechanism 100-3 also known as 'the pliers', 'tool' or 'mechanism' in this embodiment is illustrated in FIG. 20-3 through FIG. 24-3. This embodiment is identical to the embodiment shown in FIG. 1-1 through FIG. 13-E-1 with the exception that the rear handle section 152-3 and release fulcrum point 160-3 are different (FIG. 21-3). In this embodiment, the release fulcrum point 160-3 at no point comes into contact with the toggle link 112, but instead contacts the fixed handle body 104. The release fulcrum point 160-3 consists of a pair of projections on the rear handle section 152-3 that project past the toggle link 112 on both sides (FIG. 20-3, FIG. 22-3). The release fulcrum point 160-3 stops short of contacting the fixed handle body 104 when the jaws are toggle locked (FIG. 20-3, FIG. 22-3).

Operation is identical to the embodiment shown in FIG. 1-1 through FIG. 13-E-1, with the exception that the release fulcrum point 160-3 contacts the fixed handle body 104 element of the fixed handle assembly 108 instead of the toggle link 112 element of the fixed handle assembly 108.

Figures 3, 23:
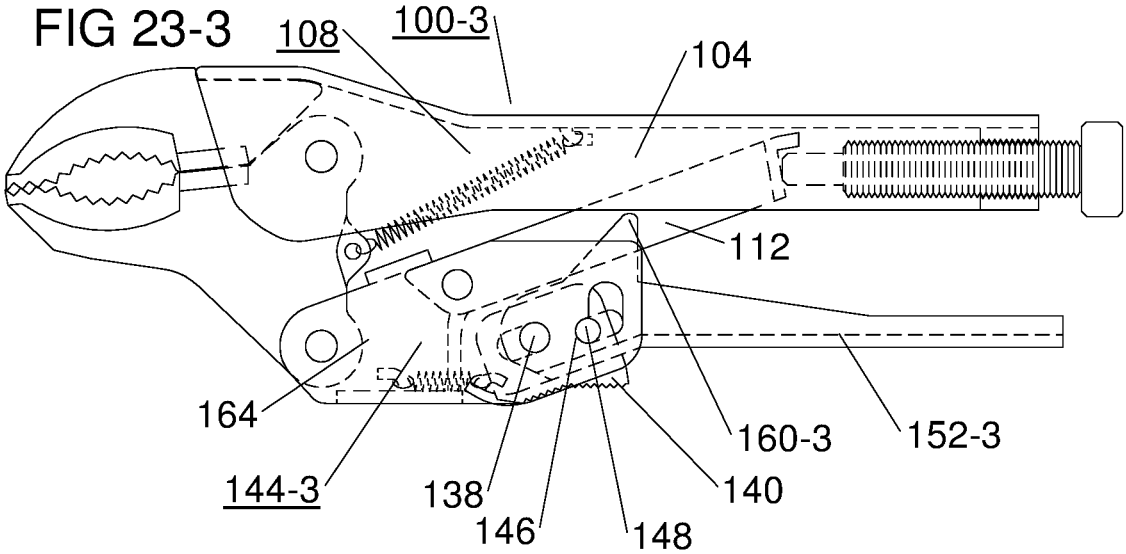

FIG. 23-3 shows the pliers 100-3 in the toggle locked position. The lock pin 148 of the release trigger 140 is engaged with the catch 146 and the rear handle section 152-3 is held rigid to the front handle section 164 with the rear handle section 152-3 in the out-locked position. The release fulcrum point 160-3 of the rear handle section 152-3 is stopped short of contacting the fixed handle body 104.

In this embodiment, the operator disengages the release trigger 140 from the catch 146 and squeezes the rear handle section 152-3 toward the fixed handle body 104. This squeezing force causes the rear handle section 152-3 to rotate around rear handle section pivot point 138 towards the fixed handle body 104 until the rear handle section 152-3 contacts the fixed handle body 104 at the release fulcrum point 160-3.

Upon contact with the fixed handle body 104, the release fulcrum point 160-3 causes the squeezing force on the rear handle section 152-3 toward the fixed handle body 104 to be translated into outwards force on the rear handle section pivot point 138 from the fixed handle body 104. This outwards force causes the front handle section 164 and toggle link 112 to rotate outwards from the fixed handle body 104 causing the toggle pivot 158 to retract past the toggle over center line 170. Once the toggle pivot 158 retracts past the toggle over center line 170, the positive gripping force of the jaws on the work-piece 500 is eliminated and the toggle lock is eliminated (released) (FIG. 24-3).

It should also be noted that the release fulcrum point 160-3 contacting the fixed handle body 104 could be used in any variant covered by the scope of this application.

A Plier Type Toggle Lock Hand Tool with Catch Engagement Element

Another embodiment plier type toggle lock hand tool with quick release mechanism 100-4 also known as 'the pliers', 'tool' or 'mechanism' in this embodiment is illustrated in FIG. 25-4 through FIG. 32-E-4. The chief difference between this embodiment and the embodiment in FIG. 1-1 through FIG. 13-E-1 is that this embodiment does not have a lock pin, but instead has an integral stud projecting from the release trigger 140-4 that serves as a catch engagement element 148-4. The fixed handle assembly 108, movable jaw 122 and jaw retraction spring 106 are the same as in the embodiment shown in FIG. 1-1 through FIG. 13-E-1.

Figures 4, 26:
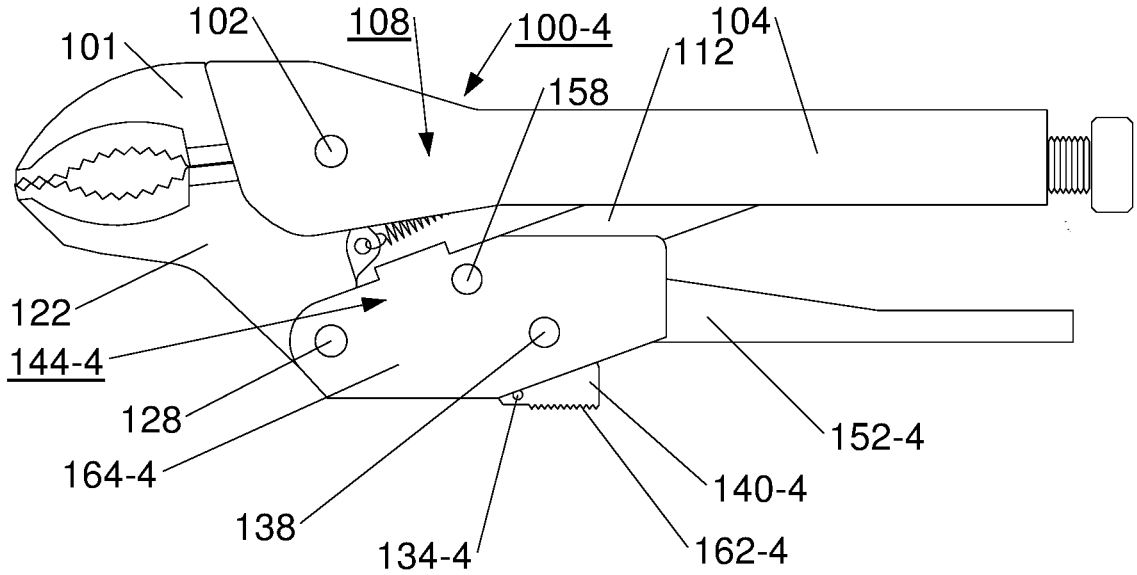

Shown in FIG. 25-4 and FIG. 26-4, the moving handle assembly 144-4 is joined to the movable jaw 122 at the front handle section attachment point 128 and joined to the toggle link 112 at the toggle pivot 158 the same as in the embodiment shown in FIG. 1-1 through FIG. 13-E-1. The functioning of the toggle link jaws retracted stop surface 166 as a limit to the outward swing of the moving handle assembly 144-4 and the toggle pivot over center stop 126 as a stop for toggle locking the jaws is also the same.

Figures 4, 28:
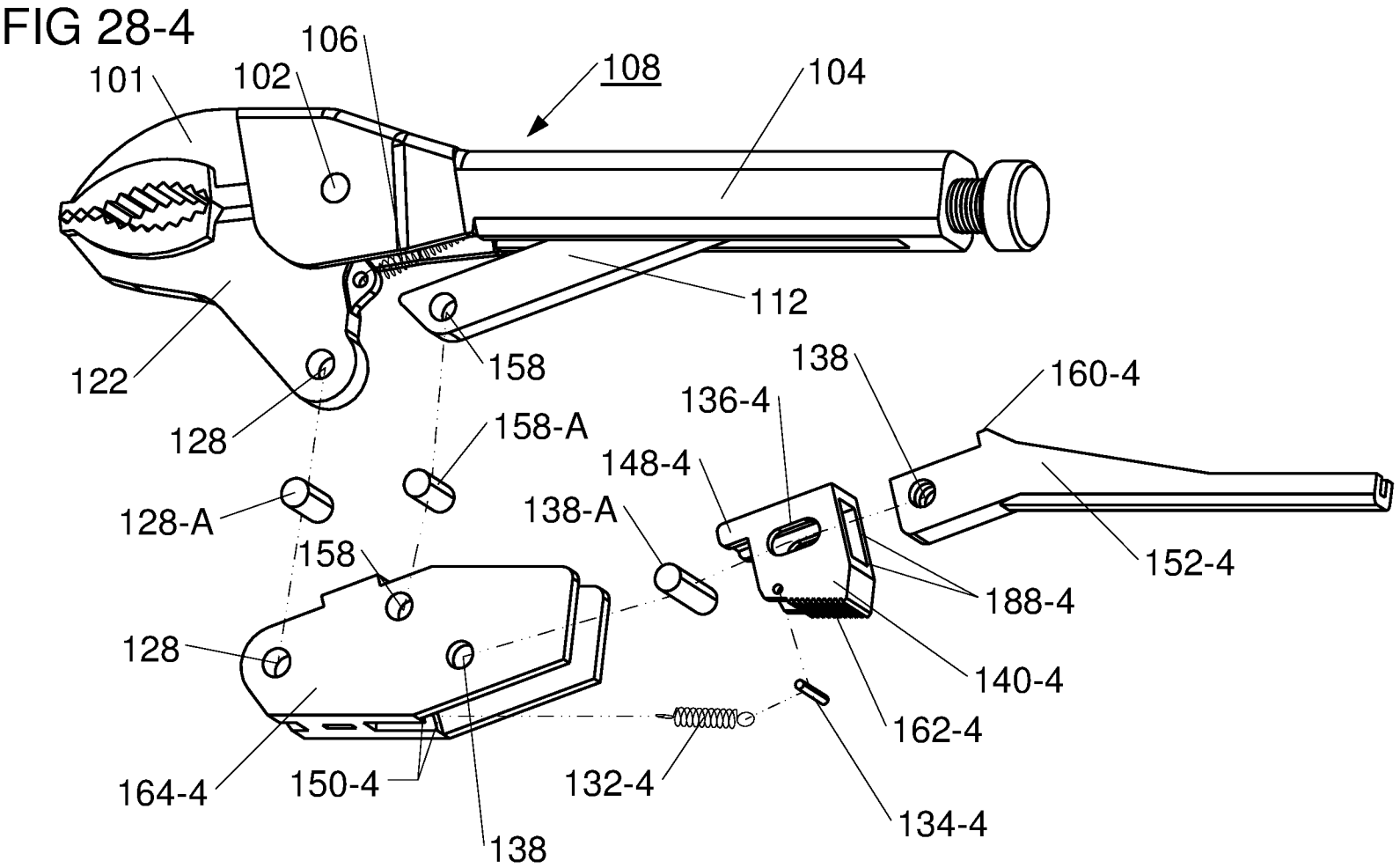
Figures 4, 30:
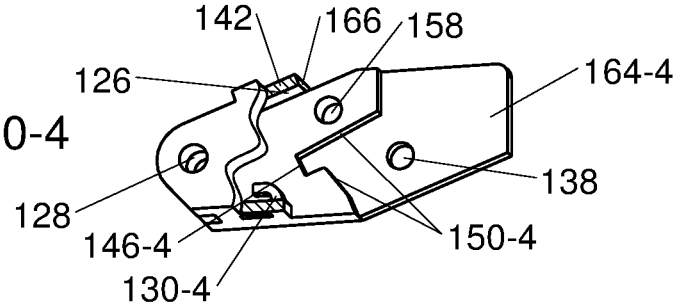

Shown in FIG. 28-4 and FIG. 30-4 is the front handle section 164-4. The front handle section 164-4 in this embodiment does not have a slot cut through the sides with a notch to serve as a catch engagement guide and catch, respectively. Instead, the front handle section 164-4 has molded contours on both inside walls that serve as the catch engagement guide 150-4 with these contours leading into a contoured notch that serves as the catch 146-4 (FIG. 30-4).

Figures 4, 29:
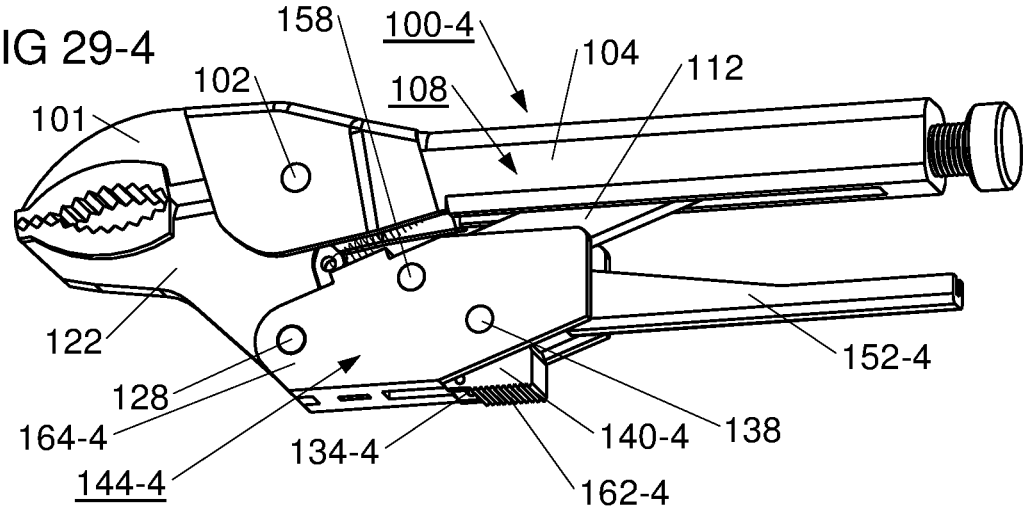

The rear handle section 152-4 is again pivotally attached to the front handle section 164-4 at the rear handle section pivot point 138 with the rear handle section pin 138-A (FIG. 28-4). The rear handle section 152-4 is mounted partially inside the front handle section 164-4 but other types of mounting are possible (FIG. 29-4).

1. Rear Handle Section and Release Trigger

In this embodiment, there is no lock pin. Instead, the catch engagement element 148-4 which is a projection (stud) on the release trigger 140-4 serves the same purpose (FIG. 28-4). The release trigger 140-4 has a release trigger handle channel 188-4 which is a rectangular channel inside the release trigger 140-4 that slides over the similarly shaped cross section end of the rear handle section 152-4 (FIG. 28-4). The release trigger 140-4 also has the release trigger handle pivot clearance slot 136-4 cut on both sides of this channel which allows the release trigger 140-4 to slide past the rear handle section pin 138-A.

The rear handle section pin 138-A is inserted at the rear handle section pivot point 138 through one of the walls of the front handle section 164-4, through the release trigger handle pivot clearance slot 136-4 on one side of the release trigger 140-4, then through the rear handle section 152-4, back through the release trigger handle pivot clearance slot 136-4 on the other side of the release trigger 140-4, and then through the other side of the front handle section 164-4. This mounting allows the release trigger 140-4 to slide a distance on the rear handle section 152-4 even if the rear handle section 152-4 is rotating around the rear handle section pivot point 138.

In this embodiment, the trigger engagement surface 162-4 of the release trigger 140-4 projects out past the bottom (the side opposite from the fixed handle body 104) of the front handle section 164-4 (FIG. 29-4).

2. Release Trigger Spring and Force Elements

Shown in FIG. 25-4 and FIG. 28-4, the release trigger spring 132-4 is an extension spring attached to the release trigger 140-4 at the release trigger spring attachment point 134-4, and the release trigger spring 132-4 is also attached to the front handle section 164-4 at a release trigger spring front handle section attachment point 130-4 in a manner similar to the embodiment in FIG. 1-1 through FIG. 13-E-1. The resulting force elements are also the same, with one element causing the release trigger 140-4 to tend to slide forward on the rear handle section 152-4 in the general direction towards the front handle section attachment point 128, and the other force element causing a torque that tends to rotate the release trigger 140-4 and rear handle section 152-4 around the rear handle section pivot point 138 away from the fixed handle body 104.

3. Catch and Catch Engagement

Figures 4, 31:
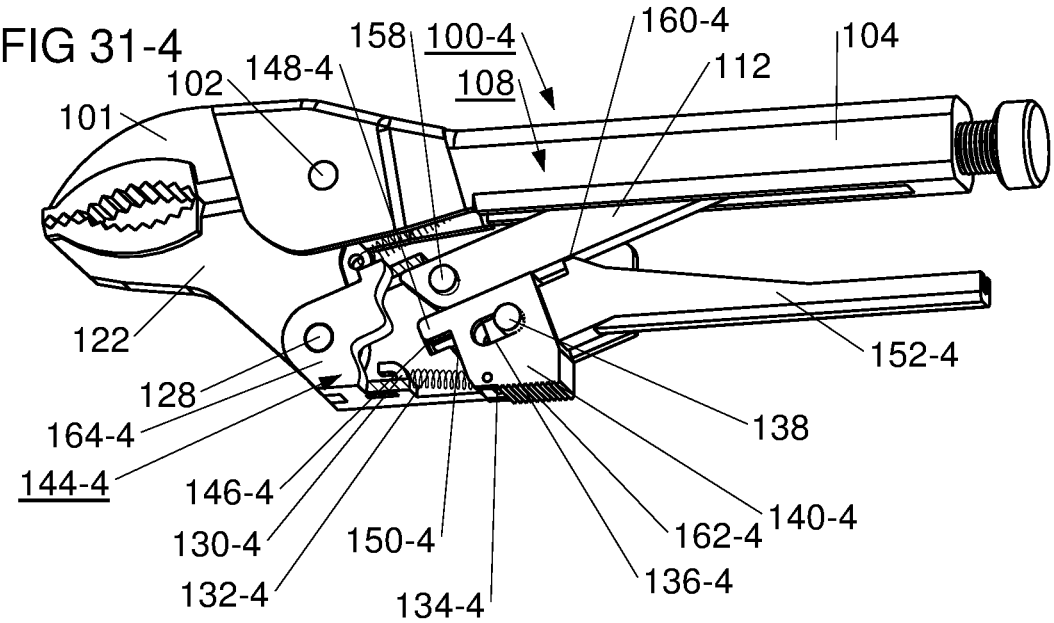

The force elements of the release trigger spring 132-4 and the interior surfaces of the catch engagement guide 150-4 normally guide the catch engagement element 148-4 into engagement with the catch 146-4 (FIG. 31-4). If the catch engagement element 148-4 is not in engagement with the catch 146-4 and there are no other opposing forces to the force elements on the release trigger 140-4 or rear handle section 152-4, then the release trigger spring 132-4 will cause the release trigger 140-4 to move forward (in the general direction towards the front handle section attachment point 128) on the rear handle section 152-4. Simultaneously, the release trigger spring 132-4 causes the release trigger 140-4 and rear handle section 152-4 to rotate around the rear handle section pivot point 138 away from the fixed handle body 104 until the catch engagement element 148-4 enters the catch 146-4 (FIG. 32-E-4).

The release trigger spring 132-4 also normally retains the catch engagement element 148-4 into engagement with the catch 146-4. In this position, the release trigger 140-4 is considered to be engaged with the catch 146-4. In this position, the rear handle section 152-4 and front handle section 164-4 are held rigid to one another (FIG. 31-4).

When the release trigger 140-4 is engaged with the catch 146-4, the rear handle section 152-4 is rotated around the rear handle section pivot point 138 away from the fixed handle body 104 to the maximum extent with the rear handle section 152-4 in the out-locked position (FIG. 32-A-4).

Figures 4, 27:
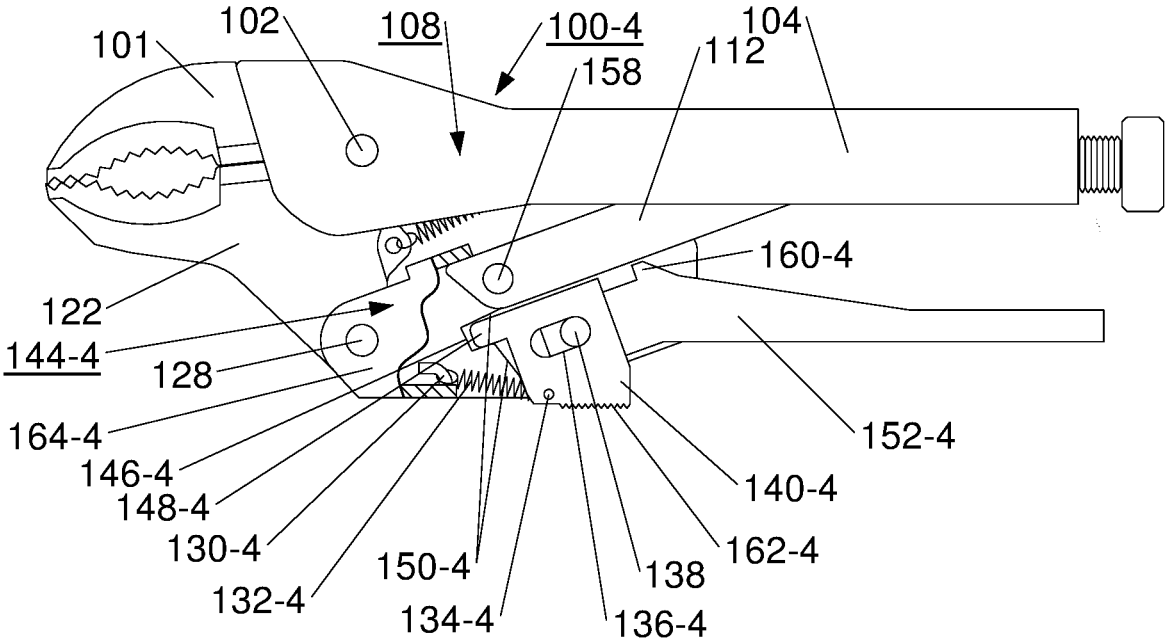

The release fulcrum point 160-4 in this embodiment is a projection located on the rear handle section 152-4 on the side closest to the toggle link 112 (FIG. 28-4, FIG. 27-4). The release fulcrum point 160-4 behaves in the same manner as the one in the embodiment shown in FIG. 1-1 through FIG. 13-E-1.

4. Operation

FIG. 32-A-4 shows the pliers 100-4 with the jaws open approaching a work-piece 500. The movable jaw 122 is retracted away from the fixed jaw 101 by the jaw retraction spring 106. This also causes the moving handle assembly 144-4 to be rotated away from the fixed handle body 104. The catch engagement element 148-4 of the release trigger 140-4 is engaged with the catch 146-4 and the rear handle section 152-4 is held rigid to the front handle section 164-4 with the rear handle section 152-4 in the out-locked position.

An operator applies a squeezing force on the rear handle section 152-4 of the moving handle assembly 144-4 towards the fixed handle body 104, resulting in the moving handle assembly 144-4 and toggle link 112 rotating inward towards the fixed handle body 104, causing the jaws to close on the work-piece 500.

FIG. 32-B-4 shows where the rotation of the moving handle assembly 144-4 and toggle link 112 have been stopped by the toggle link 112 contacting the toggle pivot over center stop 126 with the toggle pivot 158 stopped just past the toggle over center line 170. The jaws are closed and toggle locked onto the work-piece 500 with a positive gripping force. The toggle link 112 is stopped short of contacting the rear handle section 152-4.

Next, the operator disengages the release trigger 140-4 from the catch 146-4. The operator does this by engaging the trigger engagement surface 162-4 with one or more fingers. The operator pulls the release trigger 140-4 back against the force of the release trigger spring 132-4, sliding the release trigger 140-4 on the rear handle section 152-4 in a direction away from the front handle section attachment point 128. FIG. 32-C-4 shows the release trigger 140-4 pulled fully back on the rear handle section 152-4, resulting in the catch engagement element 148-4 exiting the catch 146-4. In this position, the release trigger 140-4 is disengaged or in the disengaged position from the catch 146-4, allowing the rear handle section 152-4 to rotate around the rear handle section pivot point 138 independently of the front handle section 164-4.

Next the operator, while holding the release trigger 140-4 in a disengaged position from the catch 146-4, squeezes the rear handle section 152-4 towards the fixed handle body 104. This squeezing force 400 causes the rear handle section 152-4 to rotate around the rear handle section pivot point 138 towards the fixed handle body 104 until the rear handle section 152-4 contacts the toggle link 112 at the release fulcrum point 160-4.

Upon contact with the toggle link 112, the release fulcrum point 160-4 causes the squeezing force 400 on the rear handle section 152-4 towards the fixed handle body 104 to be translated into an outwards force 402 on the rear handle section pivot point 138 away from the fixed handle body 104. This outwards force 402 causes the front handle section 164-4 and toggle link 112 to rotate outwards from the fixed handle body 104 causing the toggle pivot 158 to retract past the toggle over center line 170 shown in FIG. 32-D-4. Once the toggle pivot 158 retracts past the toggle over center line 170, the positive gripping force of the jaws on the work-piece 500 is eliminated and the toggle lock is eliminated (released).

FIG. 32-E-4 shows after the toggle lock has been eliminated, the operator relaxes the squeezing force 400 on the rear handle section 152-4 towards the fixed handle body 104 and releases the release trigger 140-4. This allows the jaw retraction spring 106 to retract the movable jaw 122 back away from the fixed jaw 101 releasing the work-piece 500. This also causes the moving handle assembly 144-4 to rotate outwards from the fixed handle body 104.

Simultaneously, the release trigger spring 132-4 causes the rear handle section 152-4 to rotate around the rear handle section pivot point 138 outwards from the fixed handle body 104, and the release trigger 140-4 to slide on the rear handle section 152-4 forward in a direction towards the front handle section attachment point 128. The movement of the catch engagement element 148-4 against the surfaces of the catch engagement guide 150-4 guides these two movements until the catch engagement element 148-4 enters the catch 146-4.

This results in the release trigger 140-4 being engaged with the catch 146-4 and the rear handle section 152-4 being held rigid to the front handle section 164-4 with the rear handle section 152-4 in the out-locked position. The movable jaw 122 is retracted away from the fixed jaw 101 by the jaw retraction spring 106, and the moving handle assembly 144-4 is retracted away from the fixed handle body 104 returning the pliers 100-4 to the original state, shown in FIG. 32-A-4.

A Plier Type Toggle Lock Hand Tool with Forward Moving Release Trigger

Another embodiment plier type toggle lock hand tool with quick release mechanism 100-5 (also known as 'the pliers', 'tool' or 'mechanism' in this embodiment) is illustrated in FIG. 33-5 through FIG. 39-E-5. The chief difference between this embodiment and the embodiment in FIG. 1-1 through FIG. 13-E-1 is that in this embodiment the release trigger 140-5 is disengaged from the catch 146-5 by moving the release trigger 140-5 forward on the rear handle section 152-5 in the general direction towards the front handle section attachment point 128 instead of away from it (FIG. 33-5).

The fixed handle assembly 108, movable jaw 122 and jaw retraction spring 106 (FIG. 33-5, FIG. 36-5) are the same as in the embodiment shown in FIG. 1-1 through FIG. 13-E-1.

Figures 5, 34:
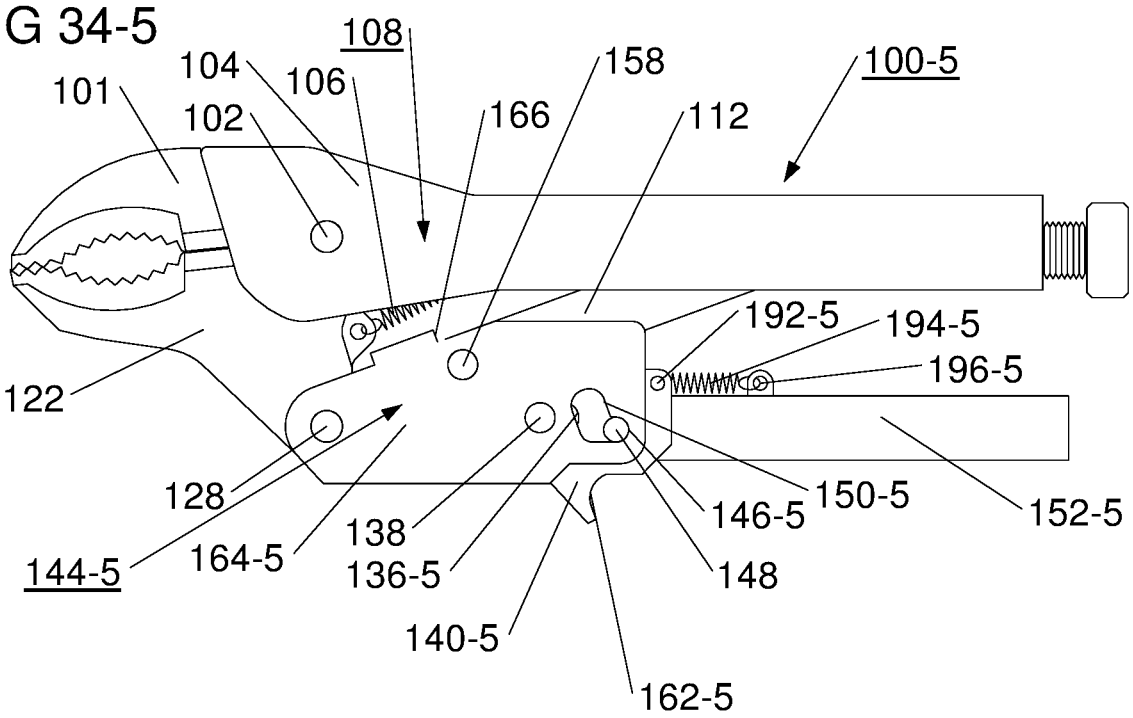

Shown in FIG. 34-5 the moving handle assembly 144-5 is also joined in the same way to the fixed handle assembly 108 and movable jaw 122 as the embodiment shown in FIG. 1-1 through FIG. 13-E-1.

The toggle link jaws retracted stop surface 166 and toggle pivot over center stop 126 (FIG. 35-5) perform the same functions as in the embodiment shown in FIG. 1-1 through FIG. 13-E-1.

1. Release Trigger Spring and Force Elements

The release trigger 140-5, lock pin 148, rear handle section 152-5, rear handle section pin 138-A and front handle section 164-5 are all assembled together (FIG. 36-5, FIG. 37-5, FIG. 38-5) in the same manner and allowing the same general motion as the embodiment shown in FIG. 1-1 through FIG. 13-E-1.

In this embodiment, the force elements on the release trigger 140-5 and rear handle section 152-5 are supplied by two springs.

Figures 5, 35:
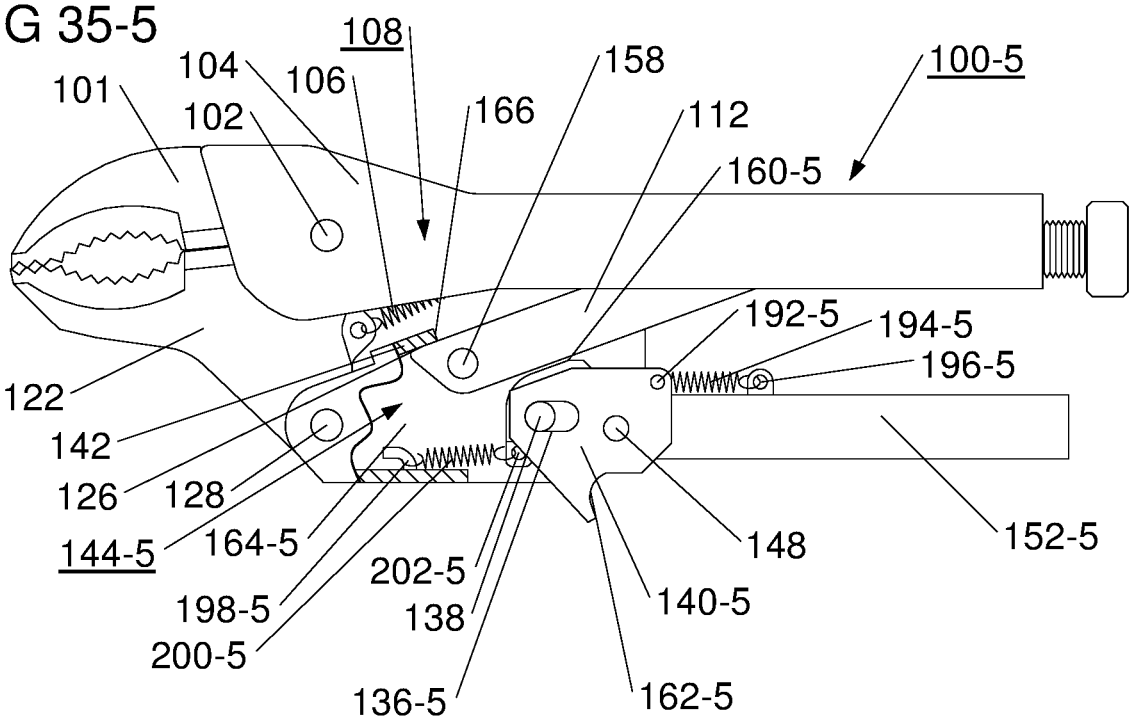
Figures 5, 36:
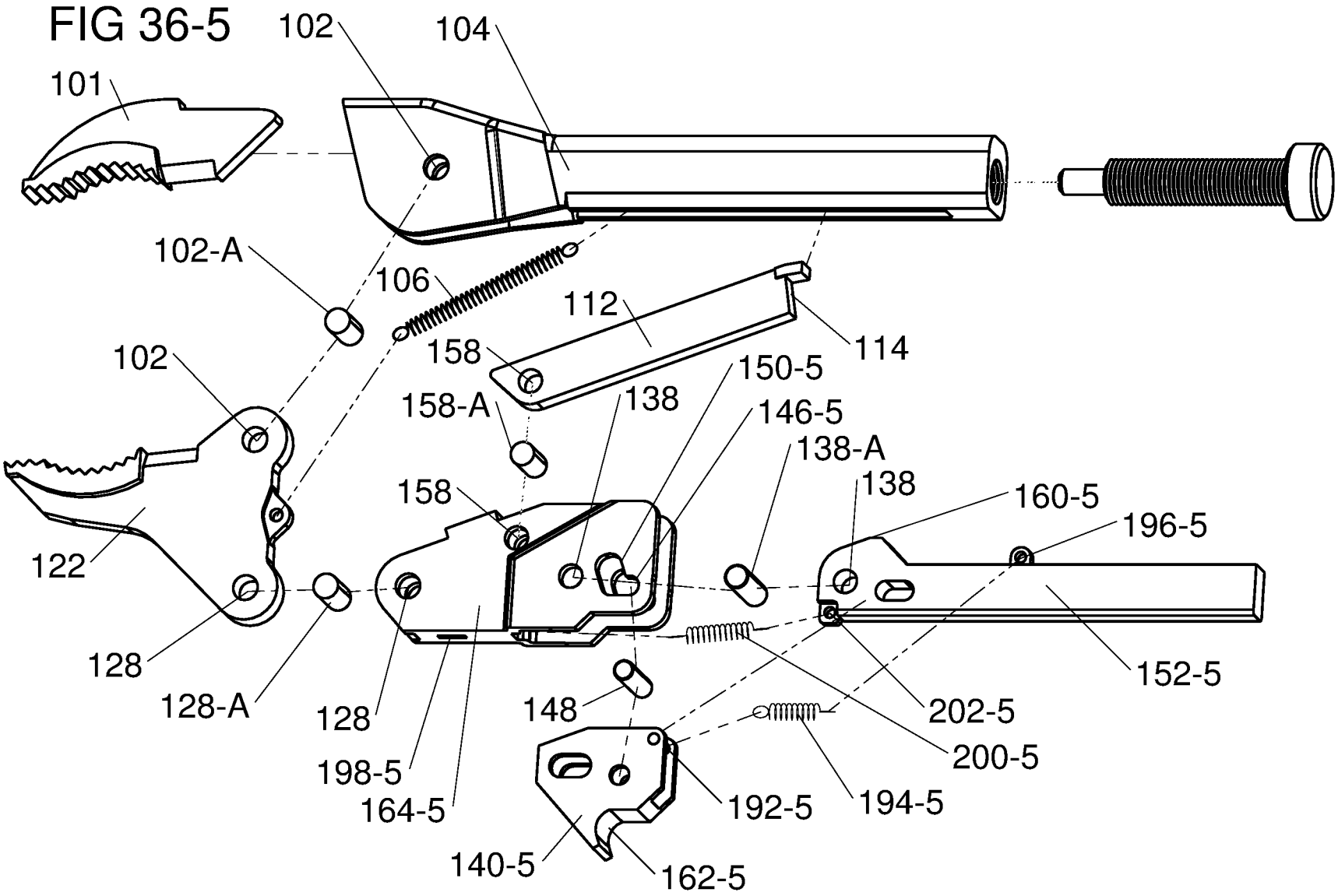
Figures 5, 37:
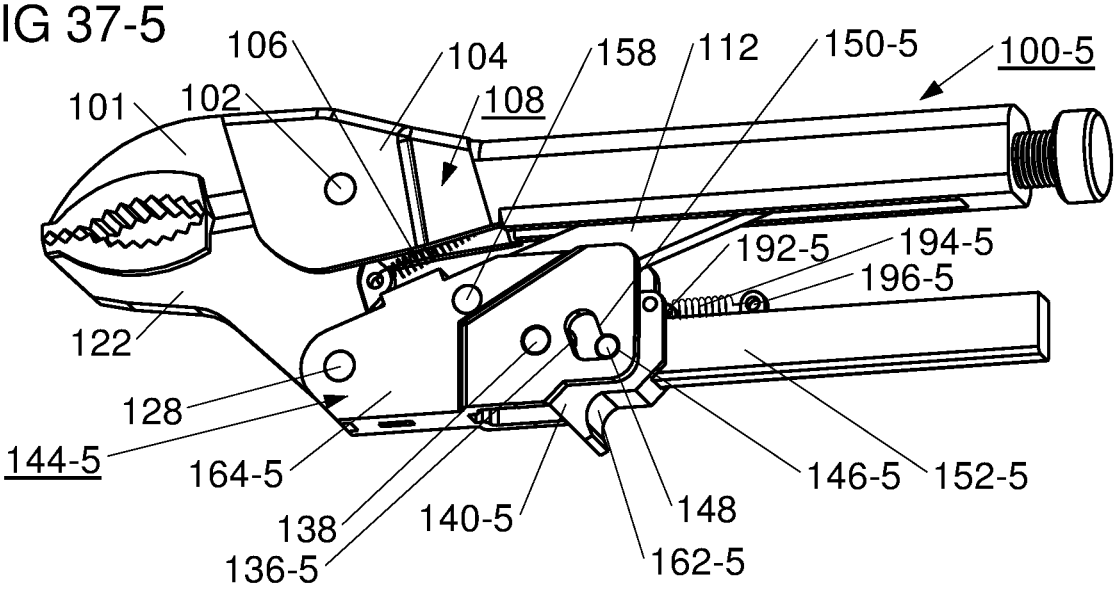
Figures 5, 38:
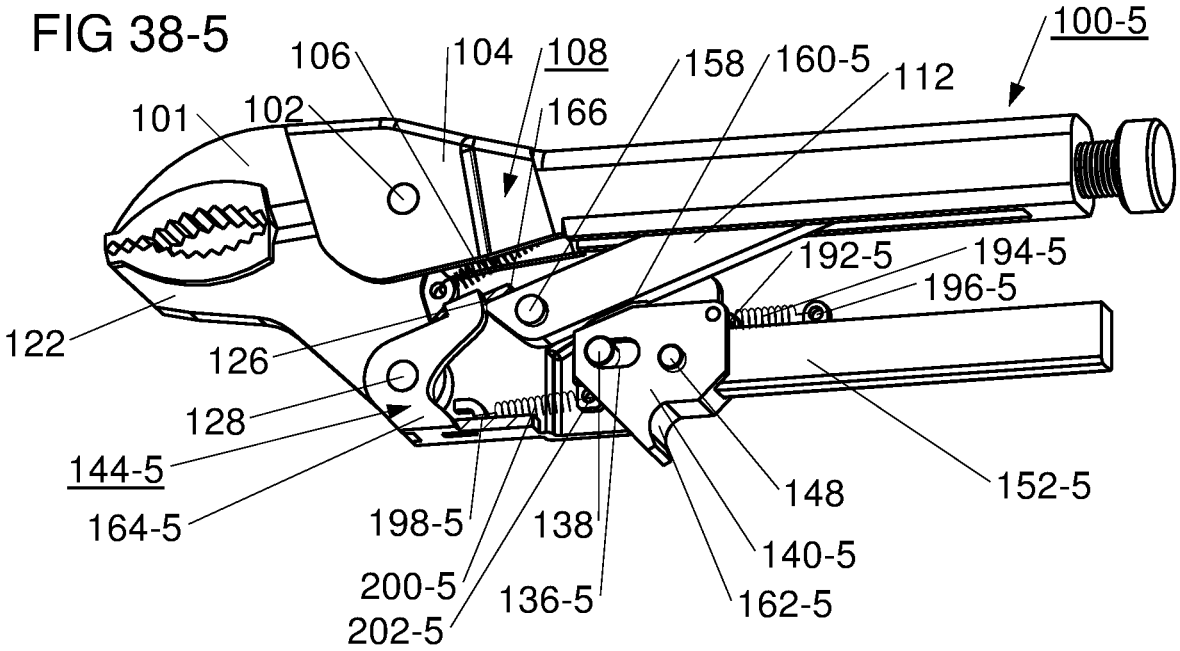

A rear handle section spring 200-5 is an extension spring (it could take other forms in different embodiments) attached to the front handle section 164-5 at a rear handle spring front handle section attachment point 198-5. The rear handle section spring 200-5 is also attached to the rear handle section 152-5 at a rear handle spring attachment point 202-5 which is attached at a distance from the rear handle section pivot point 138 (FIG. 35-5, FIG. 36-5). The rear handle section spring 200-5 causes a torque that tends to rotate the rear handle section 152-5 with the release trigger 140-5 around the rear handle section pivot point 138 away from the fixed handle body 104 (FIG. 39-E-5).

A release trigger spring 194-5 is an extension spring (it could take other forms in different embodiments) attached to the release trigger 140-5 at a release trigger spring attachment point 192-5. The release trigger spring 194-5 is also attached to the rear handle section 152-5 at a release trigger spring rear handle attachment point 196-5 (FIG. 35-5, FIG. 36-5). The release trigger spring 194-5 creates a force element on the release trigger 140-5 that tends to slide the release trigger 140-5 backwards on the rear handle section 152-5 in a general direction away from the front handle section attachment point 128 (FIG. 39-E-5).

2. Catch and Catch Engagement Guide

Similar to the embodiment shown in FIG. 1-1 through FIG. 13-E-1, the lock pin 148 on the release trigger 140-5 projects through both sides of the catch engagement guide 150-5 (FIG. 37-5) which is in the front handle section 164-5 (FIG. 36-5). The lock pin 148 acts as a catch engagement element and travels freely within the confines of the catch engagement guide 150-5.

Unlike the embodiment shown in FIG. 1-1 through FIG. 13-E-1, the catch 146-5 (FIG. 34-5, FIG. 36-5) is a notch in the catch engagement guide 150-5 at the corner of the catch engagement guide 150-5 farthest from the jaws and farthest away from the fixed handle body 104. The catch engagement guide 150-5 is also shaped differently in order to help the force elements guide the lock pin 148 into the catch 146-5.

3. Catch Engagement

The force elements of the release trigger spring 194-5 and the rear handle section spring 200-5 and the interior surfaces of the catch engagement guide 150-5 normally guide the lock pin 148 into engagement with the catch 146-5 where the lock pin acts as a catch engagement element. If the lock pin 148 is not in engagement with the catch 146-5 and there are no other opposing forces to the force elements on the release trigger 140-5 or rear handle section 152-5 then the release trigger spring 194-5 will cause the release trigger 140-5 to move rearward (in a general direction away from the front handle section attachment point 128) on the rear handle section 152-5. Simultaneously, the rear handle section spring 200-5 causes the rear handle section 152-5 with the release trigger 140-5 to rotate around the rear handle section pivot point 138 away from the fixed handle body 104 until the lock pin 148 guided by the interior surfaces of the catch engagement guide 150-5 enters the catch 146-5 (FIG. 39-E-5).

The release trigger spring 194-5 also normally retains the lock pin 148 into engagement with the catch 146-5. In this position, the release trigger 140-5 is engaged with the catch 146-5. The rear handle section 152-5 and front handle section 164-5 are held rigid to one another with the rear handle section 152-5 in the out-locked position. (FIG. 39-A-5)

4. Operation

FIG. 39-A-5 shows the pliers 100-5, with the jaws open, approaching a work-piece 500. The movable jaw 122 is retracted away from the fixed jaw 101 by the jaw retraction spring 106, causing the moving handle assembly 144-5 to be rotated away from the fixed handle body 104. The lock pin 148 of the release trigger 140-5 is engaged with the catch 146-5 and the rear handle section 152-5 is held rigid to the front handle section 164-5 with the rear handle section 152-5 in the out-locked position.

An operator applies a squeezing force on the rear handle section 152-5 of the moving handle assembly 144-5 towards the fixed handle body 104, resulting in the moving handle assembly 144-5 and toggle link 112 rotating inward towards the fixed handle body 104, causing the jaws to close on the work-piece 500.

FIG. 39-B-5 shows where the rotation of the moving handle assembly 144-5 and toggle link 112 has been stopped by the toggle link 112 contacting the toggle pivot over center stop 126 with the toggle pivot 158 stopped just past the toggle over center line 170. The jaws are closed and toggle locked onto the work-piece 500 with a positive gripping force. The toggle link 112 is stopped short of contacting the rear handle section 152-5.

Next, the operator disengages the release trigger 140-5 from the catch 146-5. The operator does this by engaging the trigger engagement surface 162-5 with one or more fingers. The operator pushes the release trigger 140-5 forward against the force of the release trigger spring 194-5, sliding the release trigger 140-5 on the rear handle section 152-5 in a general direction towards the front handle section attachment point 128. FIG. 39-C-5 shows the release trigger 140-5 pushed fully forward on the rear handle section 152-5 resulting in the lock pin 148 exiting the catch 146-5. In this position, the release trigger 140-5 is disengaged or in the disengaged position from the catch 146-5. This allows the rear handle section 152-5 to rotate around the rear handle section pivot point 138 independently of the front handle section 164-5.

Next the operator, while holding the release trigger 140-5 in a disengaged position from the catch 146-5, squeezes the rear handle section 152-5 toward the fixed handle body 104. This squeezing force 400 causes the rear handle section 152-5 to rotate around the rear handle section pivot point 138 towards the fixed handle body 104 until the rear handle section 152-5 contacts the toggle link 112 at the release fulcrum point 160-5.

Upon contact with the toggle link 112, the release fulcrum point 160-5 causes the squeezing force 400 on the rear handle section 152-5 towards the fixed handle body 104 to be translated into a outwards force 402 on the rear handle section pivot point 138 away from the fixed handle body 104. This outwards force 402 causes the front handle section 164-5 and toggle link 112 to rotate outwards from the fixed handle body 104 causing the toggle pivot 158 to retract past the toggle over center line 170 shown in FIG. 39-D-5. Once the toggle pivot 158 retracts past the toggle over center line 170, the positive gripping force of the jaws on the work-piece 500 is eliminated and the toggle lock is eliminated (released).

FIG. 39-E-5 shows after the toggle lock has been eliminated, the operator relaxes the squeezing force 400 on the rear handle section 152-5 towards the fixed handle body 104 and releases the release trigger 140-5. This allows the jaw retraction spring 106 to retract the movable jaw 122 back away from the fixed jaw 101 releasing the work-piece 500. This also causes the moving handle assembly 144-5 to rotate outwards from the fixed handle body 104.

Simultaneously, the rear handle section spring 200-5 causes the rear handle section 152-5 to rotate around the rear handle section pivot point 138 outwards from the fixed handle body 104. The release trigger spring 194-5 simultaneously causes the release trigger 140-5 to slide on the rear handle section 152-5 in a direction away from the front handle section attachment point 128. The movement of the lock pin 148 against the surfaces of the catch engagement guide 150-5 guides these two movements from the force elements until the lock pin 148 enters the catch 146-5.

This results in the release trigger 140-5 being engaged with the catch 146-5 and the rear handle section 152-5 being held rigid to the front handle section 164-5 with the rear handle section 152-5 in the out-locked position. The movable jaw 122 is retracted away from the fixed jaw 101 by the jaw retraction spring 106, and the moving handle assembly 144-5 is retracted away from the fixed handle body 104 returning the pliers 100-5 to the original state shown in FIG. 39-A-5.

Figures 6, 40:
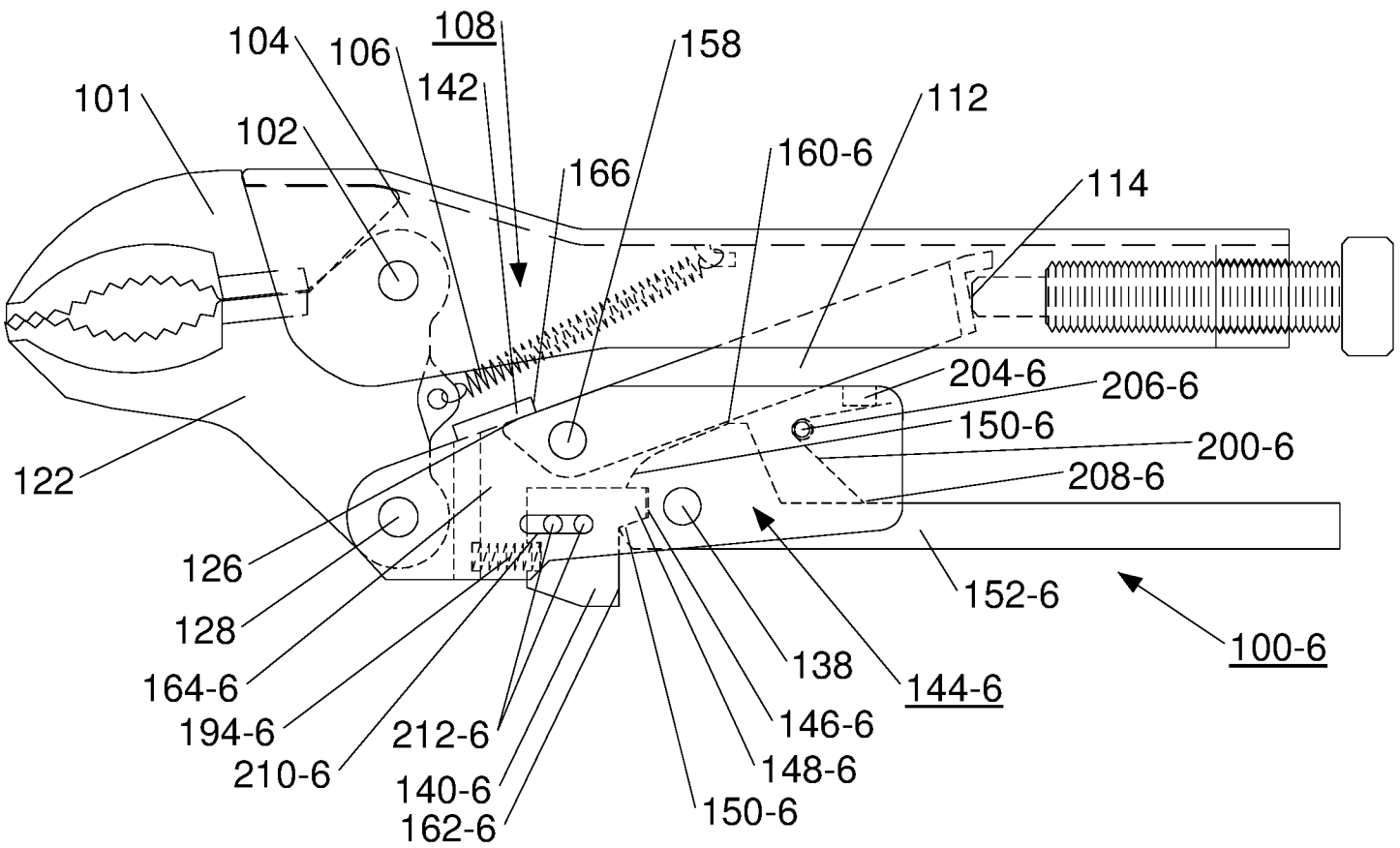
Figures 6, 43:
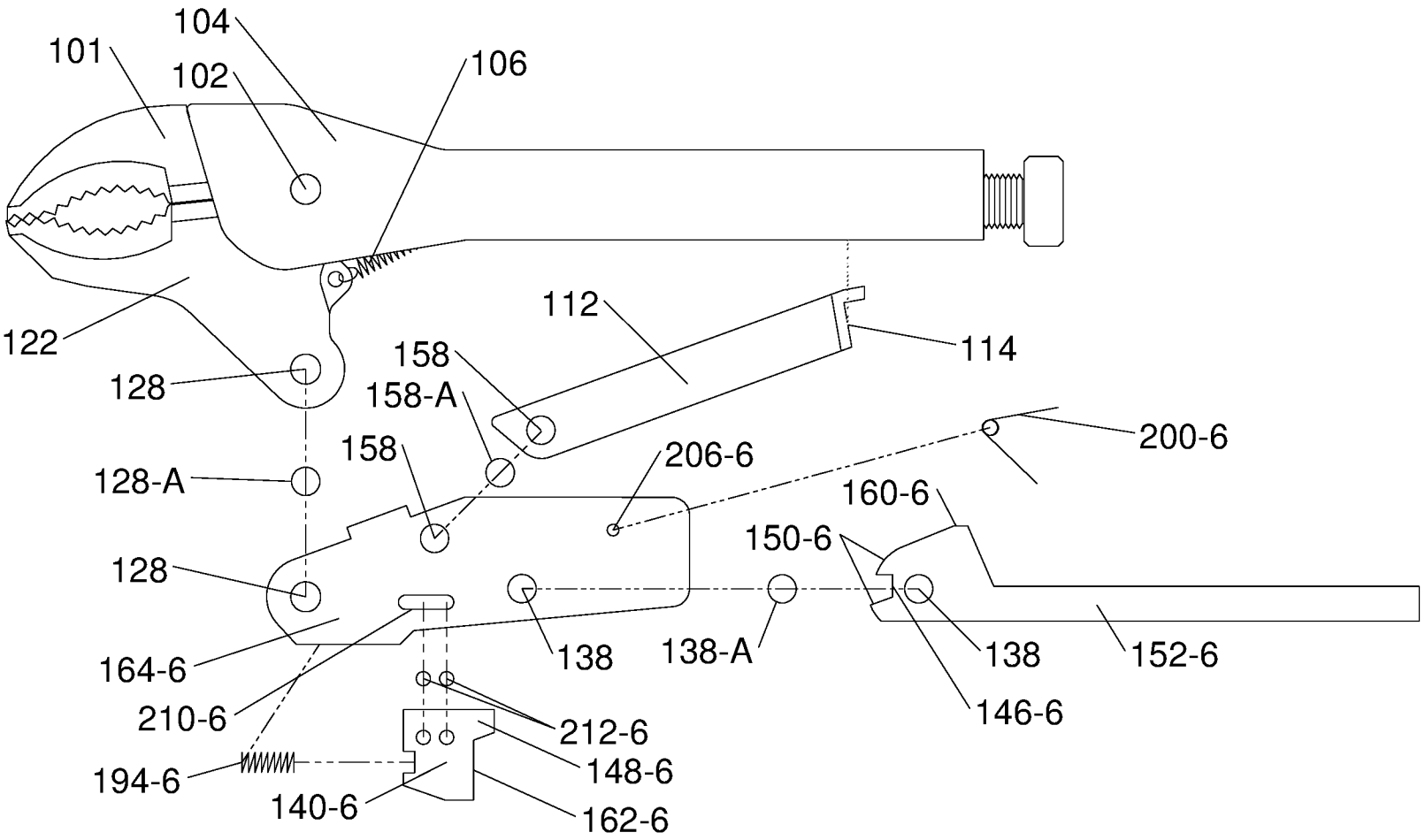

A Plier Type Toggle Lock Hand Tool with Release Trigger Movably Mounted on Front Handle Section and Catch Located on Rear Handle Section Another embodiment plier type toggle lock hand tool with quick release mechanism 100-6 (also known as 'the pliers', 'tool' or 'mechanism' in this embodiment) is illustrated in FIG. 40-6 through FIG. 44-E-6. The chief difference between this embodiment and the embodiment in FIG. 1-1 through FIG. 13-E-1 is that the release trigger 140-6 is movably mounted and retained on the front handle section 164-6 and the catch 146-6 is located on the rear handle section 152-6 (FIG. 40-6, FIG. 43-6). Also in this embodiment, the release trigger 140-6 is disengaged from the catch 146-6 by moving the release trigger 140-6 forward on the front handle section 164-6 in the direction towards the front handle section attachment point 128 instead of away from it (FIG. 44-C-6).

The fixed handle assembly 108, movable jaw 122 and jaw retraction spring 106 (FIG. 40-6 and FIG. 43-6) are the same as in the embodiment shown in FIG. 1-1 through FIG. 13-E-1.

Shown in FIG. 40-6, the moving handle assembly 144-6 is also joined the same to both the fixed handle assembly 108 and movable jaw 122 (FIG. 43-6) as in the embodiment shown in FIG. 1-1 through FIG. 13-E-1.

The toggle link jaws retracted stop surface 166 and toggle pivot over center stop 126 (FIG. 42-6) perform the same functions as in the embodiment shown in FIG. 1-1 through FIG. 13-E-1.

Figures 6, 41:
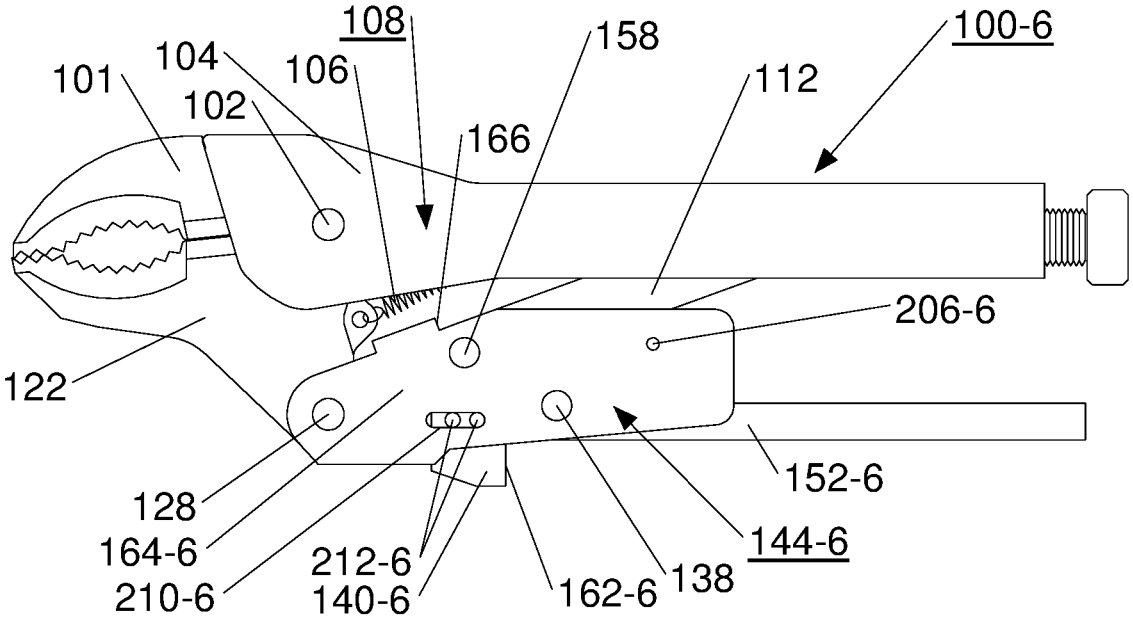

In this embodiment, the release trigger 140-6 is slidably mounted inside the front handle section 164-6, however other types of movable mountings and positions are possible. The release trigger 140-6 has several release trigger travel pins 212-6 inserted into it. The release trigger travel pins 212-6 project out of the release trigger 140-6 and through a slot cut in both sides of the front handle section 164-6 which is known as the release trigger travel pin slot 210-6 (FIG. 43-6, FIG. 41-6). This allows the release trigger 140-6 and release trigger travel pins 212-6 to slide in the release trigger travel pin slot 210-6 (FIG. 44-C-6).

The release trigger 140-6 has a projecting integral stud that serves as the catch engagement element 148-6 (FIG. 43-6). The release trigger 140-6 is mounted so that the catch engagement element 148-6 points in the general direction of the rear handle section pivot point 138.

The trigger engagement surface 162-6 of the release trigger 140-6 projects out of the bottom (side opposite the fixed handle body 104) of the front handle section 164-6 (FIG. 41-6).

1. Catch, Catch Engagement Guide, Rear Handle Section

Figures 6, 42:
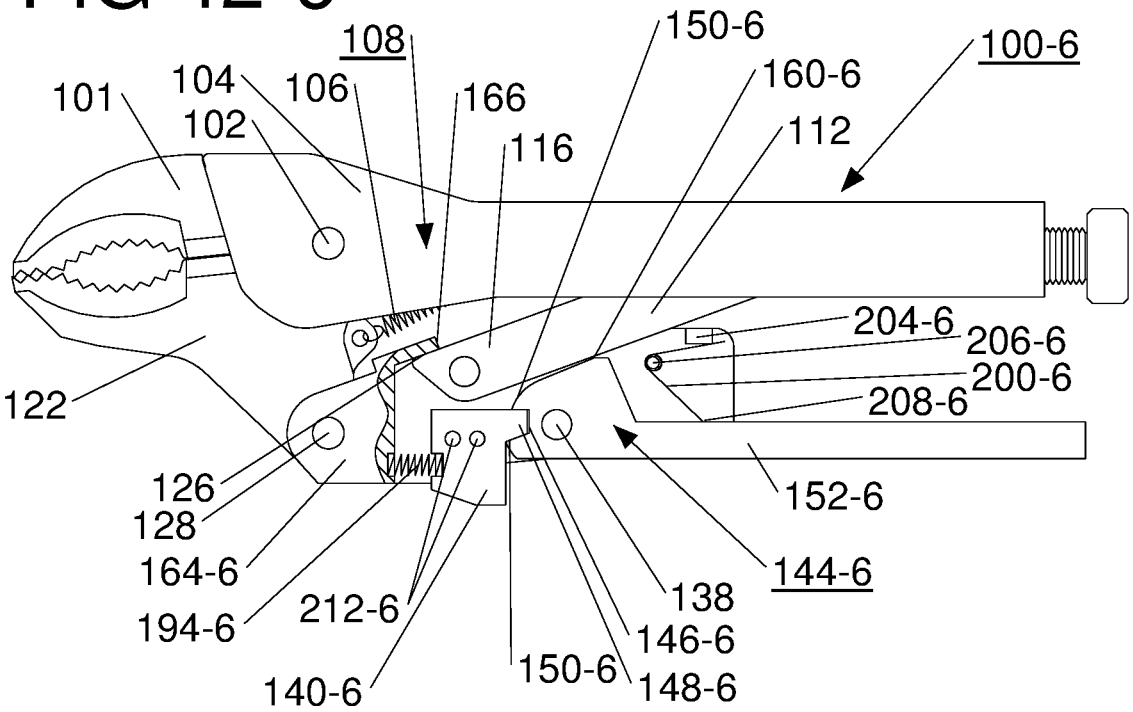

In this embodiment, the catch 146-6 is a notch cut into the face of the rear handle section 152-6 opposite to the grip (long) side of the rear handle section 152-6 (FIG. 43-6). The catch 146-6 is shaped to match the catch engagement element 148-6 (FIG. 42-6). The catch engagement guide 150-6 is the concentric surface and projection around the catch 146-6 on the rear handle section 152-6 (FIG. 43-6).

The rear handle section 152-6 is mounted partially inside the front handle section 164-6 (FIG. 41-6) with the rear handle section pin 138-A at the rear handle section pivot point 138. The rear handle section 152-6 is mounted so that the catch 146-6 is normally closest to the catch engagement element 148-6 of the release trigger 140-6 (FIG. 42-6).

2. Release Trigger Spring, Rear Handle Section Spring and Force Elements

In this embodiment, the rear handle section spring 200-6 is a torsion spring mounted inside the front handle section 164-6 with a pin at the rear handle spring front handle section attachment point 206-6. The rear handle spring front handle section attachment point 206-6 is between the fixed handle assembly 108 and the rear handle section 152-6. One of the legs of the rear handle section spring 200-6 contacts a rear handle spring leg front handle section contact point 204-6 which is a cross member on the front handle section 164-6. The other leg of the rear handle section spring 200-6 contacts the surface of the rear handle section 152-6 closest to the fixed handle body 104 at a rear handle spring leg contact point 208-6 (FIG. 42-6). The rear handle section spring 200-6 could also take other forms and mountings.

The rear handle section spring 200-6 creates a force element that tends to rotate the rear handle section 152-6 around the rear handle section pivot point 138 away from the fixed handle body 104. This same rotation causes the catch 146-6 and catch engagement guide 150-6 to rotate around the rear handle section pivot point 138 towards the fixed handle body 104 (FIG. 44-E-6).

In this embodiment, the release trigger spring 194-6 is a compression spring (and could take other forms) that is inserted between the release trigger 140-6 and an inner surface of the front handle section 164-6 between the release trigger 140-6 and the front handle section attachment point 128. The release trigger spring 194-6 is retained by fitting it into recesses formed on both the release trigger 140-6 and the inner surface of the front handle section 164-6 (FIG. 42-6, FIG. 43-6).

The release trigger spring 194-6 creates a force element on the release trigger 140-6 that tends to slide the release trigger 140-6 backwards on the front handle section 164-6 in the general direction away from the front handle section attachment point 128 (FIG. 44-E-6).

3. Catch Engagement

The force elements of the release trigger spring 194-6, and the rear handle section spring 200-6, along with exterior surfaces of the catch engagement guide 150-6, normally guide the catch engagement element 148-6 into engagement with the catch 146-6.

If the catch engagement element 148-6 is not in engagement with the catch 146-6 and there are no other forces other than the force elements on the release trigger 140-6 or rear handle section 152-6 then the release trigger spring 194-6 will cause the release trigger 140-6 to move rearward (in a general direction away from the front handle section attachment point 128) on the front handle section 164-6. This causes the catch engagement element 148-6 to contact the upper surface of the catch engagement guide 150-6 on the rear handle section 152-6 (FIG. 44-E-6).

The rear handle section spring 200-6 causes the rear handle section 152-6 to rotate around the rear handle section pivot point 138 away from the fixed handle body 104. This causes the catch 146-6 and catch engagement guide 150-6 to rotate towards the fixed handle body 104 with the catch engagement element 148-6 of the release trigger 140-6 riding on the surface of the catch engagement guide 150-6 until the catch engagement element 148-6 enters the catch 146-6 (FIG. 44-E-6). In this position, the release trigger 140-6 is engaged with the catch 146-6 and the rear handle section 152-6 and front handle section 164-6 are held rigid to one another with the rear handle section 152-6 in the out-locked position (FIG. 44-A-6).

4. Operation

FIG. 44-A-6 shows the pliers 100-6 with the jaws open approaching a work-piece 500. The movable jaw 122 is retracted away from the fixed jaw 101 by the jaw retraction spring 106. This also causes the moving handle assembly 144-6 to be rotated away from the fixed handle body 104. The catch engagement element 148-6 of the release trigger 140-6 is engaged with the catch 146-6, and the rear handle section 152-6 is held rigid to the front handle section 164-6 with the rear handle section 152-6 in the out-locked position.

An operator applies a squeezing force on the rear handle section 152-6 of the moving handle assembly 144-6 towards the fixed handle body 104, resulting in the moving handle assembly 144-6 and toggle link 112 rotating inward towards the fixed handle body 104, causing the jaws to close on the work-piece 500.

FIG. 44-B-6 shows where the rotation of the moving handle assembly 144-6 and toggle link 112 has been stopped by the toggle link 112 contacting the toggle pivot over center stop 126 with the toggle pivot 158 stopped just past the toggle over center line 170. The jaws are closed and toggle locked onto the work-piece 500 with a positive gripping force. The toggle link 112 is stopped short of contacting the rear handle section 152-6.

Next, the operator disengages the release trigger 140-6 from the catch 146-6. The operator does this by engaging the trigger engagement surface 162-6 with one or more fingers. The operator pushes the release trigger 140-6 against the force of the release trigger spring 132-6, sliding the release trigger 140-6 forwards on the front handle section 164-6 in the direction towards the front handle section attachment point 128. FIG. 44-C-6 shows the release trigger 140-6 pushed fully forward on the front handle section 164-6 resulting in the catch engagement element 148-6 exiting the catch 146-6 of the rear handle section 152-6. In this position, the release trigger 140-6 is disengaged or in the disengaged position from the catch 146-6. This allows the rear handle section 152-6 to rotate around the rear handle section pivot point 138 independently of the front handle section 164-6.

Next the operator, while holding the release trigger 140-6 in a disengaged position from the catch 146-6, squeezes the rear handle section 152-6 toward the fixed handle body 104. This squeezing force 400 causes the rear handle section 152-6 to rotate around the rear handle section pivot point 138 towards the fixed handle body 104 until the rear handle section 152-6 contacts the toggle link 112 at the release fulcrum point 160-6.

Upon contact with the toggle link 112, the release fulcrum point 160-6 causes the squeezing force 400 on the rear handle section 152-6 toward the fixed handle body 104 to be translated into outwards force 402 on the rear handle section pivot point 138 away from the fixed handle body 104. This outwards force 402 causes the front handle section 164-6 and toggle link 112 to rotate outwards from the fixed handle body 104 causing the toggle pivot 158 to retract past the toggle over center line 170 shown in FIG. 44-D-6. Once the toggle pivot 158 retracts past the toggle over center line 170, the positive gripping force of the jaws on the work-piece 500 is eliminated and the toggle lock is eliminated (released).

FIG. 44-E-6 shows after the toggle lock has been eliminated, the operator relaxes the squeezing force 400 on the rear handle section 152-6 toward the fixed handle body 104 and releases the release trigger 140-6. This allows the jaw retraction spring 106 to retract the movable jaw 122 back away from the fixed jaw 101 releasing the work-piece 500.

This also causes the moving handle assembly 144-6 to rotate outwards from the fixed handle body 104.

Simultaneously, the release trigger spring 194-6 causes the release trigger 140-6 to move rearward on the front handle section 164-6 (in a general direction away from the front handle section attachment point 128). This causes the catch engagement element 148-6 of the release trigger 140-6 to contact the upper surface of the catch engagement guide 150-6 on the rear handle section 152-6 (FIG. 44-E-6).

The rear handle section spring 200-6 causes the rear handle section 152-6 to rotate around the rear handle section pivot point 138 away from the fixed handle body 104. This causes the catch 146-6 and catch engagement guide 150-6 to rotate towards the fixed handle body 104 with the catch engagement element 148-6 riding on the surface of the catch engagement guide 150-6 until the catch engagement element 148-6 enters the catch 146-6 (FIG. 44-E-6).

In this position, the release trigger 140-6 is engaged with the catch 146-6 and the rear handle section 152-6 and front handle section 164-6 are held rigid to one another with the rear handle section 152-6 in the out-locked position. This returns the pliers 100-6 to the original state shown in FIG. 44-A-6.

A Plier Type Toggle Lock Hand Tool with Release Fulcrum Point on Toggle Link

Figures 1, 7:
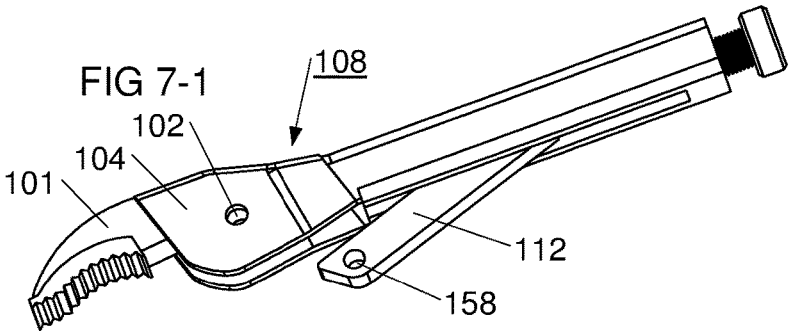
Figures 7, 46:
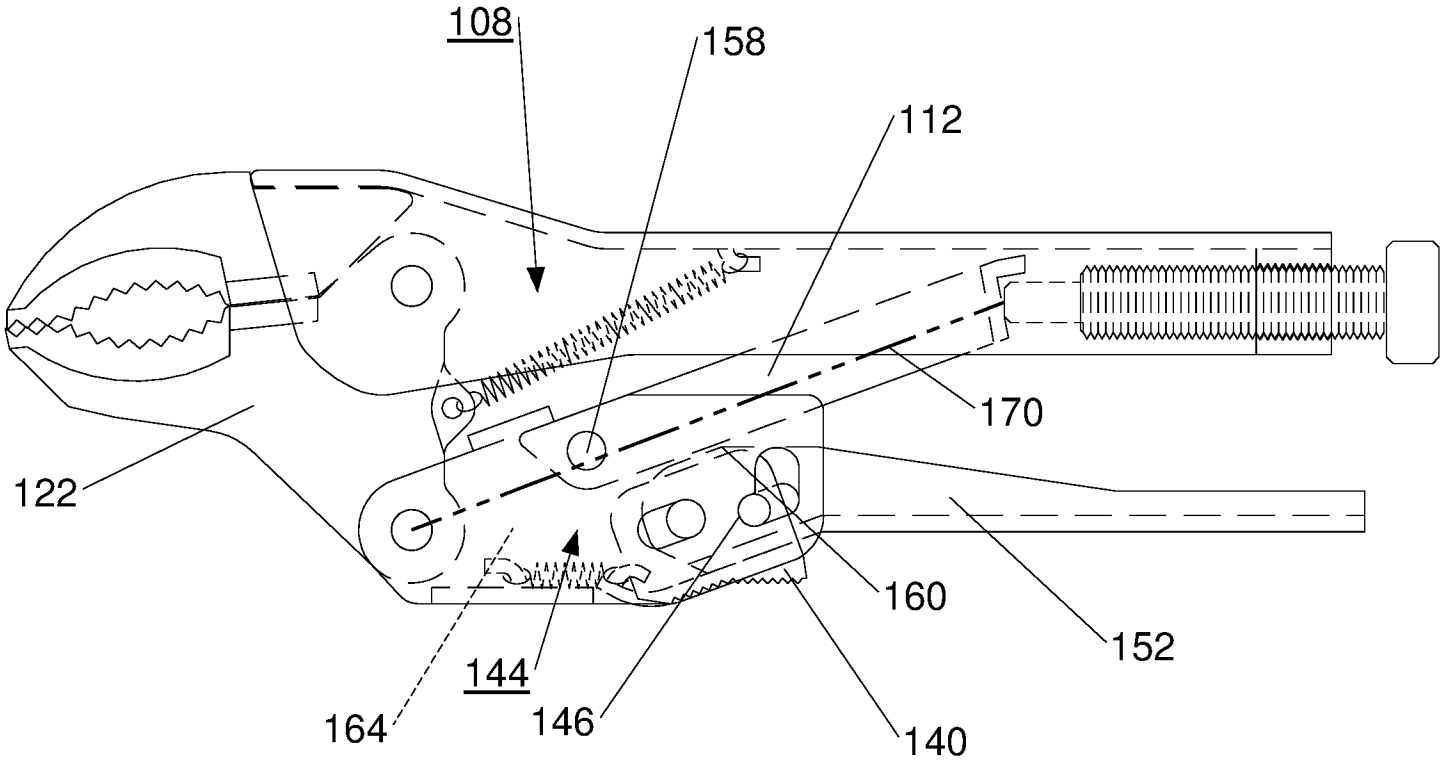

Another embodiment plier type toggle lock hand tool with quick release mechanism 100-7 also known as 'the pliers', 'tool' or 'mechanism' in this embodiment is illustrated in FIG. 45-A-7 through FIG. 46-7. This embodiment is identical to the embodiment in FIG. 1-1 through FIG. 13-E-1 except for the fact that the release fulcrum point 160-7 has been moved from the rear handle section 152-7 to the toggle link 112-7 (FIG. 46-7).

FIG. 45-A-7 shows the pliers 100-7 in the toggle locked position. In this position, the release trigger 140 is engaged with the catch 146. The rear handle section 152-7 and front handle section 164 are held rigid to one another with the rear handle section 152-7 in the out-locked position. The rear handle section 152-7 is not in contact with the release fulcrum point 160-7 on the toggle link 112-7.

FIG. 45-B-7 shows the pliers 100-7 after the toggle lock has been eliminated with the release trigger 140 disengaged from the catch 146. The rear handle section 152-7 in contact with and pivoted (rocked) around the release fulcrum point 160-7 located on the toggle link 112-7.

Operation is identical to the embodiment in FIG. 1-1 through FIG. 13-E-1 except for the fact that the release fulcrum point 160-7 is located on the toggle link 112-7. Various modifications and variations of the described embodiments will be apparent to those skilled in the art without departing from the scope and spirit of the invention. Although the invention has been described in connection with specific embodiments, it will be understood that it is capable of further modifications and that the invention as claimed should not be unduly limited to such specific embodiments. Indeed, various modifications of the described modes for carrying out the invention that are obvious to those skilled in the art are intended to be within the scope of the invention. This application is intended to cover any variations, uses, or adaptations of the invention following, in general, the principles of the invention and including such departures from the present disclosure come within known customary practice within the art to which the invention pertains and may be applied to the essential features herein before set forth.

All publications, patents, and patent applications mentioned herein are incorporated by reference to the same extent as if each individual publication, patent or patent application was specifically and individually indicated to be incorporated by reference in its entirety. In the event of there being a difference between definitions set forth in this application and those in documents incorporated herein by reference, the definitions set forth herein control.

What is claimed is:

1. A hand-held tool device with an ergonomic quick release mechanism, the device comprising:

a fixed handle assembly comprising a fixed handle body with a fixed jaw, and a toggle link attached to said fixed handle body;

a movable jaw movably attached to said fixed handle assembly;

a moving handle assembly comprising a front handle section movably attached to said movable jaw at a front handle section attachment point, said front handle section also pivotally attached to said toggle link at a toggle pivot, and a rear handle section pivotally attached to said front handle section at a rear handle section attachment point;

a release fulcrum point;

a releasable means for holding said front handle section and said rear handle section rigid to one another comprising;

a catch located on one of said front handle or rear handle sections of said moving handle assembly; and a release trigger movably attached and retained on one of said front handle or rear handle sections of said moving handle assembly not having said catch; wherein the release trigger comprises a catch engagement element and wherein said rear handle section extends beyond said front handle section when rigid to one another.

2. The device of claim 1, wherein said releasable means for holding said front handle section and said rear handle section rigid to one another further comprises a catch engagement guide and one or more springs.

3. The device of claim 2, wherein said catch engagement guide comprises one or more slots cut into said front handle section, said catch engagement element of said release trigger projecting into said catch engagement guide.

4. The device of claim 2, wherein said one or more springs are extension springs.

5. The device of claim 1, further including a toggle link over center stop on said front handle section to stop said toggle pivot just past a toggle over center line by stopping the rotation of said toggle link in relation to said front handle section at that point.

6. The device of claim 1, wherein said release trigger is movably mounted and retained on said rear handle section.

7. The device of claim 6, wherein said release trigger is slidably mounted and retained on said rear handle section.

8. A hand held clamping toggle lock device with ergonomic quick release mechanism, the device comprising:

a fixed handle assembly comprising a fixed handle body with a fixed jaw, a toggle link attached to said fixed handle body at a toggle link body attachment point;

a movable jaw movably attached to said fixed handle assembly;

a moving handle assembly comprising a front handle section movably attached to said movable jaw at a front handle section attachment point, said front handle section also pivotally attached to said toggle link at a toggle pivot, and a rear handle section pivotally attached to said front handle section at a rear handle section attachment point;

a release fulcrum point;

a catch located on one of the said front or rear handle sections of said moving handle assembly;

a release trigger movably attached and retained on the one of said front or rear handle sections not having said catch, said release trigger also having a catch engagement element for the purpose of engaging said catch; and a means for guiding and retaining said release trigger into engagement with said catch the means comprising one or more springs and a catch engagement guide, the rear handle section extending beyond the front handle section when held rigid to one another.

9. The device of claim 8, wherein said one or more springs and said catch engagement guide causing said release trigger to be engaged with said catch causing said rear handle section and said front handle section to be held rigid to one another with said rear handle section rotated around said rear handle section attachment point outward from said fixed handle body in a rear handle section out-locked position.

10. The device of claim 9, wherein said one or more springs are extension springs.

11. The device of claim 8, wherein said catch engagement guide is one or more slots cut into said front handle section, said catch engagement element of said release trigger projecting into said catch engagement guide, said catch engagement guide structured to guide the movement of said rear handle section and said catch engagement element of said release trigger from said one or more springs into engagement with said catch with said rear handle section in said rear handle section out-locked position.

12. The device of claim 8, further comprising a toggle link contacting the toggle pivot over center stop on said front handle section to stop said toggle pivot just past a toggle over center line by stopping the rotation of said toggle link in relation to said front handle section at that point.

13. The device of claim 8, wherein said release trigger is movably mounted and retained on said rear handle section.

14. The device of claim 13, wherein said release trigger is slidably mounted and retained on said rear handle section.

15. A hand held clamping toggle device with ergonomic quick release mechanism, the device comprising:

a fixed handle assembly comprising a fixed handle body with a fixed jaw, a toggle link attached to said fixed handle body at a toggle link body attachment point;

a movable jaw movably attached to said fixed handle assembly;

a moving handle assembly comprising a front handle section movably attached to said movable jaw at a front handle section attachment point, said front handle section also pivotally attached to said toggle link at a toggle pivot, and a rear handle section pivotally attached to said front handle section at a rear handle section attachment point, the rear handle section extending beyond the front handle section;

a release fulcrum point;

a catch and a catch engagement guide located on one of said front or rear handle sections; a release trigger movably attached and retained on said front or rear handle sections of said moving handle assembly not having said catch, said release trigger also having a catch engagement element for the purpose of engaging said catch; and one or more springs.

16. The device of claim 15 wherein said catch engagement guide is one or more slots cut into said front handle section, said catch engagement element of said release trigger projecting into said catch engagement guide, said catch engagement guide structured to guide the movement of said rear handle section and said catch engagement element of said release trigger from said one or more springs into engagement with said catch with said rear handle section in said rear handle section out-locked position.

17. The device of claim 15, wherein said one or more springs are extension springs.

18. The device mechanism of claim 15, further including a toggle link contacting the toggle pivot over center stop on said front handle section.

19. The device of claim 15, wherein said release trigger is movably mounted and retained on said rear handle section.

20. The device of claim 19, wherein said release trigger is slidably mounted and retained on said rear handle section.

* * * * *